US007232199B2

(12) United States Patent
Shinkawa et al.

(10) Patent No.: US 7,232,199 B2
(45) Date of Patent: Jun. 19, 2007

(54) DROPLET EJECTION APPARATUS AND METHOD OF DETECTING AND JUDGING EJECTION FAILURE IN DROPLET EJECTION HEADS

(75) Inventors: Osamu Shinkawa, Chino (JP); Yusuke Sakagami, Shiojiri (JP)

(73) Assignee: Seiko Epson Corporation (JP)

( * ) Notice: Subject to any disclaimer, the term of this patent is extended or adjusted under 35 U.S.C. 154(b) by 331 days.

(21) Appl. No.: 10/807,921

(22) Filed: Mar. 24, 2004

(65) Prior Publication Data

US 2005/0116977 A1 Jun. 2, 2005

(30) Foreign Application Priority Data

Mar. 28, 2003 (JP) ..... 2003-092934

(51) Int. Cl.
*B41J 29/393* (2006.01)
*B41J 2/165* (2006.01)

(52) U.S. Cl. ..... 347/19; 347/23

(58) Field of Classification Search ..... 347/19, 347/23

See application file for complete search history.

(56) References Cited

U.S. PATENT DOCUMENTS 4,034,380 A 7/1977 Isayama
4,498,088 A 2/1985 Kanayama
4,625,220 A * 11/1986 Nagashima ..... 347/19
5,500,657 A 3/1996 Yauchi et al.
5,818,473 A 10/1998 Fujii et al.
6,257,694 B1 7/2001 Tokumaru et al.
6,375,299 B1 4/2002 Foster et al.
2002/0089562 A1 7/2002 Simons et al.

FOREIGN PATENT DOCUMENTS

EP 0 985 533 A1 3/2000
JP 63-141750 * 6/1988
JP 02-003323 1/1990

(Continued)

OTHER PUBLICATIONS

Communication from European Patent Office re: counterpart application No. 04004519.7.

(Continued)

*Primary Examiner*—Julian D. Huffman
(74) *Attorney, Agent, or Firm*—Harness, Dickey & Pierce, P.L.C.

(57) ABSTRACT

The droplet ejection apparatus of the invention includes a plurality of droplet ejection heads 100 each having a diaphragm, an actuator that displaces the diaphragm, and a nozzle through which a liquid in a cavity is ejected in the form of droplets in response to the increase and decrease of the internal pressure of the cavity, ejection selecting means 182 for selecting the nozzle of the ink jet head 100 in the plurality of ink jet heads 100 through which a ink droplet is to be ejected, ejection failure detecting means 10 for detecting a residual vibration of the diaphragm and detecting an ejection failure of the droplets on the basis of a vibration pattern of the detected residual vibration, and switching means 23 for switching a connection of the actuator from a driving circuit to the ejection failure detecting means 10 after carrying out a droplet ejection operation by driving the actuator.

13 Claims, 48 Drawing Sheets

FOREIGN PATENT DOCUMENTS

| | | |
|---|---|---|
| JP | 08-309963 | 11/1996 |
| JP | 11-334102 | 12/1999 |
| JP | 2000-272116 | 10/2000 |
| JP | 2002-187263 | 7/2002 |

OTHER PUBLICATIONS

Communication from European Patent Office re: counterpart application No. 04004518.9.
Communication from PCT re: corresponding International Application No. PCT/JP2004/002401.
Communication from PCT re: corresponding International Application No. PCT/JP2004/002405.
Communication from PCT re: corresponding International Application No. PCT/JP2004/002400.
Communication from PCT re: corresponding International Application No. PCT/JP2004/002403.
Communication from PCT re: corresponding International Application No. PCT/JP2004/002414.
Communication from PCT re: corresponding International Application No. PCT/JP2004/002390.
Communication from PCT re: corresponding International Application No. PCT/JP2004/002437.
Communication from PCT re: corresponding International Application No. PCT/JP2004/002443.
Communication from European Patent Office regarding related application.

* cited by examiner (a) Before Adhesion of Paper Dust (b) After Adhesion of Paper Dust

DROPLET EJECTION APPARATUS AND METHOD OF DETECTING AND JUDGING EJECTION FAILURE IN DROPLET EJECTION HEADS

BACKGROUND OF THE INVENTION

1. Technical Field

The present invention relates to a droplet ejection apparatus and a method of detecting and judging an ejection failure in droplet ejection heads.

2. Background Art

An ink jet printer, which is one type of droplet ejection apparatus, forms an image on a predetermined sheet of paper by ejecting ink drops (droplets) via a plurality of nozzles of a printing head of the ink jet printer. The printing head (ink jet head) of the ink jet printer is provided with a number of nozzles. However, there is a case where some of the nozzles are blocked due to an increase of ink viscosity, intrusion of air bubbles, adhesion of dust or paper dust, or the like, and therefore these nozzles become unable to eject ink droplets. When the nozzles are blocked, missing dots occur within a printed image, which results in deterioration of image quality.

As far, a method of optically detecting a state where no ink droplets are ejected through the nozzles of the ink jet head (a state of failing ink droplet ejection) for each nozzle of the ink jet head was devised as a method of detecting such an ejection failure of an ink droplet (hereinafter, also referred to as the missing dot) (for example, Japanese Laid-Open Patent Application No. Hei. 8-309963 or the like). This method makes it possible to identify a nozzle causing the missing dot (ejection failure).

In the optical missing dot (droplet ejection failure) detecting method described above, however, a detector including a light source and an optical sensor is attached to a droplet ejection apparatus (for example, an ink jet printer). Hence, this detecting method generally has a problem that the light source and the optical sensor have to be set (or provided) with exact accuracy (high degree of accuracy) so that droplets ejected through the nozzles of the droplet ejection head (ink jet head) pass through a space between the light source and the optical sensor and therefore intercept light from the light source to the optical sensor. In addition, since such a detector is generally expensive, the droplet ejection apparatus having the detector has another problem that the manufacturing costs of the ink jet printer are increased. Further, since an output portion of the light source or a detection portion of the optical sensor may be smeared by ink mist through the nozzles or paper dust from printing sheets or the like, there is a possibility that the reliability of the detector becomes a matter of concern.

Further, although the optical missing dot detecting method described above can detect the missing dot, that is, an ejection failure (non-ejection) of ink droplets of the nozzles, the cause of the missing dot (ejection failure) cannot be identified (judged) on the basis of the detection result. Hence, there is another problem that it is impossible to select and carry out appropriate recovery processing depending on the cause of the missing dot (ejection failure). For this reason, sequential recovery processing is carried out independently of the cause of the missing dot in the conventional missing dot detecting method. For example, ink may be pump-sucked (vacuumed) from the ink jet head under circumstances where a wiping process might be sufficient for recovery. This increases discharged ink (wasted ink), or causes several types of recovery processing to be carried out because appropriate recovery processing is not carried out, and thereby reduces or deteriorates throughput of the ink jet printer (droplet ejection apparatus).

Here, the droplet ejection apparatus normally includes a plurality of nozzles and a plurality of actuators corresponding to the plurality of nozzles. In such a droplet ejection apparatus including a plurality of nozzles, it is difficult to detect an ejection failure (missing dot) of droplets (ink droplets) without deteriorating or reducing the throughput of the apparatus, that is, to detect a missing dot during a printing (recording) operation.

SUMMARY OF THE INVENTION

It is an object of the invention to provide a droplet ejection apparatus and a method of detecting and judging an ejection failure in droplet ejection heads that can detect an ejection failure of droplets in the droplet ejection heads and determine (identify) a cause of the ejection failure (missing dot) by identifying a cycle of a residual vibration of a diaphragm using change in an electric capacitance of the diaphragm in an actuator after a droplet ejection operation without deteriorating or reducing the throughput of the droplet ejection apparatus.

In order to achieve the above object, in one aspect of the invention, the present invention is directed to a droplet ejection apparatus. In one embodiment, the droplet ejection apparatus of the invention includes:

- a plurality of droplet ejection heads, each of the droplet ejection heads including:
  - a diaphragm;
  - an actuator which displaces the diaphragm;
  - a cavity filled with a liquid, an internal pressure of the cavity being increased and decreased in response to displacement of the diaphragm; and
  - a nozzle communicated with the cavity, through which the liquid in the cavity is ejected in the form of droplets in response to the increase and decrease of the internal pressure of the cavity;
- a driving circuit which drives the actuator of each of the droplet ejection heads;
- ejection selecting means for selecting the droplet ejection head in the plurality of droplet ejection heads through the nozzle of which a droplet is to be ejected;
- ejection failure detecting means for detecting a residual vibration of the diaphragm in the droplet ejection head selected by the ejection selecting means and detecting an ejection failure of droplets on the basis of a vibration pattern of the detected residual vibration of the diaphragm; and
- switching means for switching a connection of the actuator from the driving circuit to the ejection failure detecting means after carrying out a droplet ejection operation by driving the actuator.

According to the droplet ejection apparatus in the one embodiment of the invention, it is possible to detect and judge an ejection failure of the nozzle in each of the plurality of droplet ejection heads including the plurality of nozzles, and it is possible to scale down the circuitry of such a droplet ejection apparatus. It is also possible to prevent the manufacturing costs of the droplet ejection apparatus from increasing.

In this case, in the droplet ejection apparatus of the invention it is preferable that the droplet ejection apparatus is adapted to sequentially carry out the detection of the ejection failure of the droplets for the plurality of droplet ejection heads one by one. This makes it possible to detect and judge the ejection failure of all the nozzles surely.

Further, in another embodiment of the invention, the droplet ejection apparatus of the invention includes:

a plurality of droplet ejection heads, each of the droplet ejection heads including:

a diaphragm;

an actuator which displaces the diaphragm;

a cavity filled with a liquid, an internal pressure of the cavity being increased and decreased in response to displacement of the diaphragm; and a nozzle communicated with the cavity, through which the liquid in the cavity is ejected in the form of droplets in response to the increase and decrease of the internal pressure of the cavity;

a driving circuit which drives the actuator of each of the droplet ejection heads;

ejection selecting means for selecting the droplet ejection head or droplet ejection heads in the plurality of droplet ejection heads through the nozzle of each of which a droplet is to be ejected;

a plurality of ejection failure detecting means for detecting a residual vibration of the diaphragm in each of the droplet ejection heads selected by the ejection selecting means and detecting an ejection failure of the droplets on the basis of a vibration pattern of the detected residual vibration of the diaphragm in each of the droplet ejection heads; and a plurality of switching means which, after carrying out droplet ejection operations by driving the actuators corresponding to the selected droplet ejection heads, respectively switch connections of the driven actuators from the driving circuit to the plurality of ejection failure detecting means corresponding to the driven actuators.

According to the droplet ejection apparatus in another embodiment of the invention, it is possible to carry out the ejection failure detecting and judging processing for the nozzles of the droplet ejection heads having the plurality of nozzles at a time. This makes it possible to carry out the ejection failure detecting and judging processing for all the nozzles or arbitrary nozzles in a short time.

In this case, in the droplet ejection apparatus of the invention it is preferable that the droplet ejection apparatus is adapted to carry out the detection of the ejection failure of the droplets for each of the plurality of droplet ejection heads substantially simultaneously. This makes it possible to carry out the ejection failure detecting and judging processing for all the nozzles in a short time surely.

Further, in the droplet ejection apparatus of the invention it is preferable that each of the plurality of switching means carries out the switching operation in response to a predetermined switching signal. In this case, it is preferable that the droplet ejection apparatus of the invention further includes switching control means for controlling the switching means that corresponds to the droplet ejection head selected by the ejection selecting means to carry out the switching operation. In the droplet ejection apparatus of the invention it is preferable that the switching control means comprises a plurality of AND circuits that respectively correspond to the plurality of switching means and are placed between the ejection selecting means and the respective switching means. Thus, since the switching means into which the switching signal is not inputted does not carry out the switching operation, the corresponding ejection failure detecting means does not carry out the ejection failure detecting and judging processing. This makes it possible to avoid carrying out useless ejection failure detecting and judging processing.

In still another embodiment of the invention, a droplet ejection apparatus includes:

a plurality of droplet ejection heads, each of the droplet ejection heads including:

a diaphragm;

an actuator which displaces the diaphragm;

a cavity filled with a liquid, an internal pressure of the cavity being increased and decreased in response to displacement of the diaphragm; and a nozzle communicated with the cavity, through which the liquid in the cavity is ejected in the form of droplets in response to the increase and decrease of the internal pressure of the cavity;

a driving circuit which drives the actuator of each droplet ejection head;

ejection selecting means for selecting the nozzle of the droplet ejection head in the plurality of droplet ejection heads from which a droplet is to be ejected;

detection determining means that determines for which nozzle of the droplet ejection head an ejection failure of the droplets is to be detected;

ejection failure detecting means for detecting a residual vibration of the diaphragm in the droplet ejection head determined by the detection determining means and detecting the ejection failure of the droplets on the basis of a vibration pattern of the detected residual vibration of the diaphragm; and a plurality of switching means respectively corresponding to the plurality of droplet ejection heads, wherein, after carrying out a droplet ejection operation by driving the actuator corresponding to the nozzle of the droplet ejection head determined by the detection determining means, the switching means corresponding to the determined droplet ejection head switches a connection of the driven actuator in the determined droplet ejection head from the driving circuit to the ejection failure detecting means.

According to the droplet ejection apparatus of still another embodiment, it is possible to carry out the ejection failure detecting and judging processing more effectively than the droplet ejection apparatus in the other embodiments mentioned above. Further, compared with the droplet ejection apparatus provided with the plurality of ejection failure detecting means, since it is sufficient for the droplet ejection apparatus of the present embodiment to be provided with one ejection failure detecting means, it is possible to scale down the circuitry of the droplet ejection apparatus, and this makes it possible to prevent the manufacturing costs of the droplet ejection apparatus from increasing.

In the droplet ejection apparatus of the present embodiment, it is preferable that the detection determining means includes:

switching selection means for selecting the switching means corresponding to any one of the plurality of droplet ejection heads to carry out the switching operation; and switching control means for controlling the switching means corresponding to the droplet ejection head selected by the switching selection means and the ejection selecting means to carry out the switching operation;

wherein, when the switching means corresponding to the droplet ejection head determined by the detection determining means is switched by the switching control means to carry out the switching operation, the ejection failure detecting means detects the ejection failure in the determined droplet ejection head.

In this case, it is preferable that (claim 10) Thus, since it is sufficient for the droplet ejection apparatus to be provided with one ejection failure detecting means, it is possible to scale down the circuitry of the droplet ejection apparatus, and this makes it possible to prevent the manufacturing costs of the droplet ejection apparatus from increasing.

In the droplet ejection apparatus of any one of the above-mentioned embodiments, it is preferable that (claim 11) In this way, since the droplet ejection apparatus of the invention can detect the ejection failure of the droplets even during the printing (recording) operation, that is, even at the droplet ejection operations during the printing operation, the throughput of the droplet ejection apparatus of the invention will be neither reduced nor deteriorated.

The residual vibration of the diaphragm referred to herein means a state in which the diaphragm keeps vibrating while damping due to the droplet ejection operation after the actuator carried out the droplet ejection operation according to a driving signal (voltage signal) from the driving circuit until the actuator carries out the droplet ejection operation again in response to input of the following driving signal.

Further, it is preferable that the ejection failure detecting means includes judging means for judging presence or absence of the ejection failure of the droplets in the droplet ejection heads on the basis of the vibration pattern of the residual vibration of the diaphragm. In this case, it is preferable that the judging means judges a cause of the ejection failure in the case where it is judged that the ejection failure of the droplets is present in the droplet ejection heads. Here, it is preferable that the vibration pattern of the residual vibration of the diaphragm includes a cycle of the residual vibration. This makes it possible to judge the cause of the ejection failure of droplets that the conventional apparatus capable of carrying out the missing dot such as an optically detecting apparatus cannot judge, and therefore, it is possible to select and carry out appropriate recovery processing in accordance with the cause if needed.

In this case, it is preferable that the judging means judges that: an air bubble has intruded into the cavity in the case where the cycle of the residual vibration of the diaphragm is shorter than a predetermined range of cycle; the liquid in the vicinity of the nozzle has thickened due to drying in the case where the cycle of the residual vibration of the diaphragm is longer than a predetermined threshold; and paper dust is adhering in the vicinity of the outlet of the nozzle in the case where the cycle of the residual vibration of the diaphragm is longer than the predetermined range of cycle and shorter than the predetermined threshold. In this regard, in the invention, "paper dust" is not limited to mere paper dust generated from a recording sheet or the like. For example, the "paper dust" includes all the substances that could adhere in the vicinity of the nozzles and impede ejection of droplets, such as pieces of rubber from the advancing roller (feeding roller) and dust afloat in air.

It is preferable that the droplet ejection apparatus of the invention further comprises storage means for storing the judgment result judged by the judging means. This makes it possible to carry out appropriate recovery processing on the basis of the stored judgment result at proper timing such as after the end of the printing operation, for example.

Further, it is preferable that the ejection failure detecting means includes an oscillation circuit and the oscillation circuit oscillates in response to an electric capacitance component of the actuator that varies with the residual vibration of the diaphragm. Moreover, it is preferable that the ejection failure detecting means includes a resistor element connected to the actuator, and the oscillation circuit forms a CR oscillation circuit based on the electric capacitance component of the actuator and a resistance component of the resistor element. In this way, because the droplet ejection apparatus of the invention detects the residual vibration waveform (voltage waveform in response to the residual vibration) of the diaphragm as a minute time-series change (change of the oscillation cycle) of the electric capacitance component of the actuator, the residual vibration waveform of the diaphragm can be detected with accuracy independently of the magnitude of an electromotive voltage in the case where a piezoelectric element is used as the actuator.

It is preferable that the droplet ejection apparatus of the invention is adapted so that the oscillation frequency of the oscillation circuit is set to one or more orders of magnitude higher than the vibration frequency of the residual vibration of the diaphragm. By setting the oscillation frequency of the oscillation circuit to a few or several tens of times or more than the frequency of the residual vibration of the diaphragm in this way, it is possible to detect the residual vibration of the diaphragm more accurately, and this makes it possible to detect the ejection failure of droplets more accurately.

It is preferable that the ejection failure detecting means includes an F/V converting circuit that generates a voltage waveform in response to the residual vibration of the diaphragm from a predetermined group of signals generated based on changes in an oscillation frequency of an output signal from the oscillation circuit. By generating the voltage waveform with the use of the F/V converting circuit in this manner, it is possible to set the detection sensitivity to a larger magnitude when the residual vibration waveform is detected, without affecting the driving of the actuator.

Furthermore, it is preferable that the ejection failure detecting means includes a waveform shaping circuit that shapes the voltage waveform in response to the residual vibration of the diaphragm generated by the F/V converting circuit into a predetermined waveform. In addition, it is preferable that the waveform shaping circuit includes: DC component eliminating means for eliminating a direct current component from the voltage waveform of the residual vibration of the diaphragm generated by the F/V converting circuit; and a comparator that compares the voltage waveform from which the direct current component thereof has been eliminated by the DC component eliminating means with a predetermined voltage value; and that the comparator generates and outputs a rectangular wave based on this voltage comparison.

Further, it is preferable that the ejection failure detecting means includes measuring means for measuring the cycle of the residual vibration of the diaphragm based on the rectangular wave generated by the waveform shaping circuit. In this case, it is preferable that the measuring means has a counter, and measures either a time between rising edges of the rectangular wave or a time between a rising edge and falling edge of the rectangular wave by counting pulses of a reference signal with the counter. By measuring the cycle of the rectangular wave with the use of the counter in this manner, it is possible to detect the cycle of the residual vibration of the diaphragm accurately in a simple manner.

In the droplet ejection apparatus of the invention, it is preferable that the actuator includes at least one of an electrostatic actuator and a piezoelectric actuator having a piezoelectric element and using a piezoelectric effect of the piezoelectric element. Since the droplet ejection apparatus of the invention can be applied to not only the electrostatic actuator constituted from the capacitor described above but also the piezoelectric actuator, it is possible to apply the invention to most of the existing droplet ejection apparatuses. Further, it is preferable that the droplet ejection apparatus of the invention includes an ink jet printer.

Further, in yet still another embodiment of the invention, a droplet ejection apparatus includes:

a plurality of droplet ejection heads, each of the droplet ejection heads including:
- a diaphragm;
- an actuator which displaces the diaphragm;
- a cavity filled with a liquid, an internal pressure of the cavity being increased and decreased in response to displacement of the diaphragm; and
- a nozzle communicated with the cavity, through which the liquid in the cavity is ejected in the form of droplets in response to the increase and decrease of the internal pressure of the cavity;

a driving circuit which drives the actuator of each droplet ejection head;

ejection selecting means for selecting the nozzle of the droplet ejection head in the plurality of droplet ejection heads from which a droplet is to be ejected;

control means for controlling the ejection selecting means;

ejection failure detecting means for detecting a residual vibration of the diaphragm in the droplet ejection head selected by the ejection selecting means and detecting the ejection failure of the droplets on the basis of a vibration pattern of the detected residual vibration of the diaphragm; and switching means for switching a connection of the actuator in the droplet ejection head from the driving circuit to the ejection failure detecting means.

Here, it is preferable that the control means controls the ejection selecting means on the basis of data for selecting the nozzle of the droplet ejection head that carries out droplet ejection operation or droplet ejection detecting processing, and driving/detection switching signal for controlling the switching operation of the switching means according to the state of the driving circuit.

Further, it is preferable that the control means connects the actuator to the driving circuit in the case of the droplet ejection operation, and switches the connection of the actuator from the driving circuit to the ejection failure detecting means after the displacing operation of the diaphragm is generated by the driving signal outputted from the driving circuit in the case of the ejection failure detecting processing.

It is preferable that the time period when the switching means connects the actuator to the ejection failure detecting means is a time period between the driving signal and the following driving signal, that is, within the driving halt period.

Further, it is preferable that the ejection failure detecting means detects the ejection failure for the nozzle selected the ejection selecting means. In this case, the nozzle selected by the ejection selecting means may scan the nozzles in the droplet ejection heads one by one to carry out the ejection failure detecting processing for the scanned droplet ejection head.

Here, it is preferable that the droplet ejection apparatus of the invention is provided with a plurality of ejection failure detecting means and a plurality of switching means, which respectively correspond to the plurality of nozzles in the plurality of droplet ejection heads. In this case, it is preferable that, by selecting all the nozzles in the droplet ejection heads by the switching means, the plurality of ejection failure detecting means detect the ejection failure for all the nozzles simultaneously. Alternatively, it is preferable that the droplet ejection apparatus of the invention further includes switching control means for selecting the plurality of switching means in sync with the plurality of nozzles selected by the ejection selecting means and inputting the driving/detection switching signals to the selected switching means, and the plurality of ejection failure detecting means detect the ejection failure for the plurality of nozzles selected by the ejection selecting means simultaneously.

Moreover, it is preferable that the droplet ejection apparatus of the invention is provided with the plurality of switching means respectively corresponding to the plurality of nozzles, and switching selection means for selecting the switching means arbitrarily to input the driving/detection switching signal to the selected switching means.

The switching selection means may be constructed to select any one of the plurality of switching means by selecting the plurality of switching means one by one on the basis of a scanning signal outputted from the control means. Further, it is preferable that the switching selection means carries out the switching operation in sync with the timing when the ejection selecting means selects the nozzle.

It is preferable that the droplet ejection apparatus of the invention is constructed so that an output signal from the switching selection means is inputted to the switching control means, and the driving/detection switching signal is inputted to the switching means on the basis of an AND operation of the selection result of the switching selection means and the selection result of the switching control means, whereby the ejection failure detecting means corresponding to the switching means detects the ejection failure.

Further, it is preferable that the droplet ejection apparatus of the invention is constructed so that the ejection failure detecting means detects the ejection failure of the droplets at either timing of the droplet ejection operation in a flushing process for the nozzle of the droplet ejection head selected by the ejection selecting means or timing of the droplet ejection operation during a printing operation.

Further, in yet still another embodiment of the invention, a droplet ejection apparatus includes:

a plurality of droplet ejection heads, each of the droplet ejection heads including an actuator, a diaphragm displaced by the actuator, a cavity filled with a liquid, and a nozzle communicated with the cavity, through which the liquid within the cavity is ejected in the form of droplets by driving the actuator, the plurality of droplet ejection heads being divided to m blocks (here, "m" is a natural number), and one of the m blocks including n droplet ejection heads (here, "n" is a natural number);

a driving circuit which drives the actuator of each of the droplet ejection heads;

a plurality of ejection failure detecting means for detecting a residual vibration of the diaphragm and detecting an ejection failure of the droplets on the basis of a vibration pattern of the detected residual vibration of the diaphragm, the number of ejection failure detecting means being the same as the number of blocks, and the plurality of ejection failure detecting means being respectively assigned to the blocks; and recovery means for carrying out recovery processing for the droplet ejection heads to eliminate a cause of the ejection failure of the droplets, the recovery means comprising at least flushing means for carrying out a flushing process by which the droplets are preliminarily ejected through the nozzles of the droplet ejection heads by driving the actuators corresponding to the droplet ejection heads;

wherein the droplet ejection apparatus is adapted to control the flushing means to carry out the flushing processes in which a droplet is in turn ejected through the nozzle of each of the droplet ejection heads in each of the blocks n'th times to a predetermined region on which the droplets are allowed to land in order to keep up a nozzle state of each of the droplet ejection heads, and at this time each of the plurality of ejection failure detecting means sequentially carries out the detection of the ejection failure for each of the n droplet ejection heads in the block.

According to the droplet ejection apparatus in yet still another embodiment of the invention, since the ejection failure detecting and judging processing is carried out during the flushing process, it is possible to become efficient without the need for a special time required carrying out the ejection failure detecting and judging processing, and it is possible to detect and judge an ejection failure of the nozzle in the respective droplet ejection heads having a plurality of nozzles while keeping the amount of consumption of ink to a minimum.

Further, since the number of ejection of droplets (that is, "n") is the same as the number of droplet ejection heads in one block and the same number of ejection failure detecting means as the number of blocks (that is, "m") are provided to the droplet ejection apparatus of the invention, it is possible to carry out the ejection failure detecting and judging processing surely for the droplet ejection heads one by one at the "n" ejections of the droplets. Moreover, it is possible to reduce the number of ejection failure detecting means in comparison with the case where the number of ejection failure detecting means is the same as the number of droplet ejection heads, and this makes it possible to scale down the circuitry of the droplet ejection heads, and to prevent the manufacturing costs of the droplet ejection apparatus from increasing.

It is preferable that the droplet ejection apparatus of the invention further includes a plurality of switching means, each of the plurality of switching means switching connections of the actuators in each of the blocks from the driving circuit to the corresponding ejection failure detecting means after carrying out the droplet ejection operation by driving the actuators.

Moreover, it is preferable that the droplet ejection apparatus of the invention further includes judging means for judging presence or absence of the ejection failure of the droplets in the droplet ejection heads on the basis of the vibration pattern of the residual vibration of the diaphragm. In this case, it is preferable that the judging means judges a cause of the ejection failure in the case where the judging means judges that the ejection failure of the droplets is present in the droplet ejection heads. Furthermore, it is preferable that the judging means judges that: an air bubble has intruded into the cavity in the case where the cycle of the residual vibration of the diaphragm is shorter than a predetermined range of cycle; the liquid in the vicinity of the nozzle has thickened due to drying in the case where the cycle of the residual vibration of the diaphragm is longer than a predetermined threshold; and paper dust is adhering in the vicinity of the outlet of the nozzle in the case where the cycle of the residual vibration of the diaphragm is longer than the predetermined range of cycle and shorter than the predetermined threshold. This makes it possible to judge the cause of the ejection failure of droplets that the conventional apparatus capable of carrying out the missing dot such as an optically detecting apparatus cannot judge, and therefore, it is possible to select and carry out appropriate recovery processing in accordance with the cause if needed.

Further, it is preferable that the droplet ejection apparatus is adapted to periodically carry out the detection of the ejection failure by ejecting the droplets n'th times. This makes it possible to keep up the state of the nozzles in the respective droplet ejection heads, and it is possible to carry out the ejection failure detecting and judging processing for the respective nozzles periodically.

Moreover, it is preferable that the droplet ejection apparatus is adapted to periodically carry out the detection of the ejection failure by ejecting the droplets n'th times every reciprocation of the droplet ejection heads. This makes it possible to keep up the state of the nozzles in the respective droplet ejection heads, and it is possible to carry out the ejection failure detecting and judging processing for the respective nozzles every reciprocation of the droplet ejection heads.

Furthermore, it is preferable that the droplet ejection apparatus is adapted to carry out the detection of the ejection failure by ejecting the droplets n'th times immediately after the droplet ejection apparatus has been powered on. This makes it possible to keep up the state of the nozzles in the respective droplet ejection heads surely immediately after the droplet ejection apparatus has been powered on, and it is possible to carry out the ejection failure detecting and judging processing for the respective nozzles at this time.

Further, it is preferable that the droplet ejection apparatus is adapted to periodically carry out the detection of the ejection failure by ejecting the droplets n'th times immediately after the recovery means has carried out the recovery processing. This makes it possible to keep up the state of the nozzles in the respective droplet ejection heads surely immediately after the recovery means has carried out the recovery processing, and it is possible to carry out the ejection failure detecting and judging processing for the respective nozzles at this time.

In another aspect of the invention, the invention is directed to a method of detecting and judging an ejection apparatus. The droplet ejection apparatus includes a driving circuit, a detecting circuit and a plurality of droplet ejection heads, each of the plurality of droplet ejection heads including a diaphragm, an actuator, a cavity and a nozzle. The method includes the steps of:

selecting the nozzle of the droplet ejection head in the plurality of droplet ejection heads through which a droplet is to be ejected;

driving the actuator of the selected droplet ejection head with the driving circuit to displace the diaphragm;

carrying out a droplet ejecting operation through the nozzle;

switching a connection of the actuator from the driving circuit to the detecting circuit after carrying out the droplet ejection operation;

detecting a residual vibration of the diaphragm with the detecting circuit; and detecting an ejection failure of the droplets on the basis of a vibration pattern of the detected residual vibration of the diaphragm.

It is preferable that the droplet ejection apparatus includes a plurality of detecting circuits respectively corresponding to the plurality of droplet ejection heads; and that the switching step includes switching connections of the actuators corresponding to the plurality of droplet ejection heads from the driving circuit to the detecting circuits respectively corresponding to the plurality of droplet ejection heads. In this case, it is preferable that the switching step includes switching connections of the actuators in only the selected droplet ejection heads in the selecting step from the driving circuit to the corresponding detecting circuits.

Further, it is preferable that the method further includes the step of: specifying an arbitrary droplet ejection head in the plurality of droplet ejection heads; wherein the switching step includes switching connections of the actuator in the specified droplet ejection head from the driving circuit to the corresponding detecting circuit. Moreover, it is preferable that the ejection failure detecting step includes detecting the ejection failure of the droplets ay either timing of the droplet ejection operation in a flushing process for the nozzle of the droplet ejection head in question or timing of the droplet ejection operation during a printing operation.

In addition, it is preferable that the method of the invention further includes the steps of: judging presence or absence of the ejection failure of the droplets in the droplet ejection heads on the basis of the vibration pattern of the residual vibration of the diaphragm; and judging a cause of the ejection failure in the case where it is judged that the ejection failure of the droplets is present in the droplet ejection heads.

Here, it is preferable that the vibration pattern of the residual vibration of the diaphragm includes a cycle of the residual vibration; and that the cause judging step includes judging that: an air bubble has intruded into the cavity in the case where the cycle of the residual vibration of the diaphragm is shorter than a predetermined range of cycle; the liquid in the vicinity of the nozzle has thickened due to drying in the case where the cycle of the residual vibration of the diaphragm is longer than a predetermined threshold; and paper dust is adhering in the vicinity of the outlet of the nozzle in the case where the cycle of the residual vibration of the diaphragm is longer than the predetermined range of cycle and shorter than the predetermined threshold. In this regard, it is preferable that the method of the invention further includes the step of: storing the judgment result judged in the judging step into a storage section.

BRIEF DESCRIPTION OF THE DRAWINGS

The above and other objects, features, and the advantages of the invention will readily become more apparent from the following detailed description of preferred embodiments of the invention with reference to the accompanying drawings.

DETAILED DESCRIPTION OF THE PREFERRED EMBODIMENTS

Preferred embodiments of a droplet ejection apparatus and a method of detecting and judging an ejection failure in droplet ejection heads of the invention will now be described in detail with reference to FIGS. 1–49. It is to be understood that these embodiments are mentioned for the purpose of illustration of the invention and interpretations of the content of the invention are not limited to these embodiments. It should be noted that, in the embodiments described below, an ink jet printer that prints an image on a recording sheet (droplet receptor) by ejecting ink (liquid material) will be described as one example of the droplet ejection apparatus of the invention.

(First Embodiment)

Figure 1:
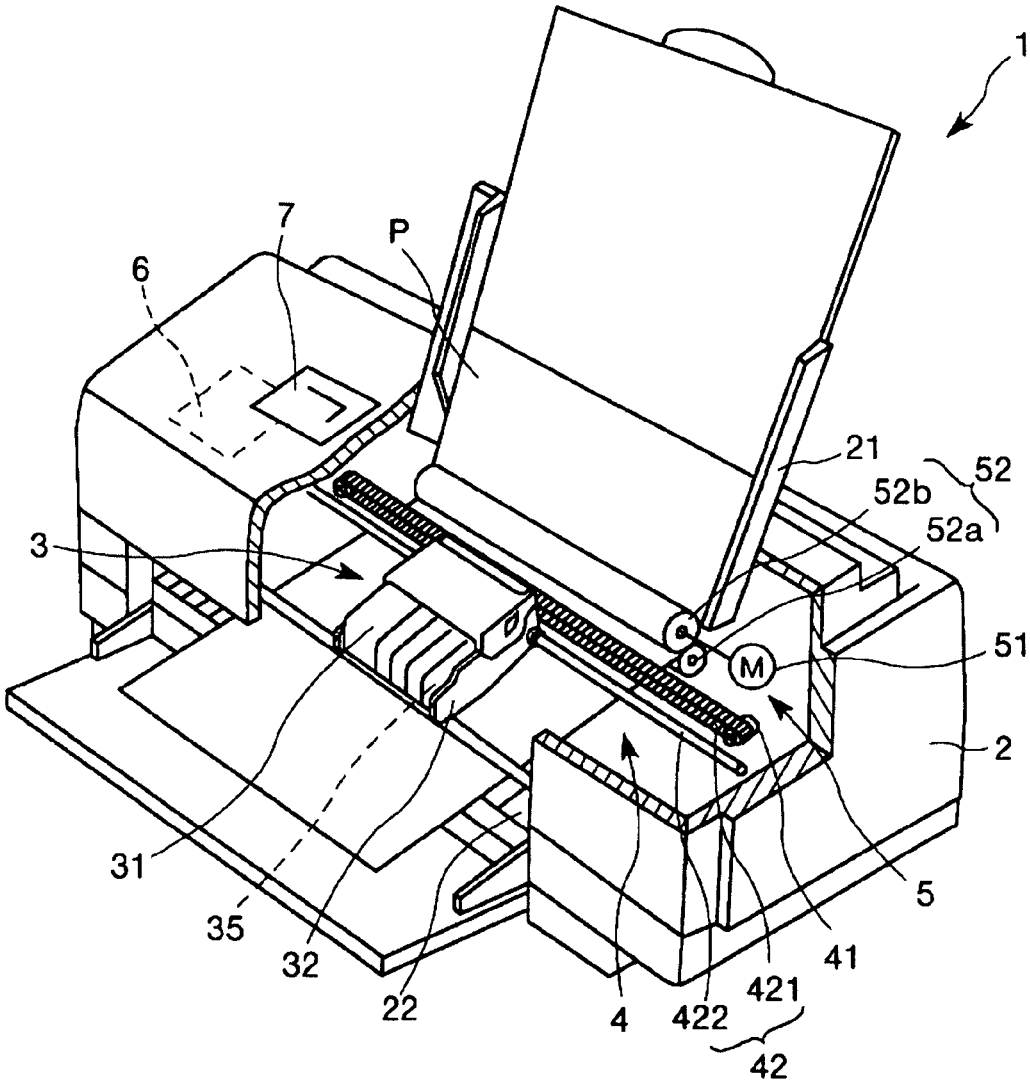
FIG. 1 is a schematic view showing the configuration of an ink jet printer as one type of droplet ejection apparatus of the invention.

FIG. 1 is a schematic view showing the configuration of an ink jet printer 1 as one type of droplet ejection apparatus according to a first embodiment of the invention. Now, in following explanations using FIG. 1, an upper side and lower side are referred to as "upper" and "lower," respectively. First, the configuration of the ink jet printer 1 will be described.

The ink jet printer 1 shown in FIG. 1 includes a main body 2. A tray 21 on which recording sheets P may be placed, a sheet discharge port 22, through which the recording sheet P is discharged, and an operation panel 7 are respectively provided in the rear of the top, in the front of the bottom, and on the top surface, of the main body 2.

The operation panel 7 is provided with a display portion (not shown) for displaying an error message or the like, such as a liquid crystal display, an organic EL display, an LED lamp or the like, and an operation portion (not shown) comprising various kinds of switches or the like.

Further, the main body 2 mainly includes a printing device 4 equipped with printing means (moving element) 3 which undergoes a reciprocating motion, a feeder (droplet receptor transporting means) 5 which feeds and discharges a recording sheet P to/from the printing device 4 one by one, and a control section (control means) 6 which controls the printing device 4 and the feeder 5.

The feeder 5 intermittently feeds recording sheets P one by one under the control of the control section 6. The recording sheet P passes by the vicinity of the bottom of the printing means 3. In this instance, the printing means 3 reciprocates in a direction substantially perpendicular to the feeding direction of the recording sheet P, thereby carrying out a printing operation on the recording sheet P. In other words, the printing operation by the ink jet method is carried out so that the reciprocating motion of the printing means 3 and the intermittent feeding of the recording sheet P constitute the main scanning and the sub scanning of printing, respectively.

The printing device 4 is provided with the printing means 3, a carriage motor 41 serving as a driving source for moving the printing means 3 (making it to reciprocate) in the main scanning direction, and a reciprocating mechanism 42 which receives rotations of the carriage motor 41 and making the printing means 3 to reciprocate in the main scanning direction.

The printing means 3 includes a plurality of head units 35 on which a plurality of nozzles 110 are provided in accordance with ink types, a plurality of ink cartridges (I/C) 31 each respectively supplying the head units 35 with inks, a carriage 32 on which the head units 35 and ink cartridges 31 are mounted.

Further, as will be described in FIG. 3, the head unit 35 is provided with a number of ink jet recording heads (i.e., ink jet heads or droplet ejection heads) 100 each comprising a nozzle 110, a diaphragm 121, an electrostatic actuator 120, a cavity 141, an ink supply port 142, and the like. In this regard, although FIG. 1 shows the configuration in which the head units 35 and the ink cartridges 31 are included, the invention is not limited to this configuration. For example, the invention may include a configuration in which the ink cartridges 31 are provided in another place instead of being mounted on the carriage 32, and communicates with the head units 35 via tubes or the like to supply inks thereto (not shown in the drawings). Hereinafter, the configuration in which the plurality of ink jet heads 100, each of which comprises the nozzle 110, the diaphragm 121, the electrostatic actuator 120, the cavity 141, the ink supply port 142, and the like, are provided will be referred to as the "head unit 35".

By using cartridges respectively filled with four colors of inks, including yellow, cyan, magenta, and black, as the ink cartridges 31, full-color printing becomes possible. In this case, the head units 35 respectively corresponding to the colors are provided in the printing means 3. Here, FIG. 1 shows four ink cartridges 31 respectively corresponding to four colors of inks, but the printing means 3 may be configured to further include an ink cartridge or ink cartridges 31 for other ink such as light cyan, light magenta, or dark yellow a special color or the like.

The reciprocating mechanism 42 includes a carriage guide shaft 422 supported by a frame (not shown) at both ends thereof, and a timing belt 421 extending in parallel with the carriage guide shaft 422.

The carriage 32 is supported by the carriage guide shaft 422 of the reciprocating mechanism 42 so as to be able to reciprocate and is fixed to a part of the timing belt 421.

When the timing belt 421 is run forward and backward via a pulley by the operation of the carriage motor 41, the printing means 3 is guided by the carriage guide shaft 422 and starts to reciprocate. During this reciprocating motion, ink droplets are ejected through the nozzles 110 of the plurality of ink jet heads 100 in the head units 35 as needed in response to image data (printing data) to be printed, thereby carrying out printing operation onto the recording sheet P.

The feeder 5 includes a feeding motor 51 serving as a driving source thereof, and a feeding roller 52 which is rotated in association with the operation of the feeding motor 51.

The feeding roller 52 comprises a driven roller 52*a* and a driving roller 52*b* which vertically face across a transportation path of a recording sheet P (i.e., a recording sheet P). The driving roller 52*b* is connected to the feeding motor 51. This allows the feeding roller 52 to feed a number of recording sheets P placed on the tray 21 to the printing device 4 one by one, and discharge the recording sheets P from the printing device 4 one by one. Instead of the tray 21, a feeding cassette in which the recording sheets P can be housed may be removably attached.

The control section 6 carries out a printing operation on a recording sheet P by controlling the printing device 4, the feeder 5 and the like according to the printing data inputted from a host computer 8 such as a personal computer (PC), a digital camera (DC) or the like. The control section 6 also controls the display portion of the operation panel 7 to display an error message or the like, or an LED lamp or the like to be turned ON/OFF, and controls the respective portions to carry out corresponding processes according to press signals of various switches inputted from the operation portion.

Figure 2:
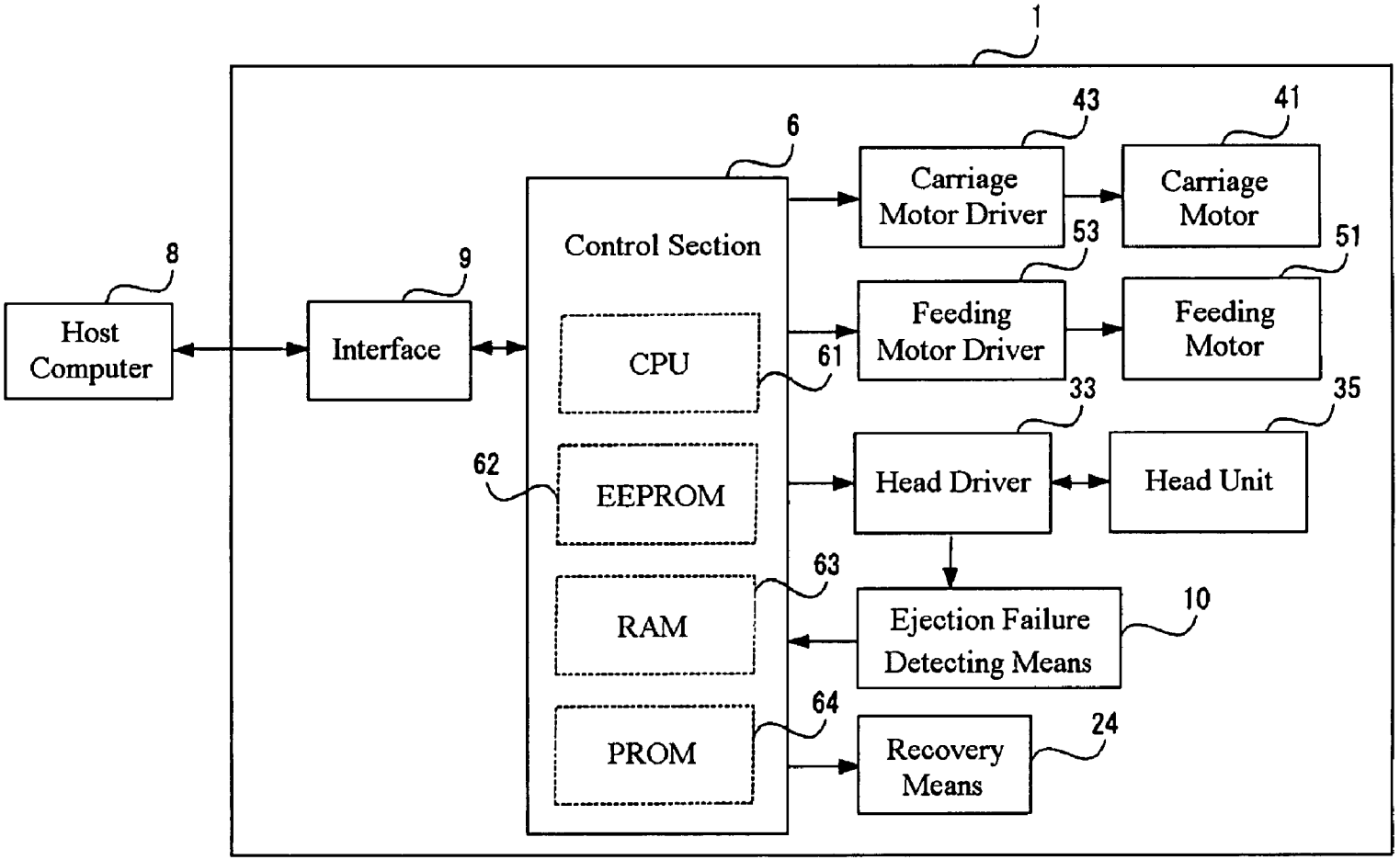
FIG. 2 is a block diagram schematically showing a major portion of the ink jet printer (droplet ejection apparatus) of the invention.

FIG. 2 is a block diagram schematically showing a major portion of the ink jet printer of the invention. Referring to FIG. 2, the ink jet printer 1 of the invention is provided with an interface portion (IF) 9 for receiving printing data or the like inputted from the host computer 8, the control section 6, the carriage motor 41, a carriage motor driver 43 for controlling the driving of the carriage motor 41, the feeding motor 51, a feeding motor driver 53 for controlling the driving of the feeding motor 51, the head units 35, a head driver 33 for controlling the driving of the head units 35, ejection failure detecting means 10, and recovery means 24. In this regard, the ejection failure detecting means 10, the recovery means 24, and the head driver 33 will be described later in detail.

Referring to FIG. 2, the control section 6 is provided with a CPU (Central Processing Unit) 61 which carries out various types of processes such as a printing process, ejection failure detecting and judging processing or the like, an EEPROM (Electrically Erasable Programmable Read-Only Memory) (storage means) 62 as one kind of nonvolatile semiconductor memory for storing the printing data inputted from the host computer 8 via the IF 9 in a data storage region (not shown), a RAM (Random Access Memory) 63 for temporarily storing various kinds of data when the ejection failure detecting and judging processing or the like (described later) is carried out or temporarily opening up application programs for printing processes or the like, and a PROM 64 as one kind of nonvolatile semiconductor memory in which control programs and the like for controlling the respective portions are stored. The components of the control section 6 are electrically connected to each other via a bus (not shown).

As described above, the printing means 3 is provided with the plurality of head units 35 respectively corresponding to the colors of inks. Further, each head unit 35 is provided with a plurality of nozzles 110 and the plurality of electrostatic actuators 120 respectively corresponding to the nozzles 110 (that is, the plurality of ink jet heads 100). In other words, each head unit 35 is configured to include a plurality of ink jet heads 100 (droplet ejection heads) each comprising a set including a nozzle 110 and an electrostatic actuator 120. The head driver 33 comprises a driving circuit 18 for driving the electrostatic actuators 120 of the respective ink jet heads 100 to control ejection timing of inks, and switching means 23 (see FIG. 16). In this regard, the configuration of the ink jet head 100 and the electrostatic actuator 120 will be described later.

Although it is not shown in the drawings, various kinds of sensors capable of detecting, for example, a remaining quantity of ink in each of the ink cartridges 31, the position of the printing means 3, printing environments such as temperature, humidity and the like are electrically connected to the control section 6.

When the control section 6 receives printing data from the host computer 8 via the IF 9, the control section 6 stores the printing data in the EEPROM 62. The CPU 61 then executes a predetermined process on the printing data, and outputs driving signals to each of the drivers 33, 43, and 53 according to the processed data and input data from the various kinds of sensors. When these driving signals are respectively inputted through the drivers 33, 43, and 53, the plurality of electrostatic actuators 120 corresponding to the plurality of ink jet heads 100 in the respective head units 35, the carriage motor 41 of the printing device 4, and the feeder 5 start to operate individually. In this way, a printing operation is effected on a recording sheet P.

Figure 4:
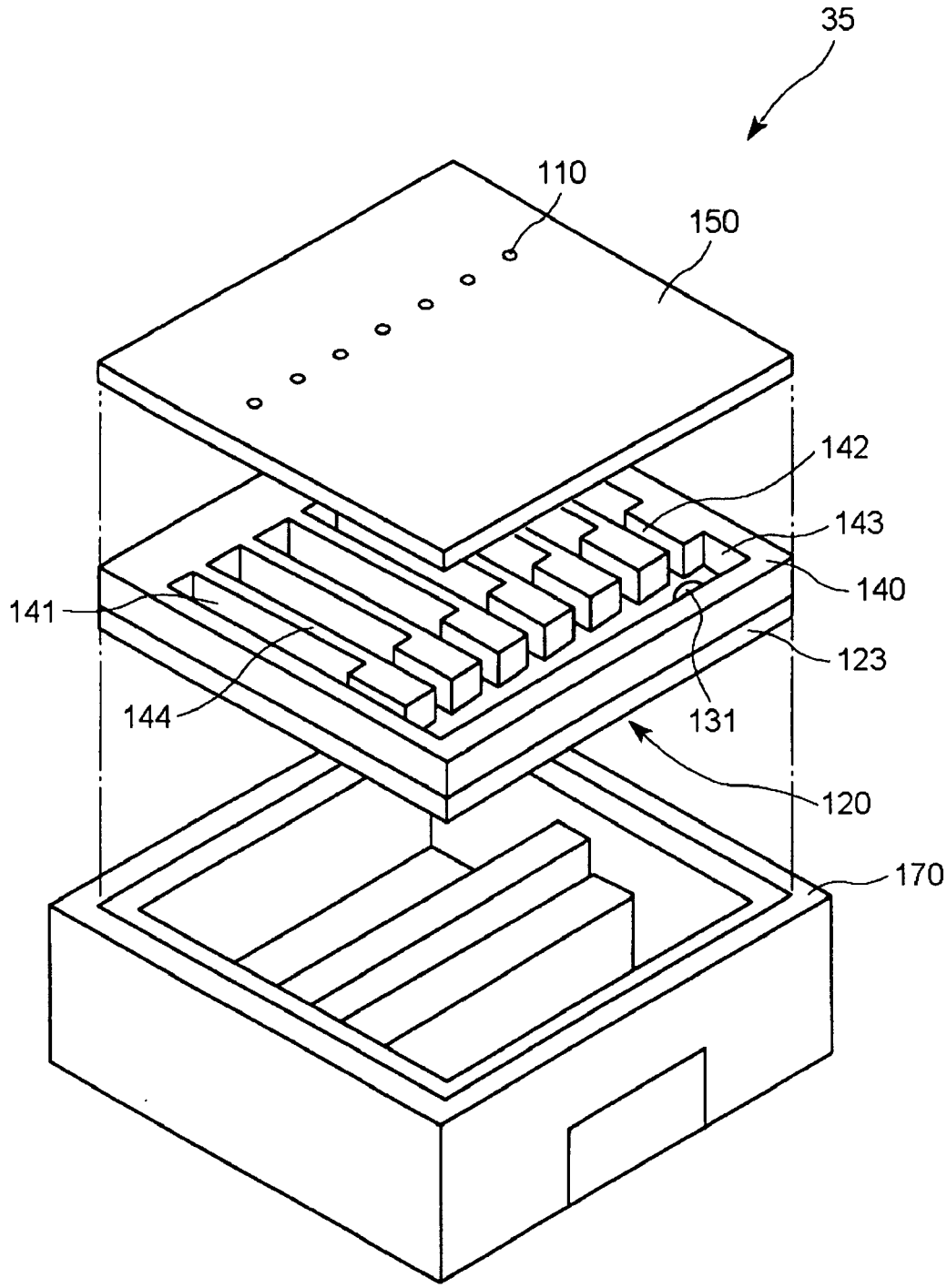
FIG. 4 is an exploded perspective view showing the configuration of the head unit shown in FIG. 3 corresponding to one color of ink.
Figure 5:
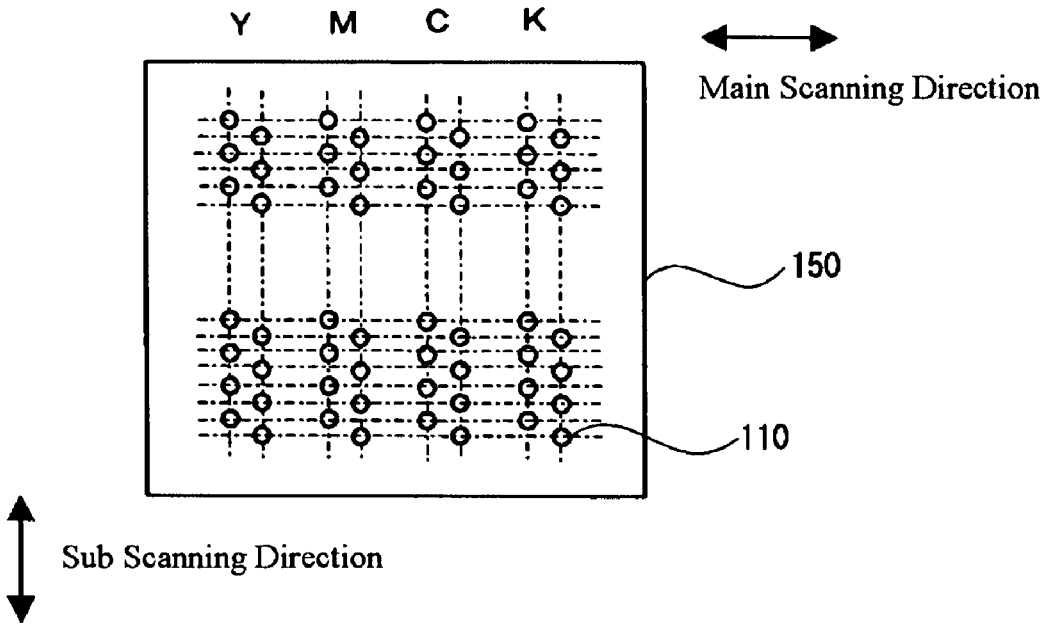
FIG. 5 shows one example of a nozzle arrangement pattern in a nozzle plate of the head unit using four colors of inks.

Next, the structure of the ink jet head 100 in each head unit 35 in the printing means 3 will now be described. FIG. 3 is a schematic cross sectional view of the head unit 35 (ink jet head 100) shown in FIG. 1 (including common components such as the ink cartridge 31). FIG. 4 is an exploded perspective view schematically showing the configuration of the head unit 35 corresponding to one color of ink. FIG. 5 is a plan view showing an example of a nozzle surface of the head unit 35 shown in FIG. 3 on which the plurality of ink jet heads 100 are provided. It should be noted that FIGS. 3 and 4 are shown upside down from the normally used state and FIG. 5 is a plan view when the ink jet head 100 shown in FIG. 3 is viewed from the top of the drawing.

Figure 3:
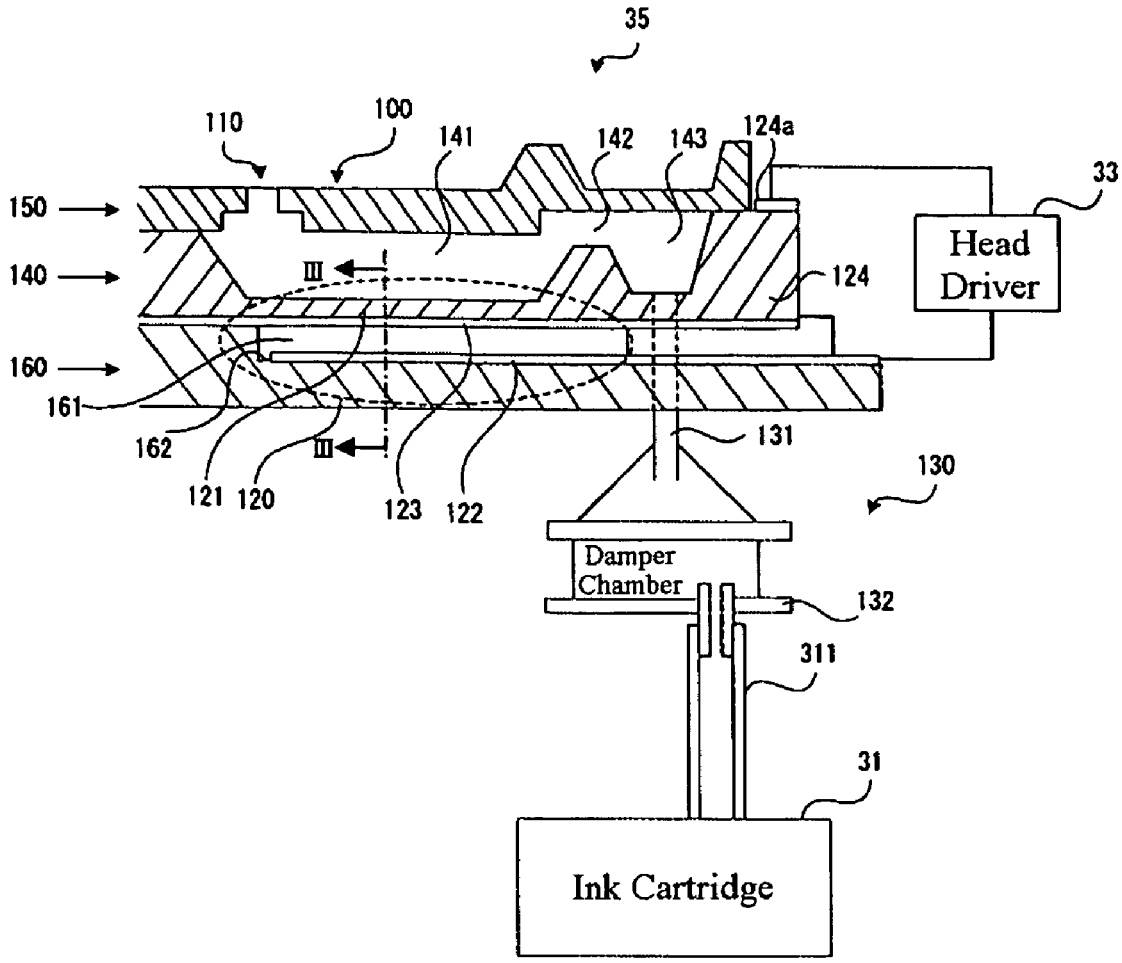
FIG. 3 is a schematic cross sectional view of an ink jet head of a head unit (ink jet head) in the ink jet printer shown in FIG. 1.

As shown in FIG. 3, the head unit 35 is connected to the ink cartridge 31 via an ink intake port 131, a damper chamber 130, and an ink supply tube 311. The damper chamber 130 is provided with a damper 132 made of rubber. The damper chamber 130 makes it possible to absorb fluctuation of ink and a change in ink pressure when the carriage 32 reciprocates, whereby it is possible to supply each ink jet head 100 in the head unit 35 with a predetermined quantity of ink in a stable manner.

Further, the head unit 35 has a triple-layer structure, in which a silicon substrate 140 in the middle, a nozzle plate 150 also made of silicon, which is layered on the upper side of the silicon substrate 140 in FIG. 3, and a borosilicate glass substrate (glass substrate) 160 having a coefficient of thermal expansion close to that of silicon, which is layered on the lower side of the silicon substrate 140. A plurality of independent cavities (pressure chambers) 141 (seven cavities are shown in FIG. 4), one reservoir (common ink chamber) 143, and grooves each serving as an ink supply port (orifice) 142 that allows communication between the reservoir 143 and each of the cavities 141 are formed in the silicon substrate 140 of the middle layer. Each groove may be formed, for example, by applying an etching process from the surface of the silicon substrate 140. The nozzle plate 150, the silicon substrate 140, and the glass substrate 160 are bonded to each other in this order, whereby each of the cavities 141, the reservoir 143 and each of the ink supply ports 142 are defined therein.

Each of these cavities 141 is formed in the shape of a strip (rectangular prism), and is configured in such a manner that a volume thereof is variable with vibration (displacement) of a diaphragm 121 described later and this change in volume makes ink (liquid material) to be ejected through the nozzle (ink nozzle) 110. The nozzles 110 are respectively formed in the nozzle plate 150 at positions corresponding to the portions on the tip side of the cavities 141, and communicate with the respective cavities 141. Further, the ink intake port 131 communicating with the reservoir 143 is formed in the glass substrate 160 at a portion where the reservoir 143 is located. Ink is supplied from the ink cartridge 31 to the reservoir 143 by way of the ink supply tube 311 and the damper chamber 130 through the ink intake port 131. The ink supplied to the reservoir 143 passes through the respective ink supply ports 142 and is then supplied to the respective cavities 141 that are independent from each other. In this regard, the cavities 141 are respectively defined by the nozzle plate 150, sidewalls (partition walls) 144, and bottom walls 121.

The bottom wall 121 of each of the independent cavity 141 is formed in a thin-walled manner, and the bottom wall 121 is formed to function as a diaphragm that can undergo elastic deformation (elastic displacement) in the out-of-plane direction (its thickness direction), that is, in the vertical direction of FIG. 3. Consequently, hereinafter, the portion of this bottom wall 121 will be occasionally referred to as the diaphragm 121 for ease of explanation (in other words, the same reference numeral 121 is used for both the "bottom wall" and the "diaphragm").

Shallow concave portions 161 are respectively formed in the surface of the glass substrate 160 on the silicon substrate 140 side, at the positions corresponding to the cavities 141 in the silicon substrate 140. Thus, the bottom wall 121 of each cavity 141 faces, with a predetermined clearance in between, the surface of an opposing wall 162 of the glass substrate 160 in which the concave portions 161 are formed. In other words, a clearance (air gap) having a predetermined thickness (for example, approximately 0.2 microns) exists between the bottom wall 121 of each cavity 141 and a segment electrode 122 described later. In this case, the concave portions 161 can be formed by an etching process, for example.

The bottom wall (diaphragm) 121 of each cavity 141 forms a part of a common electrode 124 on the respective cavities 141 side for accumulating charges by a driving signal supplied from the head driver 33. In other words, the diaphragm 121 of each cavity 141 also serves as one of the counter electrodes (counter electrodes of the capacitor) in the corresponding electrostatic actuator 120 described later. The segment electrodes 122 each serving as an electrode opposing the common electrode 124 are respectively formed on the surfaces of the concave portions 161 in the glass substrate 160 so as to face the bottom walls 121 of the cavities 141. Further, as shown in FIG. 3, the surfaces of the bottom walls 121 of the respective cavities 141 are covered with an insulating layer 123 made of a silicon dioxide ($SiO_2$) film. In this manner, the bottom wall 121 of each cavity 141, that is, the diaphragm 121 and the corresponding segment electrode 122 form (constitute) the counter electrodes (counter electrodes of the capacitor) via the insulating layer 123 formed on the surface of the bottom wall 121 of the cavity 141 on the lower side of FIG. 3 and the clearance within the concave portion 161. Therefore, the diaphragm 121, the segment electrode 122, and the insulating layer 123 and the clearance therebetween form the major portion of the electrostatic actuator 120.

As shown in FIG. 3, the head driver 33 including the driving circuit 18 for applying a driving voltage between these counter electrodes carries out charge and discharge of these counter electrodes in response to a printing signal (printing data) inputted from the control section 6. One output terminal of the head driver (voltage applying means) 33 is connected to the respective segment electrodes 122, and the other output terminal is connected to an input terminal 124*a* of the common electrode 124 formed in the silicon substrate 140. Because the silicon substrate 140 is doped with impurities and therefore has conductive property by itself, it is possible to supply the common electrode 124 of the bottom walls 121 with a voltage from the input terminal 124*a* of the common electrode 124. Alternatively, for example, a thin film made of an electrically conductive material such as gold, copper, or the like may be formed on one surface of the silicon substrate 140. This makes it possible to supply a voltage (electric charges) to the common electrode 124 at low electric resistance (efficiently). This thin film may be formed, for example, by vapor deposition, sputtering, or the like. In this embodiment, for example, because the silicon substrate 140 and the glass substrate 160 are coupled (bonded) to each other through anode bonding, an electrically conductive film used as an electrode in this anode bonding is formed on the silicon substrate 140 on the channel forming surface side (i.e., on the top side of the silicon substrate 140 shown in FIG. 3). This electrically conductive film is directly used as the input terminal 124*a* of the common electrode 124. It should be appreciated, however, that in the invention, for example, the input terminal 124*a* of the common electrode 124 may be omitted and the bonding method of the silicon substrate 140 and the glass substrate 160 is not limited to the anode bonding.

As shown in FIG. 4, the head unit 35 is provided with the nozzle plate 150 in which a plurality of nozzles 110 corresponding to a plurality of ink jet heads 100 are formed, the silicon substrate (ink chamber substrate) 140 in which a plurality of cavities 141, a plurality of ink supply ports 142, and one reservoir 143 are formed, and the insulating layer 123, all of which are accommodated in a base body 170 containing the glass substrate 160. The base body 170 is made of, for example, various kinds of resin materials, various kinds of metal materials, or the like, and the silicon substrate 140 is fixed to and supported by the base body 170.

The plurality of nozzles 110 formed in the nozzle plate 150 are aligned linearly and substantially parallel to the reservoir 143 in FIG. 4 to make the illustration simple. However, the alignment pattern of the nozzles 110 is not limited to this pattern, and they are normally arranged in a manner that steps are shifted as in the nozzle alignment pattern shown in FIG. 5, for example. Further, the pitch between the nozzles 110 can be set appropriately depending on the printing resolution (dpi: dot per inch). In this regard, FIG. 5 shows the alignment pattern of the nozzles 110 in the case where four colors of ink (ink cartridges 31) are applied.

Figure 6:
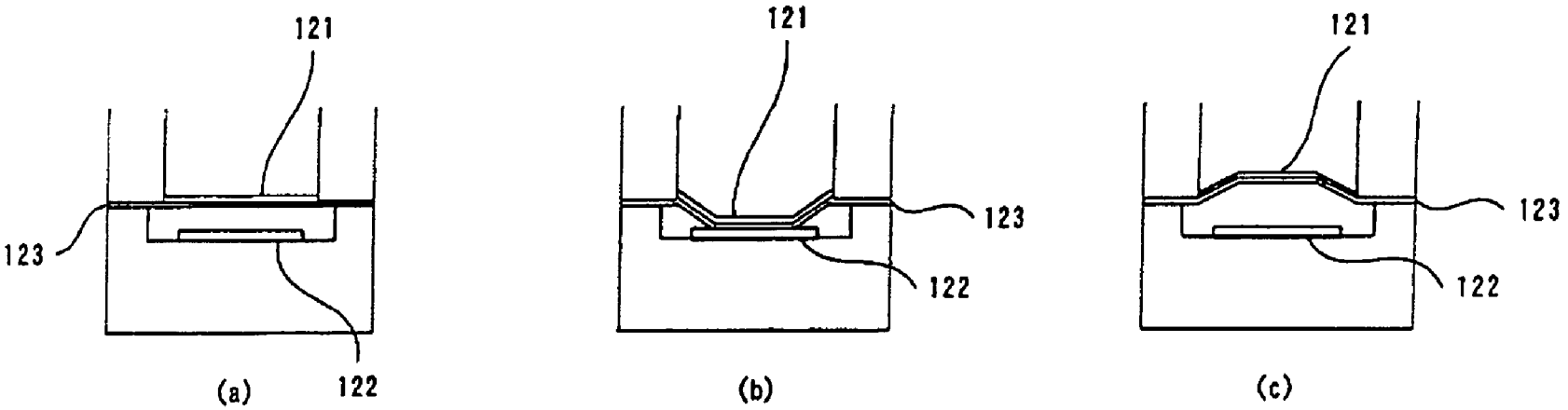
FIG. 6 is a state diagram showing respective states of a cross section taken along the line III—III of FIG. 3 when a driving signal is inputted.

FIG. 6 shows respective states of the cross section taken along the line III—III of FIG. 3 when a driving signal is inputted. When a driving voltage is applied between the counter electrodes from the head driver 33, Coulomb force is generated between the counter electrodes, whereby the bottom wall (diaphragm) 121 then bends (is attracted) towards the segment electrode 122 from the initial state (FIG. 6(*a*)) so that the volume of the cavity 141 is increased (FIG. 6(*b*)). When the electric charges between the counter electrodes are discharged abruptly at this state under the control of the head driver 33, the diaphragm 121 restores upward in the drawing due to its elastic restoring force, whereby the diaphragm 121 moves upwards above its initial position at the initial state so that the volume of the cavity 141 is contracted abruptly (FIG. 6(*c*)). At this time, a part of the ink (liquid material) filled in the cavity 141 is ejected through the nozzle 110 communicating with this cavity 141 in the form of ink droplets due to the compression pressure generated within the cavity 141.

The diaphragm 121 in each cavity 141 undergoes damped vibration continuately by this series of operations (the ink ejection operation by the driving signal from the head driver 33) until an ink droplet is ejected again when the following driving signal (driving voltage) is inputted. Hereinafter, this damped vibration is also referred to as the residual vibration. The residual vibration of the diaphragm 121 is assumed to have an intrinsic vibration frequency that is determined by the acoustic resistance r given by the shapes of the nozzle 110 and the ink supply port 142, a degree of ink viscosity and the like, the acoustic inertance m given by a weight of ink within the channel (cavity 141), and compliance Cm of the diaphragm 121.

Figure 7:
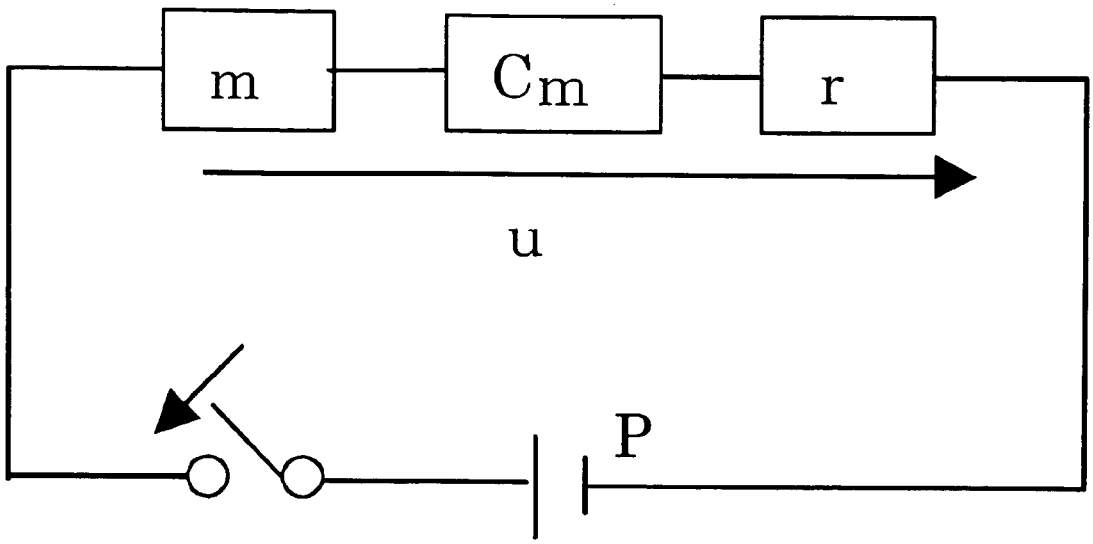
FIG. 7 is a circuit diagram showing a computation model of simple harmonic vibration on the assumption of residual vibration of the diaphragm shown in FIG. 3.

The computation model of the residual vibration of the diaphragm 121 based on the above assumption will now be described. FIG. 7 is a circuit diagram showing the computation model of simple harmonic vibration on the assumption of the residual vibration of the diaphragm 121. In this way, the computation model of the residual vibration of the diaphragm 121 can be represented by a sound pressure P, and the acoustic inertance m, compliance Cm and acoustic resistance r mentioned above. Then, by computing a step response in terms of a volume velocity u when the sound pressure P is applied to the circuit shown in FIG. 7, following equations are obtained.

$$u = \frac{P}{\omega \cdot m} e^{-\omega t} \cdot \sin \omega t \tag{1}$$

$$\omega = \sqrt{\frac{1}{m \cdot C_m} - \alpha^2} \tag{2}$$

$$\alpha = \frac{r}{2m} \tag{3}$$

Figure 8:
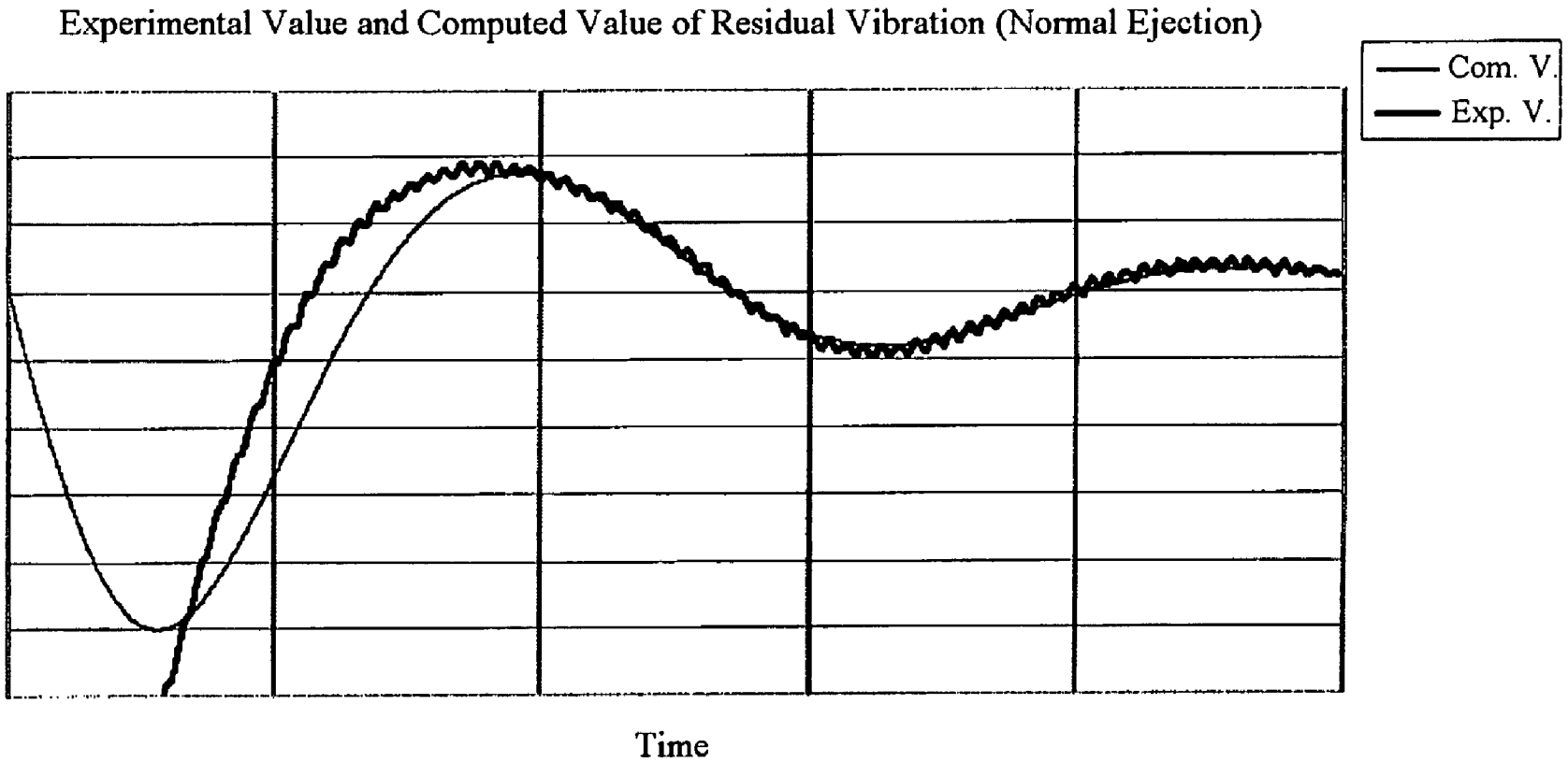
FIG. 8 is a graph showing the relationship between an experimental value and computed value of residual vibration of the diaphragm shown in FIG. 3 in the case of normal ejection.

The computation result obtained from the equations described above is compared with the experiment result from an experiment carried out separately as to the residual vibration of the diaphragm 121 after ejection of ink droplets. FIG. 8 is a graph showing the relationship between the experimental value and the computed value of the residual vibration of the diaphragm 121. As can be understood from the graph shown in FIG. 8, two waveforms of the experimental value and the computed value substantially correspond with each other.

In the meantime, a phenomenon, which ink droplets are not ejected normally through the nozzle 110 even when the above-mentioned ejection operation is carried out, that is, the occurrence of an ejection failure of droplets, may occur in any of the ink jet heads 100 of the head unit 35. As for causes of the occurrence of the ejection failure, as will be described below, (1) intrusion of an air bubble into the cavity 141, (2) drying and thickening (fixing) of ink in the vicinity the nozzle 110, (3) adhesion of paper dust in the vicinity the outlet of the nozzle 110, or the like may be mentioned.

Once the ejection failure occurs, it typically results in non-ejection of droplets through the nozzle 110, that is, the advent of a droplet non-ejection phenomenon, which gives rise to missing dots in pixels forming an image printed (drawn) on a recording sheet P. Further, in the case of the ejection failure, even when droplets are ejected through the nozzle 110, the ejected droplets do not land on the recording sheet P adequately because a quantity of droplets is too small or the flying direction (trajectory) of droplets is deviated, which also appears as missing dots in pixels. For this reason, hereinafter, an ejection failure of droplets may also be referred to simply as the "missing dot".

In the following, values of the acoustic resistance r and/or the acoustic inertance m are adjusted on the basis of the comparison result shown in FIG. 8 for each cause of the missing dot (ejection failure) phenomenon (i.e., droplet non-ejection phenomenon) during the printing process, which occurs in the nozzle 110 of the ink jet head 100, so that the computed value and the experimental value of the residual vibration of the diaphragm 121 match (or substantially correspond) with each other. Herein, three types of ejection failures, that is, intrusion of an air bubble, thickening due to drying and adhesion of paper dust, are considered.

Figure 9:
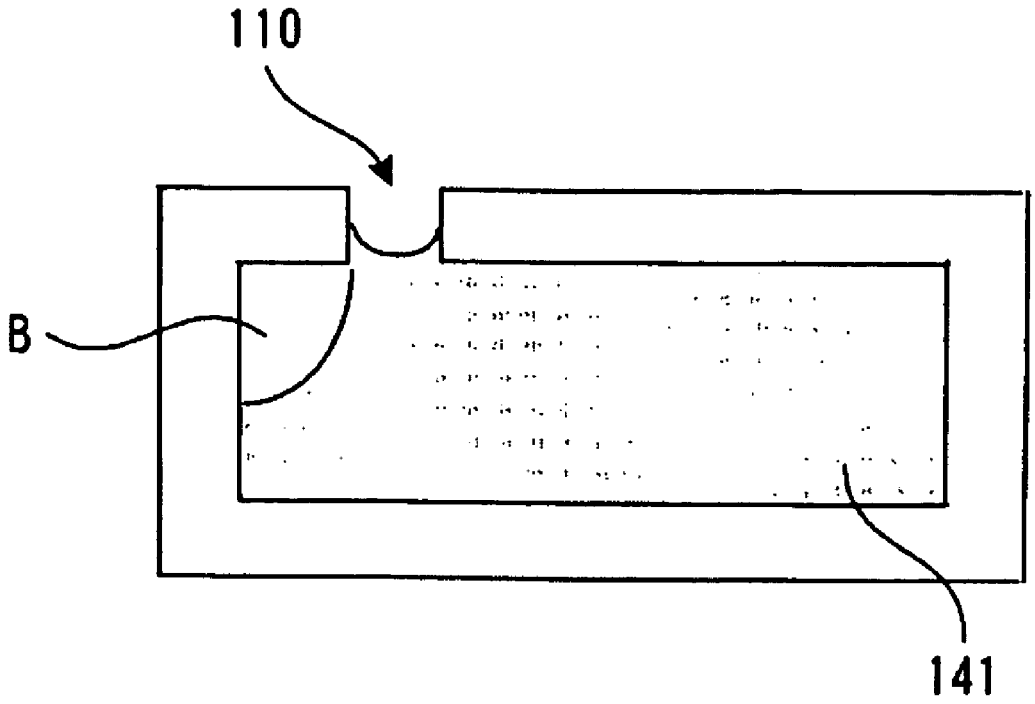
FIG. 9 is a conceptual view in the vicinity of the nozzle in a case where an air bubble has intruded into the cavity shown in FIG. 3.

First, intrusion of an air bubble into the cavity 141, which is one of the causes of the missing dot, will be discussed. FIG. 9 is a conceptual view in the vicinity of the nozzle 110 in a case where an air bubble B has intruded into the cavity 141 of FIG. 3. As shown in FIG. 9, the air bubble B thus generated is assumed to be generated and adhering to the wall surface of the cavity 141 (FIG. 9 shows a case where the air bubble B is adhering in the vicinity of the nozzle 110, as one example of the adhesion position of the air bubble B).

When the air bubble B has intruded into the cavity 141 in this manner, a total weight of ink filling the cavity 141 is thought to decrease, which in turn lowers the acoustic inertance m. Because the air bubble B is adhering to the wall surface of the cavity 141, the nozzle 110 is thought to become in a state where its diameter is increased in size by the diameter of the air bubble B, which in turn lowers the acoustic resistance r.

Figure 10:
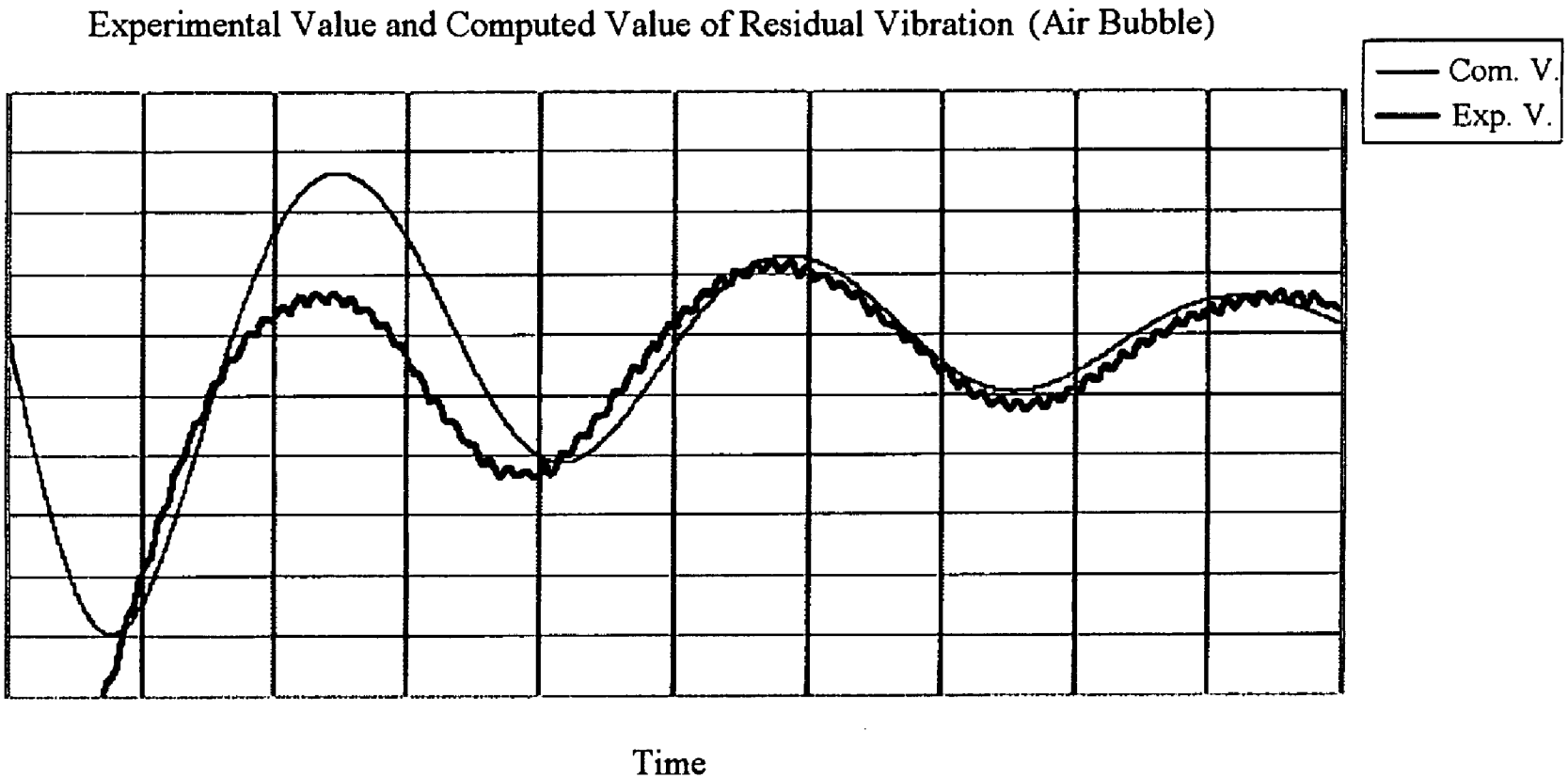
FIG. 10 is a graph showing the computed value and the experimental value of residual vibration in a state where ink droplets cannot be ejected due to intrusion of an air bubble into the cavity.

Thus, by setting both the acoustic resistance r and the acoustic inertance m smaller than in the case of FIG. 8 where ink is ejected normally, to be matched with the experimental value of the residual vibration in the case of intrusion of an air bubble, the result (graph) as shown in FIG. 10 was obtained. As can be understood from the graphs of FIGS. 8 and 10, in the case of intrusion of an air bubble into the cavity 141, a residual vibration waveform, characterized in that the frequency becomes higher than in the case of normal ejection, is obtained. In this regard, it can also be confirmed that the damping rate of amplitude of the residual vibration becomes smaller as the acoustic resistance r is lowered, and the amplitude of the residual vibration thus becomes smaller slowly.

Figure 11:
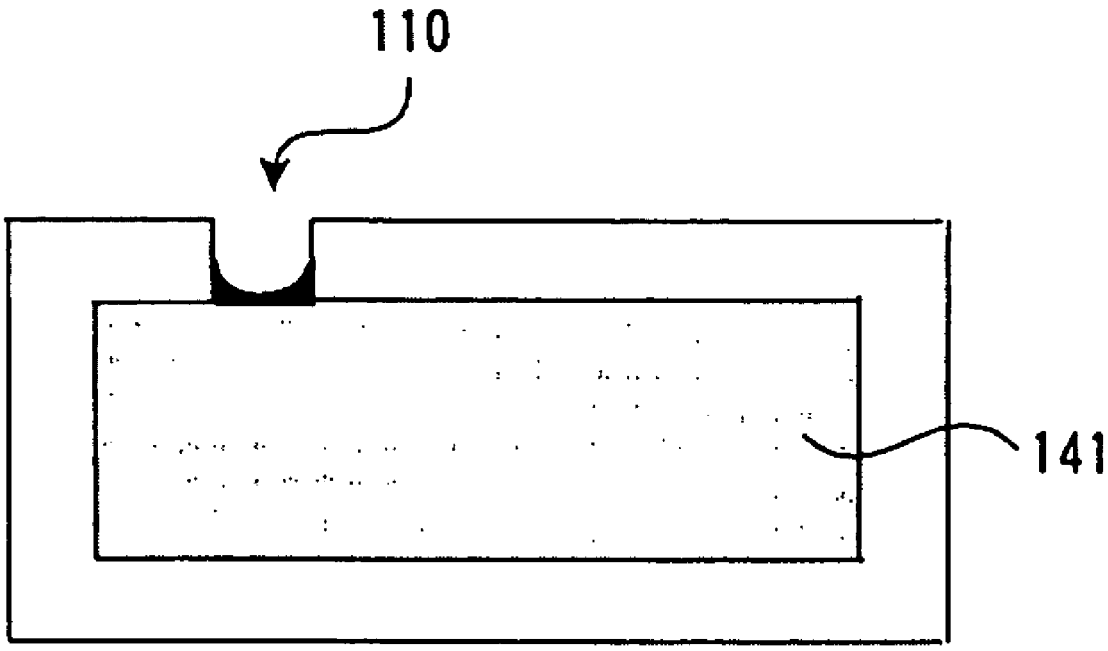
FIG. 11 is a conceptual view in the vicinity of the nozzle in a case where ink has fixed due to drying in the vicinity of the nozzle shown in FIG. 3.

Next, drying (fixing and thickening) of ink in the vicinity of the nozzle 110, which is another cause of the missing dot, will be discussed. FIG. 11 is a conceptual view in the vicinity of the nozzle 110 in a case where ink has fixed due to drying in the vicinity of the nozzle 110 of FIG. 3. As shown in FIG. 11, in a case where ink has fixed due to drying in the vicinity of the nozzle 110, ink within the cavity 141 is in a situation that the ink is trapped within the cavity 141. When ink dries and thickens in the vicinity of the nozzle 110 in this manner, the acoustic resistance r is thought to increase.

Figure 12:
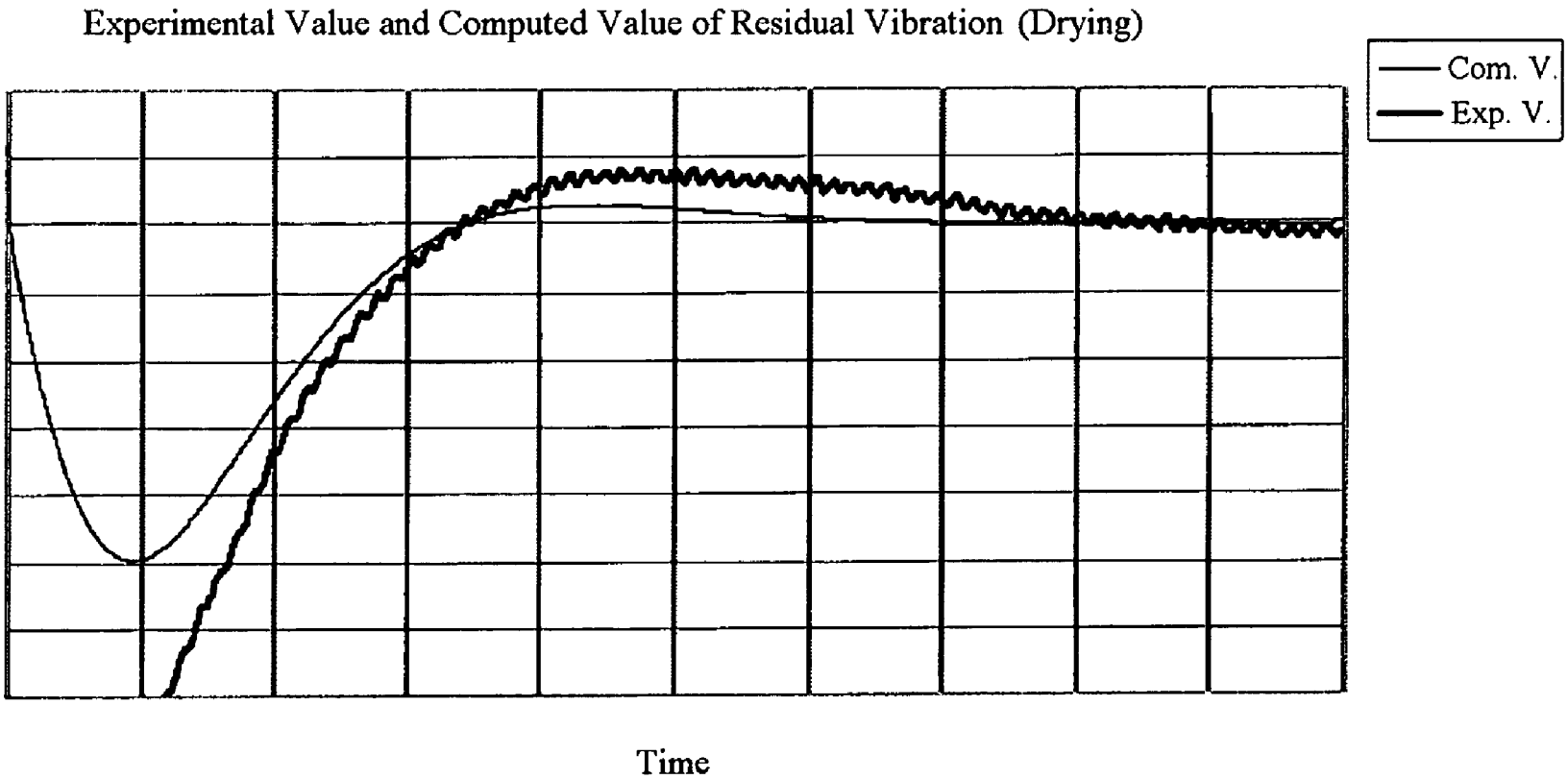
FIG. 12 is a graph showing the computed value and the experimental value of residual vibration in a state where ink has thickened due to drying in the vicinity of the nozzle.

Thus, by setting the acoustic resistance r larger than in the case of FIG. 8 where ink is ejected normally, to be matched with the experimental value of the residual vibration in the case of fixing (thickening) of ink caused by drying in the vicinity of the nozzle 110, the result (graph) as shown in FIG. 12 was obtained. In this case, the experimental values shown in FIG. 12 are those obtained by measuring the residual vibration of the diaphragm 121 in a state where the head unit 35 was allowed to stand for a few days without attaching a cap (not shown), so that ink could not be ejected because the ink had dried and thickened (the ink had fixed) in the vicinity of the nozzle 110 in the cavity 141. As can be understood from the graphs of FIGS. 8 and 12, in the case where ink has thickened due to drying in the vicinity of the nozzle 110, a residual vibration waveform, characterized in that not only the frequency becomes extremely low compared with the case of normal ejection, but also the residual vibration is over-damped, is obtained. This is because, when the diaphragm 121 moves upward in FIG. 3 after the diaphragm 121 is attracted downward in FIG. 3 in order to eject an ink droplet and ink thereby flows into the cavity 141 from the reservoir 143, there is no escape for the ink within the cavity 141 and the diaphragm 121 suddenly becomes unable to vibrate anymore (i.e., the diaphragm 121 becomes over-damped).

Figure 13:
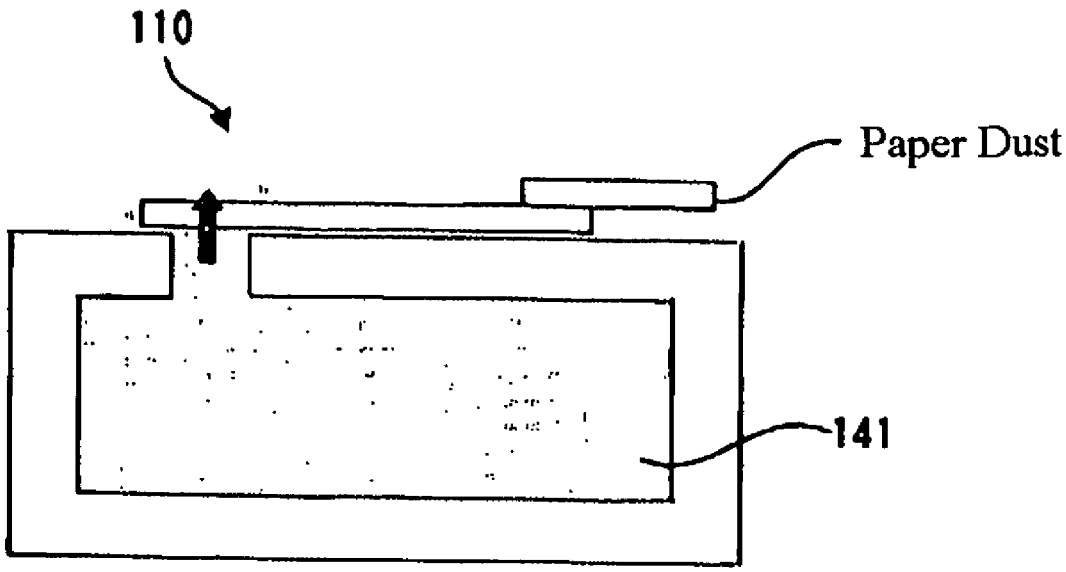
FIG. 13 is a conceptual view in the vicinity of the nozzle in a case where paper dust is adhering in the vicinity of the outlet of the nozzle shown in FIG. 3.

Next, adhesion of paper dust in the vicinity of the outlet of the nozzle 110, which is still another cause of the missing dot, will be described. FIG. 13 is a conceptual view in the vicinity of the nozzle 110 in the case of adhesion of paper dust in the vicinity of the outlet of the nozzle 110 of FIG. 3. As shown in FIG. 13, in the case where paper dust is adhering in the vicinity of the outlet of the nozzle 110, not only ink seeps out from the cavity 141 via paper dust, but also it becomes impossible to eject ink through the nozzle 110. In the case where paper dust is adhering in the vicinity of the outlet of the nozzle 110 and ink seeps out from the nozzle 110 in this manner, a quantity of ink within the cavity 141 and ink seeping out when viewed from the diaphragm 121 is thought to increase compared with the normal state, which in turn causes the acoustic inertance m to increase. Further, fibers of the paper dust adhering in the vicinity of the outlet of the nozzle 110 are thought to cause the acoustic resistance r to increase.

Figure 14:
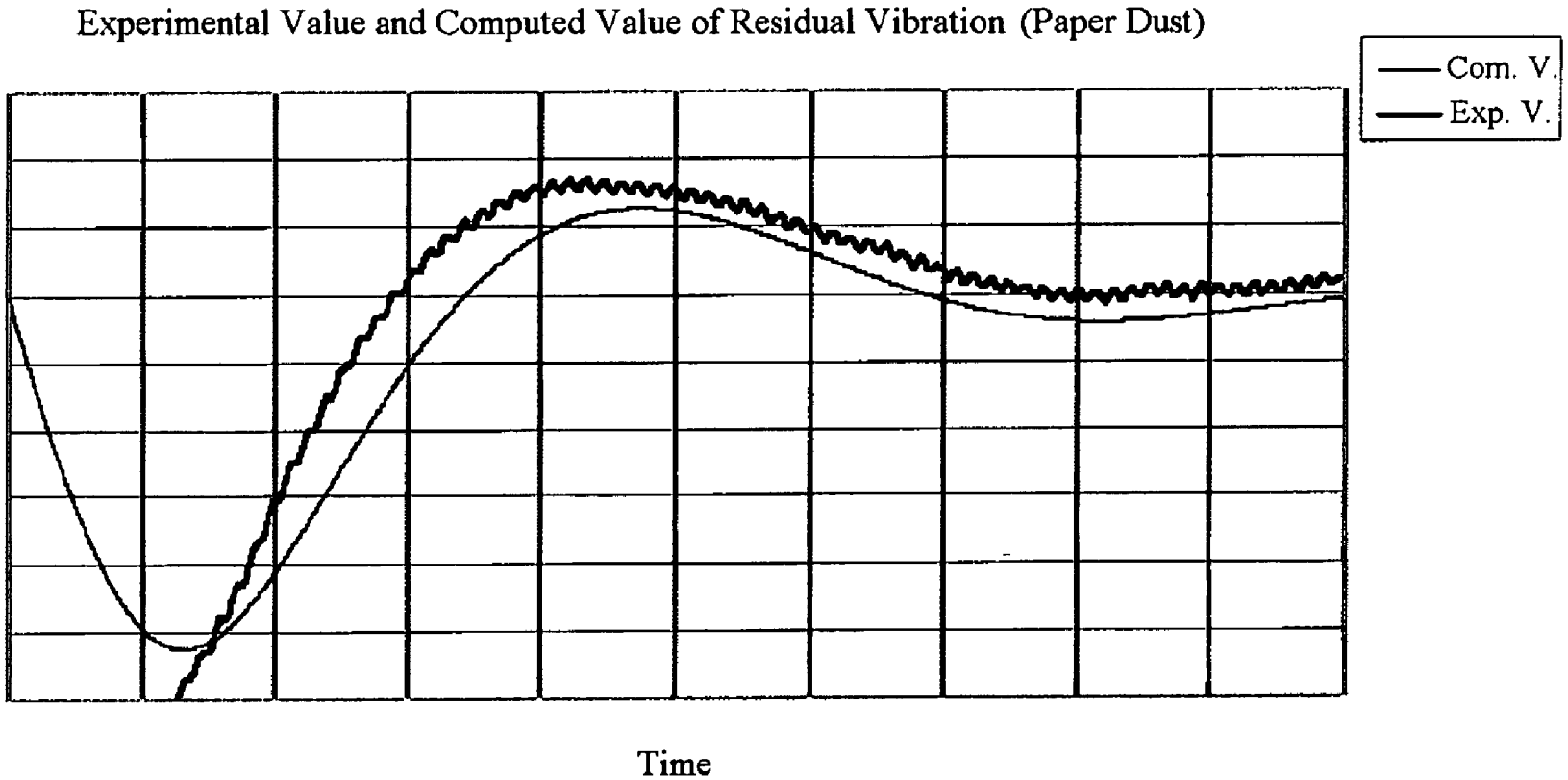
FIG. 14 is a graph showing the computed value and the experimental value of residual vibration in a state where paper dust is adhering to the outlet of the nozzle.
Figure 15:
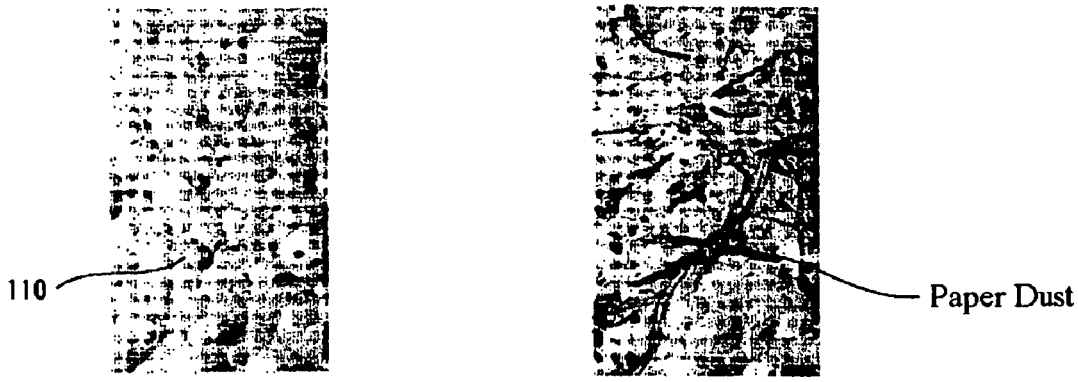
FIG. 15 shows pictures of the nozzle states before and after adhesion of paper dust in the vicinity of the nozzle.

Thus, by setting both the acoustic inertance m and the acoustic resistance r larger than in the case of FIG. 8 where ink is ejected normally, to be matched with the experimental value of the residual vibration in the case of adhesion of paper dust in the vicinity of the outlet of the nozzle 110, the result (graph) as shown in FIG. 14 was obtained. As can be understood from the graphs of FIGS. 8 and 14, in the case where paper dust is adhering in the vicinity of the outlet of the nozzle 110, a residual vibration waveform, characterized in that the frequency becomes lower than in the case of normal ejection, is obtained (it is also understood from the graphs of FIGS. 12 and 14 that the frequency of the residual vibration in the case of adhesion of paper dust is higher than that in the case of thickening ink). FIG. 15 shows pictures of the states of the nozzle 110 before and after adhesion of paper dust. It can be seen from FIG. 15(*b*) that once paper dust adheres in the vicinity of the outlet of the nozzle 110, ink seeps out along the paper dust.

Note that in both the cases where ink has thickened due to drying in the vicinity of the nozzle 110 and where paper dust is adhering in the vicinity of the outlet of the nozzle 110, the frequency of the damped vibration is lower than in the case where ink droplets are ejected normally. Hence, a comparison is made, for example, with a predetermined threshold in the frequency, the cycle or the phase of the damped vibration to identify these two causes of the missing dot (non-ejection of ink, i.e., ejection failure) from the waveform of the residual vibration of the diaphragm 121, or alternatively the causes can be identified from a change of the cycle of the residual vibration (damped vibration) or the damping rate of a change in amplitude. In this way, an ejection failure of the respective ink jet heads 100 can be detected from a change of the residual vibration of the diaphragm 121, in particular, a change of the frequency thereof, when ink droplets are ejected through the nozzle 110 of each of the ink jet heads 100. Further, by comparing the frequency of the residual vibration in this case with the frequency of the residual vibration in the case of normal ejection, the cause of the ejection failure can be identified.

Figure 16:
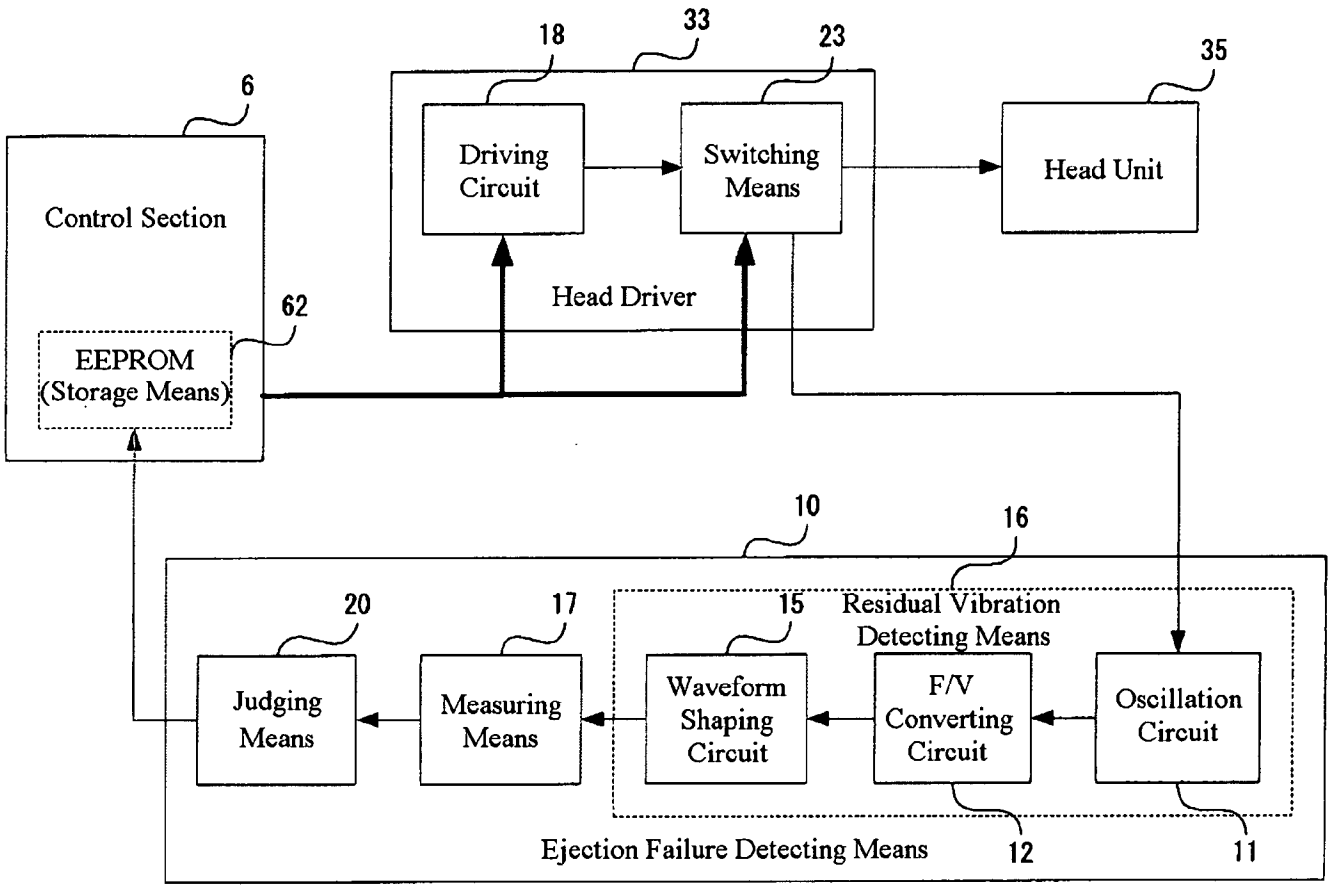
FIG. 16 is a schematic block diagram of the ejection failure detecting means shown in FIG. 2.

Next, the ejection failure detecting means 10 will now be described. FIG. 16 is a schematic block diagram of the ejection failure detecting means 10 shown in FIG. 2. As shown in FIG. 16, the ejection failure detecting means 10 of the invention is provided with residual vibration detecting means 16 comprising an oscillation circuit 11, an F/V (frequency-to-voltage) converting circuit 12 and a waveform shaping circuit 15, measuring means 17 for measuring the cycle, amplitude or the like of the residual vibration from the residual vibration waveform data detected in the residual vibration detecting means 16, and judging means 20 for judging an ejection failure of the ink jet head 100 on the basis of the cycle or the like measured by the measuring means 17. In the ejection failure detecting means 10, the residual vibration detecting means 16 detects the vibration waveform, which is formed in the F/V converting circuit 12 and the waveform shaping circuit 15 from the oscillation frequency of the oscillation circuit 11 that oscillates on the basis of the residual vibration of the diaphragm 121 of the electrostatic actuator 120. In the residual vibration detecting means 16, the measuring means 17 then measures the cycle or the like of the residual vibration on the basis of the vibration waveform thus detected, and the judging means 20 detects and judges an ejection failure of each of the ink jet heads 100 provided to each head unit 35 in the printing means 3, on the basis of the cycle or the like of the residual vibration thus measured. In the following, each component of the ejection failure detecting means 10 will be described.

Figure 17:
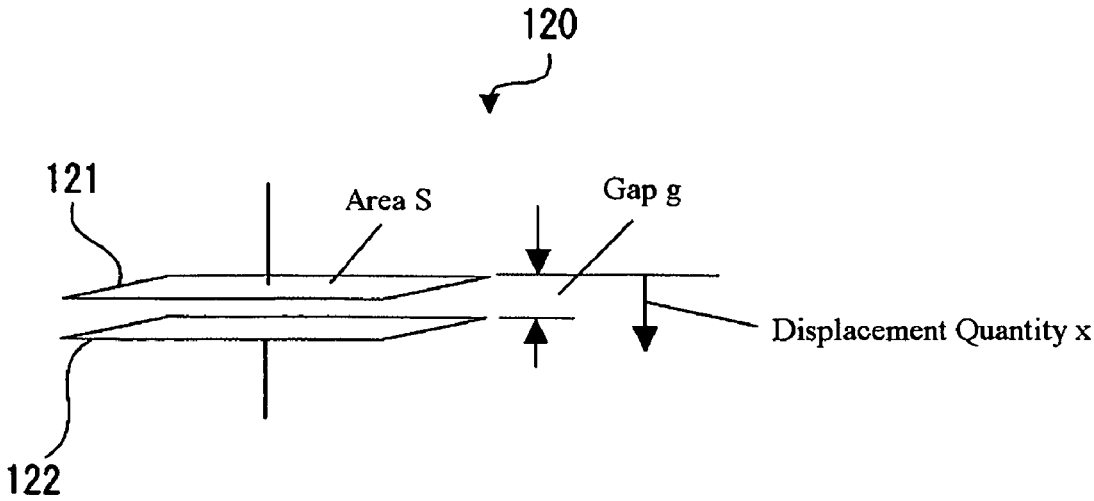
FIG. 17 is a conceptual view in the case where the electrostatic actuator shown in FIG. 3 is assumed as a parallel plate capacitor.
Figure 18:
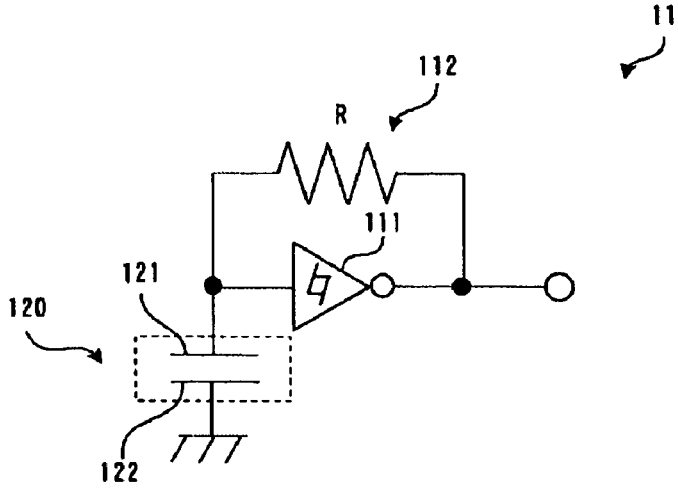
FIG. 18 is a circuit diagram of an oscillation circuit including the capacitor constituted from the electrostatic actuator shown in FIG. 3.

First, a method of using the oscillation circuit 11 to detect the frequency (the number of vibration) of the residual vibration of the diaphragm 121 of the electrostatic actuator 120 will be described. FIG. 17 is a conceptual view in the case where the electrostatic actuator 120 of FIG. 3 is assumed as a parallel plate capacitor. FIG. 18 is a circuit diagram of the oscillation circuit 11 including the capacitor constituted from the electrostatic actuator 120 of FIG. 3. In this case, the oscillation circuit 11 shown in FIG. 18 is a CR oscillation circuit using the hysteresis characteristic of a schmitt trigger. However, in the invention, the oscillation circuit is not limited to such a CR oscillation circuit, and any oscillation circuit can be used provided that it is an oscillation circuit using an electric capacitance component (capacitor C) of the actuator (including the diaphragm). The oscillation circuit 11 may comprise, for example, the one using an LC oscillation circuit. Further, this embodiment describes an example case using a schmitt trigger inverter; however, a CR oscillation circuit using inverters in three stages may be formed.

In the ink jet head 100 shown in FIG. 3, as described above, the diaphragm 121 and the segment electrode 122 spaced apart therefrom by an extremely small interval (clearance) together form the electrostatic actuator 120 that forms the counter electrodes. The electrostatic actuator 120 can be deemed as the parallel plate capacitor as shown in FIG. 17. In the case where C is the electric capacitance of the capacitor, S is the surface area of each of the diaphragm 121 and the segment electrode 122, g is a distance (gap length) between the two electrodes 121 and 122, and $\epsilon$ is a dielectric constant of the space (clearance) sandwiched by both electrodes (if $\epsilon_0$ is a dielectric constant in vacuum and $\epsilon_r$ is a specific dielectric constant in the clearance, then $\epsilon=\epsilon_0\times\epsilon_r$), then an electric capacitance C(x) of the capacitor (electrostatic actuator 120) shown in FIG. 17 can be expressed by the following equation.

$$C(x) = \varepsilon_0 \cdot \varepsilon_r \frac{S}{g - x} \ (F) \tag{4}$$

As shown in FIG. 17, x in Equation (4) above indicates a displacement quantity of the diaphragm 121 from the reference position thereof, caused by the residual vibration of the diaphragm 121.

As can be understood from Equation (4) above, the smaller the gap length g (i.e., gap length g−displacement quantity x) is, the larger the electric capacitance C(x) becomes, and conversely, the larger the gap length g (gap length g−displacement quantity x) is, the smaller the electric capacitance C(x) becomes. In this manner, the electric capacitance C(x) is inversely proportional to (gap length g−displacement quantity x)(the gap length g when x is 0). In this regard, for the electrostatic actuator 120 shown in FIG. 3, a specific dielectric constant, $\epsilon_r=1$, because the clearance is fully filled with air.

Further, because ink droplets (ink dots) to be ejected become finer with an increase of the resolution of the droplet ejection apparatus (the ink jet printer 1 in this embodiment), the electrostatic actuator 120 is increased in density and decreased in size. The surface area S of the diaphragm 121 of the ink jet head 100 thus becomes smaller and a smaller electrostatic actuator 120 is assembled. Furthermore, the gap length g of the electrostatic actuator 120 that varies with the residual vibration caused by ink droplet ejection is approximately one tenth of the initial gap $g_0$. Hence, as can be understood from Equation (4) above, a quantity of change of the electric capacitance of the electrostatic actuator 120 takes an extremely small value.

In order to detect a quantity of change of the electric capacitance of the electrostatic actuator 120 (which varies with the vibration pattern of the residual vibration), a method as follows is used, that is, a method of forming an oscillation circuit as the one shown in FIG. 18 on the basis of the electric capacitance of the electrostatic actuator 120, and analyzing the frequency (cycle) of the residual vibration on the basis of the oscillated signal. The oscillation circuit 11 shown in FIG. 18 comprises a capacitor (C) constituted from the electrostatic actuator 120, a schmitt trigger inverter 111, and a resistor element (R) 112.

In the case where an output signal from the schmitt trigger inverter 111 is in the high level, the capacitor C is charged via the resistor element 112. When the charged voltage in the capacitor C (a potential difference between the diaphragm 121 and the segment electrode 122) reaches an input threshold voltage $V_T+$ of the schmitt trigger inverter 111, the output signal from the schmitt trigger inverter 111 inverts to a low level. Then, when the output signal from the schmitt trigger inverter 111 shifts to the low level, electric charges charged in the capacitor C via the resistor element 112 are discharged. When the voltage of the capacitor C reaches the input threshold voltage $V_T-$ of the schmitt trigger inverter 111 through this discharge, the output signal from the schmitt trigger inverter 111 inverts again to the high level. Thereafter, this oscillation operation is carried out repetitively.

Here, in order to detect a change with time of the electric capacitance of the capacitor C in each of the above-mentioned phenomena (intrusion of an air bubble, drying, adhesion of paper dust, and normal ejection), it is required that the oscillation frequency of the oscillation circuit 11 is set to an oscillation frequency at which the frequency in the case of intrusion of an air bubble (see FIG. 10), where the frequency of the residual vibration is the highest, can be detected. For this reason, the oscillation frequency of the oscillation circuit 11 has to be increased, for example, to a few or several tens of times or more than the frequency of the residual vibration to be detected, that is, it has to be set to one or more orders of magnitude higher than the frequency in the case of intrusion of an air bubble. In this case, it is preferable to set the oscillation frequency to an oscillation frequency at which the residual vibration frequency in the case of intrusion of an air bubble can be detected, because the frequency of the residual vibration in the case of intrusion of an air bubble shows a high frequency in comparison with the case of normal ejection. Otherwise, it is impossible to detect the frequency of the residual vibration accurately for the phenomenon of the ejection failure. In this embodiment, therefore, a time constant of the CR in the oscillation circuit 11 is set in accordance with the oscillation frequency. By setting the oscillation frequency of the oscillation circuit 11 high in this manner, it is possible to detect the residual vibration waveform more accurately on the basis of a minute change of the oscillation frequency.

The digital information on the residual vibration waveform for each oscillation frequency can be obtained by counting pulses of the oscillation signal outputted from the oscillation circuit 11 in every cycle (pulse) of the oscillation frequency with the use of a measuring count pulse (counter), and by subtracting a count quantity of the pulses of the oscillation frequency when the oscillation circuit 11 is oscillated with an electric capacitance of the capacitor C at the initial gap go from the count quantity thus measured. By carrying out D/A (digital-to-analog) conversion on the basis of the digital information, a schematic residual vibration waveform can be generated. The method as described above may be used; however, the measuring count pulse (counter) having a high frequency (high resolution) that can measure a minute change of the oscillation frequency is needed. Such a count pulse (counter) increases the cost, and for this reason, the ejection failure detecting means 10 of the invention uses the F/V converting circuit 12 shown in FIG. 19.

Figure 19:
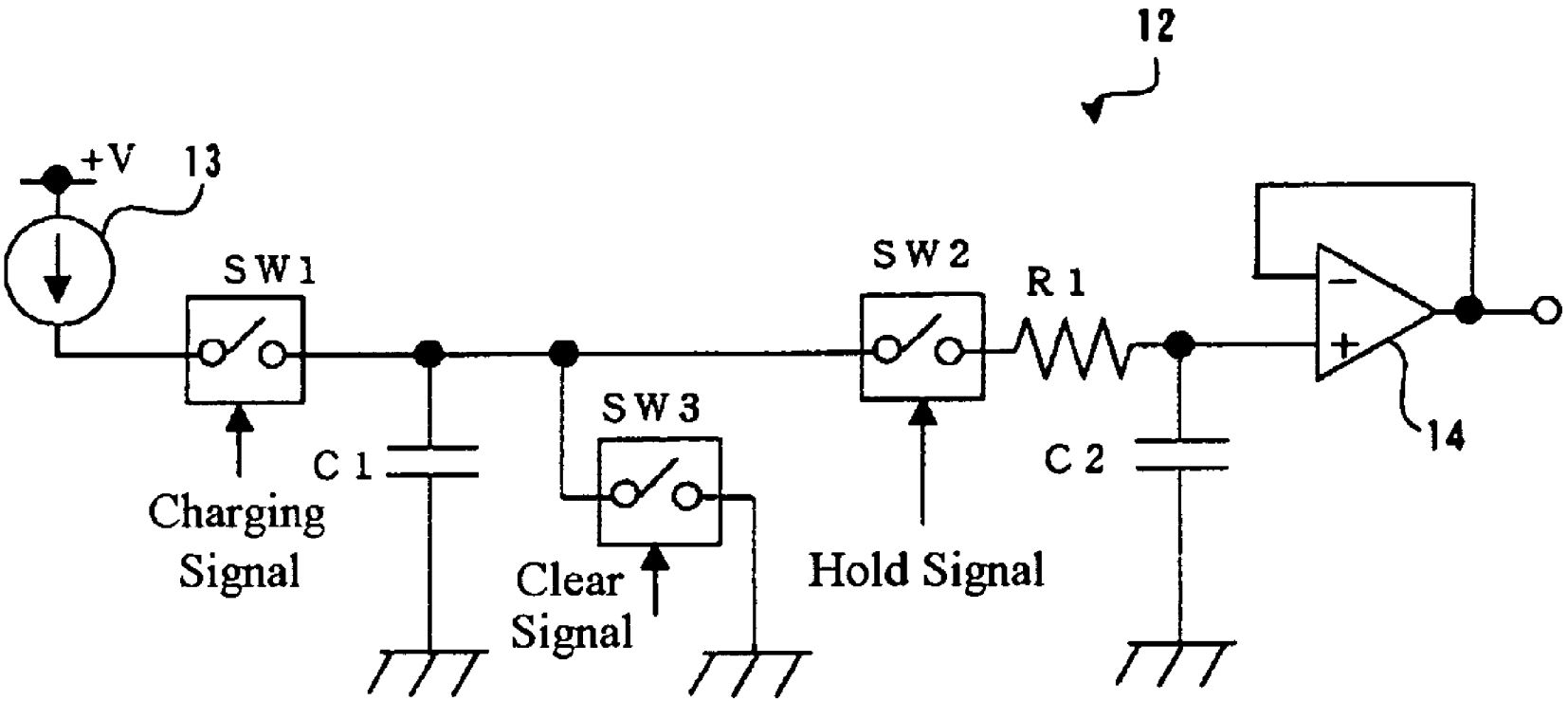
FIG. 19 is a circuit diagram of an F/V converting circuit in the ejection failure detecting means shown in FIG. 16.

FIG. 19 is a circuit diagram of the F/V converting circuit 12 in the ejection failure detecting means 10 shown in FIG. 16. As shown in FIG. 19, the F/V converting circuit 12 comprises three switches SW1, SW2 and SW3, two capacitors C1 and C2, a resistor element R1, a constant current source 13 from which a constant current Is is outputted, and a buffer 14. The operation of the F/V converting circuit 12 will be described with the use of the timing chart of FIG. 20 and the graph of FIG. 21.

First, a method of generating a charging signal, a hold signal, and a clear signal shown in the timing chart of FIG. 20 will be described. The charging signal is generated in such a manner that a fixed time tr is set from the rising edge of the oscillation pulse of the oscillation circuit 11 and the signal remains in the high level for the fixed time tr. The hold signal is generated in such a manner that the signal rises in sync with the rising edge of the charging signal, and falls to the low level after it is held in the high level for a predetermined fixed time. The clear signal is generated in such a manner that the signal rises in sync with the falling edge of the hold signal and falls to the low level after it is held in the high level for a predetermined fixed time. In this regard, as will be described later, because electric charges move from the capacitor C1 to the capacitor C2 instantaneously and the capacitor C1 discharges instantaneously, in regard to pulses of the hold signal and the clear signal, it is sufficient for each signal to include one pulse until the following rising edge of the output signal from the oscillation circuit 11 occurs, and the rising edge and the falling edge are not limited to those described above.

Figure 21:
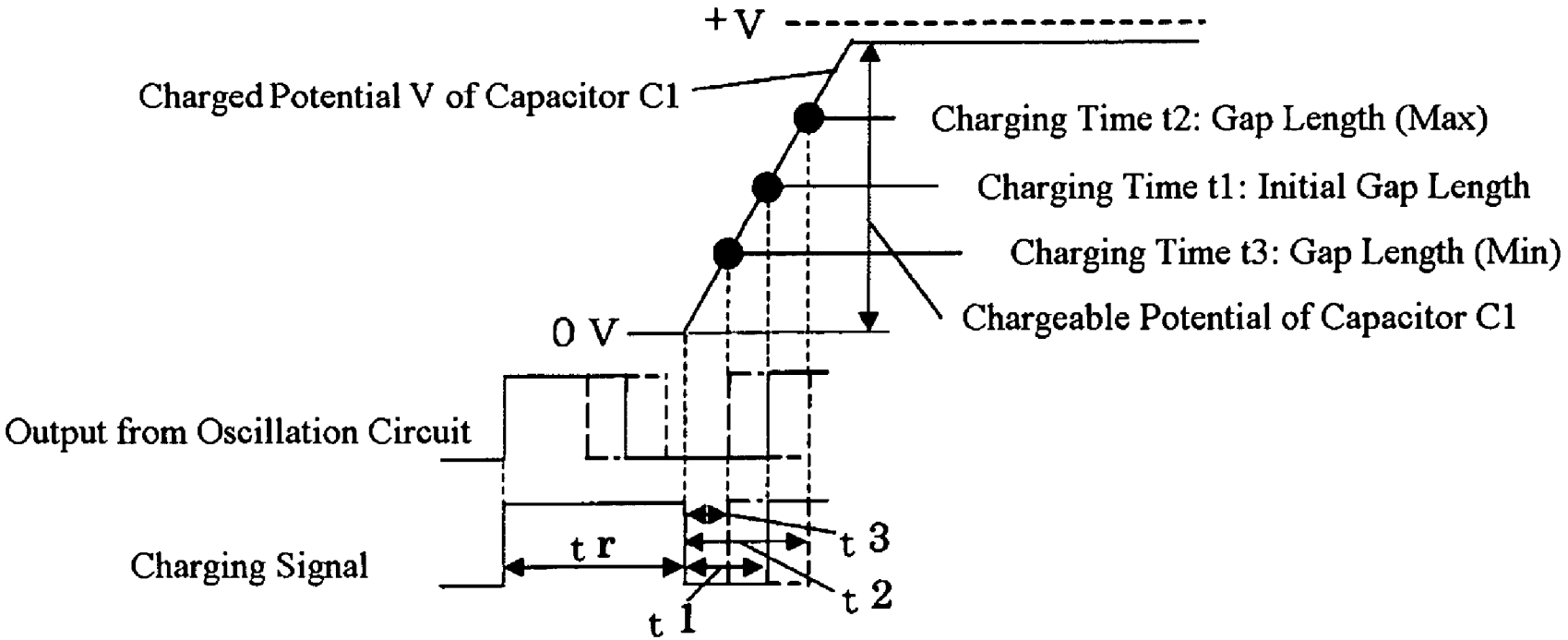
FIG. 21 is a drawing used to explain a setting method of fixed times tr and t1.

With reference to FIG. 21, a method of setting the fixed times tr and t1 in obtaining a sharp waveform (voltage waveform) of the residual vibration will be described. The fixed time tr is adjusted from the cycle of the oscillation pulse oscillated with the electric capacitance C when the electrostatic actuator 120 is at the initial gap length $g_0$, and is set so that a charged potential for the charging time t1 becomes about half of the chargeable range of the capacitor C1. Further, a gradient of the charged potential is set so as not to exceed the chargeable range of the capacitor C1 from a charging time t2 at the position at which the gap length g becomes the maximum (Max) to a charging time t3 at the position at which the gap length g becomes the minimum (Min). In other words, because the gradient of the charged potential is determined by dV/dt=Is/C1, it is sufficient to set the output constant current Is from the constant current source 13 to an appropriate value. By setting the output constant current Is of the constant current source 13 as high as possible within the range, a minute change of the electric capacitance of the capacitor comprising the electrostatic actuator 120 can be detected with high sensitivity, and this makes it possible to detect a minute change of the diaphragm 121 of the electrostatic actuator 120.

Figure 22:
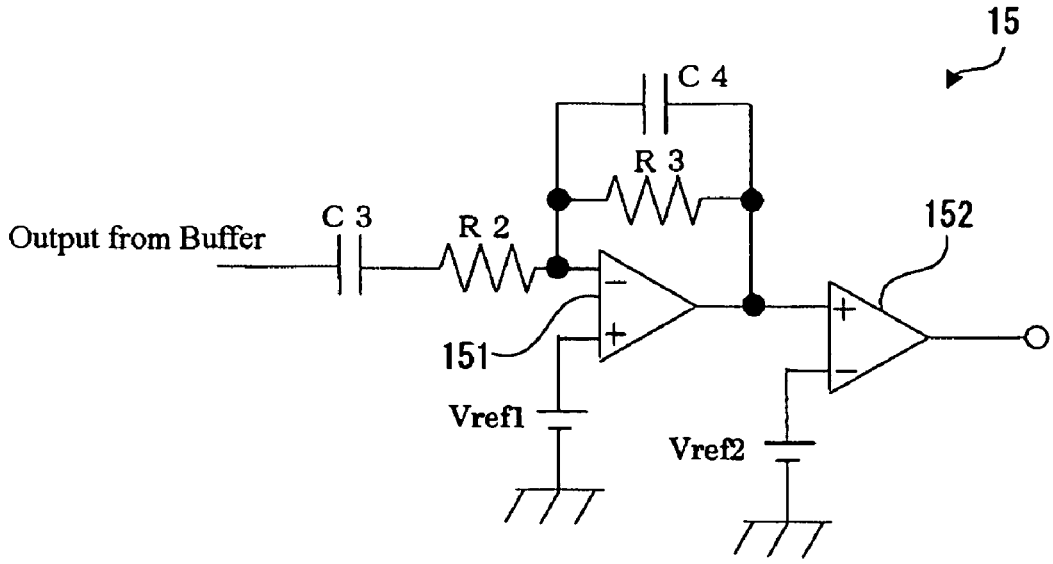
FIG. 22 is a circuit diagram showing the circuitry of a waveform shaping circuit shown in FIG. 16.

The configuration of the waveform shaping circuit 15 shown in FIG. 16 will now be described with reference to FIG. 22. FIG. 22 is a circuit diagram showing the circuitry of the waveform shaping circuit 15 of FIG. 16. The waveform shaping circuit 15 outputs the residual vibration waveform to the judging means 20 in the form of a rectangular wave. As shown in FIG. 22, the waveform shaping circuit 15 comprises two capacitors C3 (DC component eliminating means) and C4, two resistor elements R2 and R3, two direct current voltage sources Vref1 and Vref2, an operational amplifier 151, and a comparator 152. In this regard, the waveform shaping circuit 15 may be configured to measure the amplitude of the residual vibration waveform by directly outputting a wave height value detected in the waveform shaping processing of the residual vibration waveform.

The output from the buffer 14 in the F/V converting circuit 12 includes electric capacitance components of DC components (direct current components) based on the initial gap $g_0$ of the electrostatic actuator 120. Because the direct current components vary with each ink jet head 100, the capacitor C3 is used to eliminate the direct current components of the electric capacitance. The capacitor C3 thus eliminates the DC components from an output signal from the buffer 14, and outputs only the AC components of the residual vibration to the inverting input terminal of the operational amplifier 151.

The operational amplifier 151 inverts and amplifies the output signal from the buffer 14 in the F/V converting circuit 12, from which the direct current components have been eliminated, and also forms a low-pass filter to remove a high band of the output signal. In this case, the operational amplifier 151 is assumed to be a single power source circuit. The operational amplifier 151 forms an inverting amplifier based on the two resistor elements R2 and R3, and the residual vibration (alternating current components) inputted therein is therefore amplified by a factor of −R3/R2.

Further, because of the single power source operation, the operational amplifier 151 outputs an amplified residual vibration waveform of the diaphragm 121 that vibrates about the potential set by the direct current voltage source Vref1 connected to the non-inverting input terminal thereof. Here, the direct current voltage source Vref1 is set to about half the voltage range within which the operational amplifier 151 is operable with a single power source. Furthermore, the operational amplifier 151 forms a low-pass filter, having a cut-off frequency of $1/(2\pi \times C4 \times R3)$, from the two capacitors C3 and C4. Then, as shown in the timing chart of FIG. 20, the residual vibration waveform of the diaphragm 121, which is amplified after the direct current components are eliminated therefrom, is compared with the potential of the other direct current voltage source Vref2 in the comparator 152 in the following stage, and the comparison result is outputted from the waveform shaping circuit 15 in the form of a rectangular wave. In this case, the direct current voltage source Vref1 may be commonly used as the other direct current voltage source Vref2.

Next, the operations of the F/V converting circuit 12 and the waveform shaping circuit 15 of FIG. 19 will now be described with reference to the timing chart shown in FIG. 20. The F/V converting circuit 12 shown in FIG. 19 operates according to the charging signal, the clear signal and the hold signal, which are generated as described above. Referring to the timing chart of FIG. 20, when the driving signal of the electrostatic actuator 120 is inputted into the ink jet head 100 of the head unit 35 via the head driver 33, the diaphragm 121 of the electrostatic actuator 120 is attracted toward the segment electrode 122 as shown in FIG. 6(*b*), and abruptly contracts upward in FIG. 6 in sync with the falling edge of the driving signal (see FIG. 6(*c*)).

A driving/detection switching signal that switches the connection of the ink jet head 100 between the driving circuit 18 and the ejection failure detecting means 10 shifts to the high level in sync with the falling edge of the driving signal. The driving/detection switching signal is held in the high level during the driving halt period of the corresponding ink jet head 100, and shifts to the low level before the following driving signal is inputted. While the driving/detection switching signal remains in the high level, the oscillation circuit 11 of FIG. 18 keeps oscillating while changing the oscillation frequency in response to the residual vibration of the diaphragm 121 of the electrostatic actuator 120.

As described above, the charging signal is held in the high level from the falling edge of the driving signal, that is, the rising edge of the output signal from the oscillation circuit 11 until the elapse of the fixed time tr, which is set in advance so that the waveform of the residual vibration will not exceed the chargeable range of the capacitor C1. It should be noted that the switch SW1 remains OFF while the charging signal is held in the high level.

When the fixed time tr elapses and the charging signal shifts to the low level, the switch SW1 is switched ON in sync with the falling edge of the charging signal (see FIG. 19). The constant current source 13 and the capacitor C1 are then connected to each other, and the capacitor C1 is charged with the gradient Is/C1 as described above. Namely, the capacitor C1 is kept charged while the charging signal remains in the low level, that is, until it shifts to the high level in sync with the rising edge of the following pulse of the output signal from the oscillation circuit 11.

When the charging signal shifts to the high level, the switch SW1 is switched OFF (i.e., opened), and the capacitor C1 is isolated from the constant current source 13. At this time, the capacitor C1 holds a potential charged during the period t1 during which the charging signal remained in the low level (that is, ideally speaking, Is×t1/C1(Volt)). When the hold signal shifts to the high level in this state, the switch SW2 is switched ON (see FIG. 19), and the capacitors C1 and C2 are connected to each other via the resistor element R1. After the switch SW2 is switched ON, charging and discharging operations are carried out due to a charged potential difference between the two capacitors C1 and C2, and the electric charges move from the capacitor C1 to the capacitor C2 so that the potential differences in the two capacitors C1 and C2 become almost equal.

Herein, the electric capacitance of the capacitor C2 is set to approximately one tenth or less of the electric capacitance of the capacitor C1. For this reason, a quantity of electric charges that move (are used) due to the charging and discharging caused by a potential difference between the two capacitors C1 and C2 is one tenth or less of the electric charges charged in the capacitor C1. Hence, after the electric charges moved from the capacitor C1 to the capacitor C2, a potential difference in the capacitor C1 varies little (drops little). In the F/V converting circuit 12 of FIG. 19, a primary low-pass filter is formed from the resistor element R1 and the capacitor C2 in preventing the charged potential from rising abruptly by the inductance or the like of the wiring in the F/V converting circuit 12 when the capacitor C2 is charged.

After the charged potential, which is substantially equal to the charged potential in the capacitor C1, is held in the capacitor C2, the hold signal shifts to the low level, and the capacitor C1 is isolated from the capacitor C2. Further, when the clear signal shifts to the high level and the switch SW3 is switched ON, the capacitor C1 is connected to the ground terminal GND, and a discharge operation is carried out so that the electric charges charged in the capacitor C1 is reduced to 0. After the capacitor C1 is discharged, when the clear signal shifts to the low level, and the switch SW3 is switched OFF, then the electrode of the capacitor C1 at the top in FIG. 19 is isolated from the ground terminal GND, and the F/V converting circuit 12 stands by (waits) until the following charging signal is inputted, that is, until the charging signal shifts to the low level.

The potential held in the capacitor C2 is updated at each rising time of the charging signal, that is, at each timing at which the charging to the capacitor C2 is completed, and this potential is outputted to the waveform shaping circuit 15 of FIG. 22 in the form of the residual vibration waveform of the diaphragm 121 via the buffer 14. Hence, by setting the electric capacitance of the electrostatic actuator 120 (in this case, a variation width of the electric capacitance due to the residual vibration has to be taken into consideration) and the resistance value of the resistor element 112 so that the oscillation frequency of the oscillation circuit 11 becomes high, each step (step difference) in the potential in the capacitor C2 (output from the buffer 14) shown in the timing chart of FIG. 20 can become more in detail, and this makes it possible to detect a change with time of the electric capacitance due to the residual vibration of the diaphragm 121 more in detail.

Thereafter, the charging signal repeatedly shifts between the low level and the high level, and the potential held in the capacitor C2 is outputted to the waveform shaping circuit 15 via the buffer 14 at the predetermined timing described above. In the waveform shaping circuit 15, the direct current components are eliminated by the capacitor C3 from the voltage signal (the potential in the capacitor C2 in the timing chart of FIG. 20) inputted from the buffer 14, and the resulting signal is inputted into the inverting input terminal of the operational amplifier 151 via the resistor element R2. The alternating current (AC) components of the residual vibration thus inputted are inverted and amplified in the operational amplifier 151, and outputted to one input terminal of the comparator 152. The comparator 152 compares the potential (reference voltage) set in advance by the direct current voltage source Vref2 with the potential of the residual vibration waveform (alternating current components) to output a rectangular wave (output from the comparator in the timing chart of FIG. 20).

Figure 23:
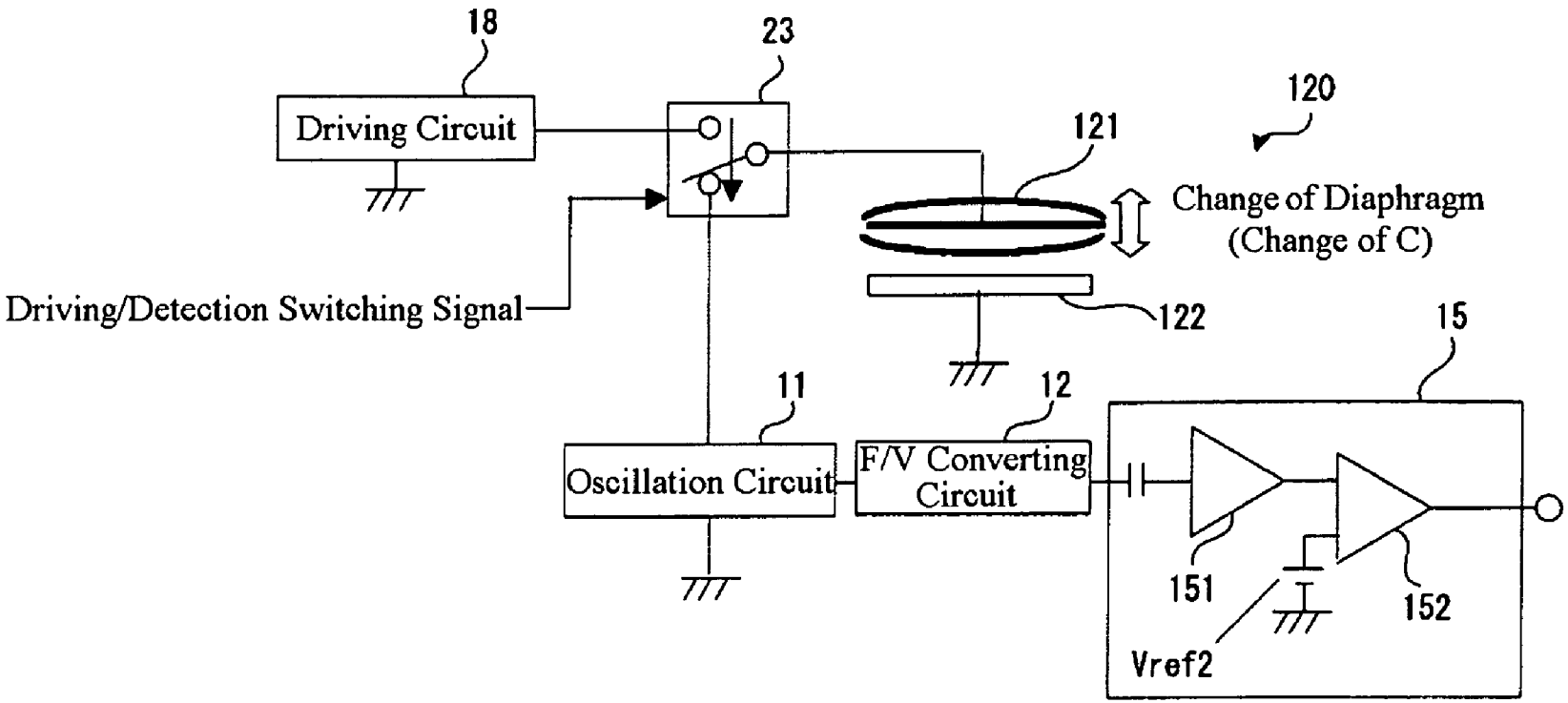
FIG. 23 is a block diagram schematically showing switching means for switching between a driving circuit and a detection circuit.

Next, the switching timing between an ink droplet ejection operation (i.e., driving state) and an ejection failure detection operation (i.e., driving halt state) of the ink jet head 100 will now be described. FIG. 23 is a block diagram schematically showing the switching means 23 for switching the connection of the ink jet head 100 between the driving circuit 18 and the ejection failure detecting means 10. Referring to FIG. 23, the driving circuit 18 in the head driver 33 shown in FIG. 16 will be described as the driving circuit of the ink jet head 100. As shown in the timing chart of FIG. 20, the ejection failure detecting and judging processing is carried out in a period between the driving signals for the ink jet head 100, that is, during the driving halt period.

Referring to FIG. 23, the switching means 23 is initially connected to the driving circuit 18 side to drive the electrostatic actuator 120 thereof. As described above, when the driving signal (voltage signal) is inputted from the driving circuit 18 to the diaphragm 121, the electrostatic actuator 120 starts to be driven, and the diaphragm 121 is attracted toward the segment electrode 122. Then, when the applied voltage drops to 0, the diaphragm 121 displaces abruptly in a direction to move away from the segment electrode 122 and starts to vibrate (residual vibration). At this time, an ink droplet is ejected through the nozzle 110 of the ink jet head 100.

When the pulse of the driving signal falls, the driving/detection switching signal is inputted into the switching means 23 in sync with the falling edge thereof (see the timing chart of FIG. 20), and the switching means 23 switches the connection of the diaphragm 121 from the driving circuit 18 to the ejection failure detecting means (detection circuit) 10, so that the electrostatic actuator 120 (used as the capacitor of the oscillation circuit 11) is connected to the ejection failure detecting means 10.

Then, the ejection failure detecting means 10 carries out the detecting and judging processing of an ejection failure (missing dot) as described above, and converts the residual vibration waveform data (rectangular wave data) of the diaphragm 121 outputted from the comparator 152 in the waveform shaping circuit 15 into numerical forms, such as the cycle or the amplitude of the residual vibration waveform by means of the measuring means 17. In this embodiment, the measuring means 17 measures a particular vibrational cycle from the residual vibration waveform data, and outputs the measurement result (numerical value) to the judging means 20.

To be more specific, in order to measure a time (cycle of the residual vibration) from the first rising edge to the following rising edge of the waveform (rectangular wave) of the output signal from the comparator 152, the measuring means 17 counts the pulses of the reference signal (having a predetermined frequency) by means of a counter (not shown), and measures the cycle (particular vibrational cycle) of the residual vibration from the count value. Alternatively, the measuring means 17 may measure a time from the first rising edge to the following falling edge, and output a time two times longer than the measured time to the judging means 20 as the cycle of the residual vibration. Hereinafter, the cycle of the residual vibration obtained in either manner is referred to as Tw.

The judging means 20 judges the presence or absence of an ejection failure of the nozzle, the cause of the ejection failure, a comparative deviation, and the like on the basis of the particular vibration cycle (measurement result) of the residual vibration waveform measured by the measuring means 17, and outputs the judgment result to the control section 6. The control section 6 then saves the judgment result in a predetermined storage region of the EEPROM (storage means) 62. The driving/detection switching signal is inputted into the switching means 23 again at the timing at which the following driving signal is inputted from the driving circuit 18, and the driving circuit 18 and the electrostatic actuator 120 are thereby connected to each other. Because the driving circuit 18 holds the ground (GND) level once the driving voltage is applied thereto, the switching means 23 carries out the switching operation as described above (see the timing chart of FIG. 20). This makes it possible to detect the residual vibration waveform of the diaphragm 121 of the electrostatic actuator 120 accurately without being influenced due to a disturbance or the like from the driving circuit 18.

In this regard, in the invention, the residual vibration waveform data is not limited to that made into a rectangular wave by the comparator 152. For example, it may be arranged in such a manner that the residual vibration amplitude data outputted from the operational amplifier 151 is converted into numerical forms by means of the measuring means 17 that carries out the A/D (analog-to-digital) conversion without carrying out the comparison processing by the comparator 152, then the presence or absence of an ejection failure or the like is judged by the judging means 20 on the basis of the data converted into the numerical forms in this manner, and the judgment result is stored into the storage means 62.

Further, because the meniscus (the surface on which ink within the nozzle 110 comes in contact with air) of the nozzle 110 vibrates in sync with the residual vibration of the diaphragm 121, each of the ink jet heads 100 waits for the residual vibration of the meniscus to be damped in a time substantially determined based on the acoustic resistance r after the ink droplet ejection operation (stand by for a predetermined time), and then starts the following ink droplet ejection operation. In the present invention, because the residual vibration of the diaphragm 121 is detected by effectively using this stand-by time, detection of an ejection failure can be carried out without influencing the driving of the ink jet head 100. In other words, it is possible to carry out the ejection failure detecting and judging processing for the nozzle 110 of the ink jet head 100 without reducing the throughput of the ink jet printer 1 (droplet ejection apparatus).

As described above, in the case where an air bubble has intruded into the cavity 141 of the ink jet head 100, because the frequency becomes higher than that of the residual vibration waveform of the diaphragm 121 in the case of normal ejection, the cycle thereof conversely becomes shorter than the cycle of the residual vibration in the case of normal ejection. Further, in the case where ink has thickened or fixed due to drying in the vicinity of the nozzle 110, the residual vibration is over-damped. Hence, because the frequency becomes extremely low in comparison with that of the residual vibration waveform in the case of normal ejection, the cycle thereof becomes markedly longer than the cycle of the residual vibration in the case of normal ejection. Furthermore, in the case where paper dust is adhering in the vicinity of the outlet of the nozzle 110, the frequency of the residual vibration is lower than the frequency of the residual vibration in the case of normal ejection and higher than the frequency of the residual vibration in the case of drying/thickening of ink. Hence, the cycle thereof becomes longer than the cycle of the residual vibration in the case of normal ejection and shorter than the cycle of the residual vibration in the case of drying of ink.

Therefore, by setting a predetermined range Tr as the cycle of the residual vibration in the case of normal ejection, and by setting a predetermined threshold T1 to differentiate the cycle of the residual vibration when paper dust is adhering in the vicinity of the outlet of the nozzle 110 from the cycle of the residual vibration when ink has dried in the vicinity of the nozzle 110, it is possible to determine the cause of such an ejection failure of the ink jet head 100. The judging means 20 judges the cause of an ejection failure depending on whether or not the cycle Tw of the residual vibration waveform detected in the ejection failure detecting and judging processing described above is a cycle within the predetermined range, or longer than the predetermined threshold.

Figure 24:
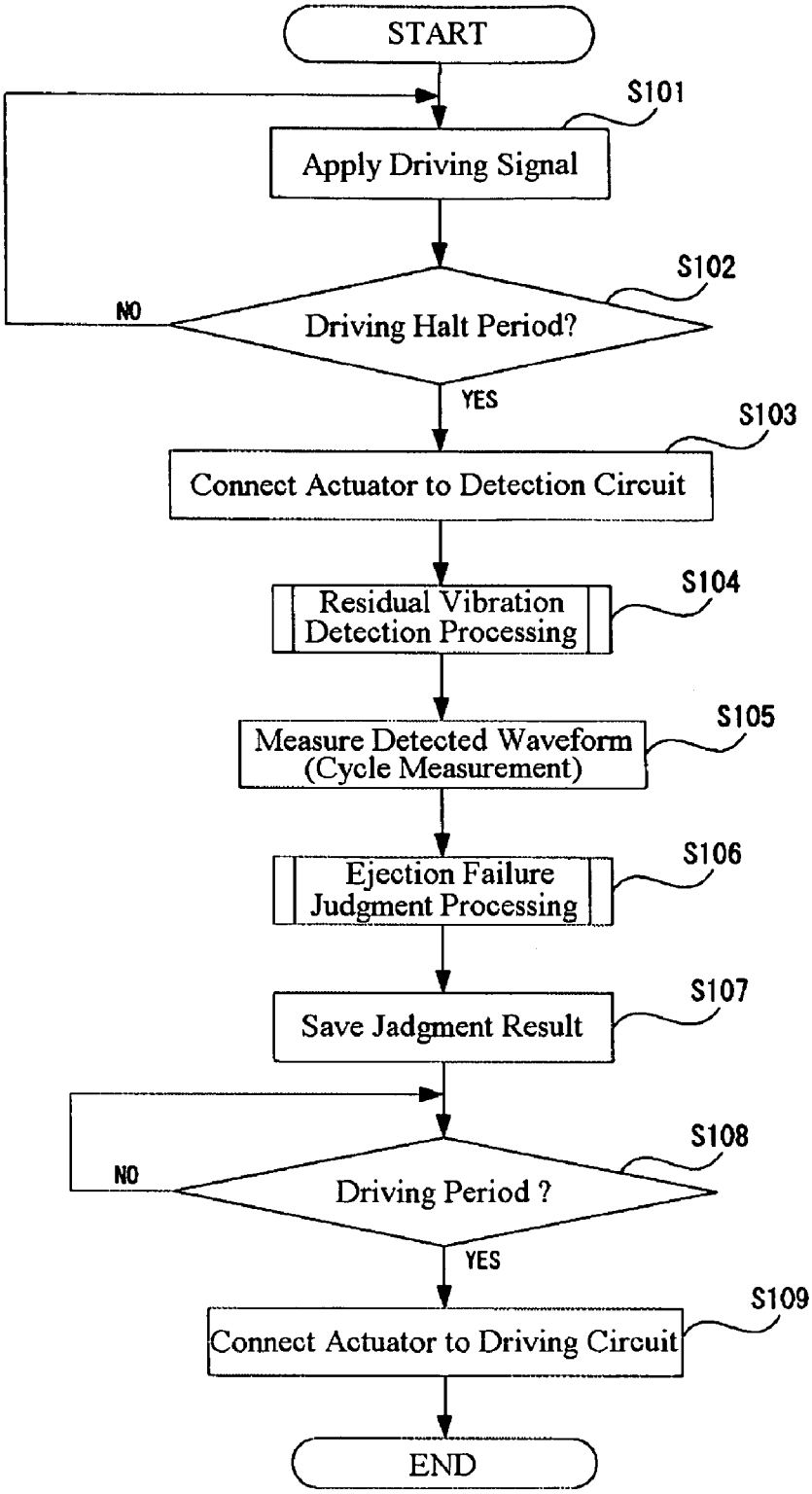
FIG. 24 is a flowchart showing ejection failure detection and judgment processing of the invention.

Next, the operation of the droplet ejection apparatus of the invention will now be described on the basis of the configuration of the ink jet printer 1 as described above. First, the ejection failure detecting and judging processing (including the driving/detection switching processing) for the nozzle 110 of one ink jet head 100 will be described. FIG. 24 is a flowchart showing the ejection failure detection and judgment processing of the invention. When printing data to be printed (or ejection data used for the flushing operation) is inputted into the control section 6 from the host computer 8 via the interface (IF) 9, the ejection failure detecting and judging processing is carried out at the predetermined timing. In this regard, in the flowchart shown in FIG. 24, the ejection failure detecting and judging processing corresponding to an ink ejection operation of one ink jet head 100, that is, one nozzle 110, will be described for ease of explanation.

Figure 20:
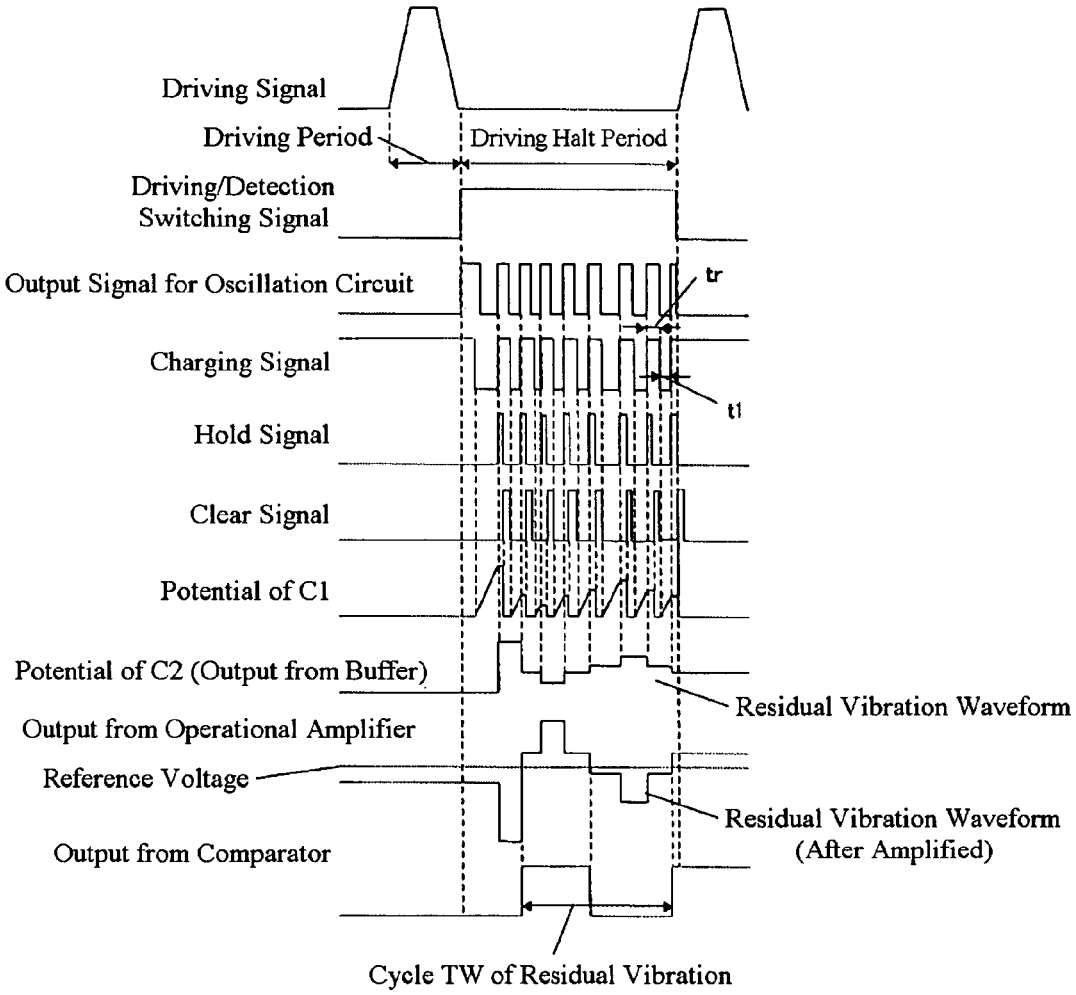
FIG. 20 is a timing chart showing the timing of output signals from respective portions and the like based on an oscillation frequency outputted from the oscillation circuit of the invention.

Initially, the driving signal corresponding to the printing data (ejection data) is inputted from the driving circuit 18 of the head driver 33, whereby the driving signal (voltage signal) is applied between both electrodes of the electrostatic actuator 120 according to the timing of the driving signal as shown in the timing chart of FIG. 20 (Step S101). The control section 6 then judges whether or not the ink jet head 100 that has ejected an ink droplet is in a driving halt period on the basis of the driving/detection switching signal (Step S102). At this point, the driving/detection switching signal shifts to the high level in sync with the falling edge of the driving signal (see FIG. 20), and is inputted into the switching means 23 from the control section 6.

When the driving/detection switching signal is inputted into the switching means 23, the electrostatic actuator 120, that is, the capacitor constituting the oscillation circuit 11 is isolated from the driving circuit 18 by the switching means 23, and is connected to the ejection failure detecting means 10 (detection circuit) side, that is, to the oscillation circuit 11 of the residual vibration detecting means 16 (Step S103). Subsequently, the residual vibration detection processing described later is carried out (Step S104), and the measuring means 17 measures the predetermined numerical value from the residual vibration waveform data detected in the residual vibration detection processing (Step S105). In this case, the measuring means 17 measures the cycle of the residual vibration from the residual vibration waveform data as described above.

Subsequently, the ejection failure judgment processing described later is carried out by the judging means 20 on the basis of the measurement result by the measuring means 17 (Step S106), and the judgment result is saved (stored) in a predetermined storage region in the EEPROM (storage means) 62 of the control section 6 (Step S107). At the following Step S108, it is judged whether or not the ink jet head 100 is in the driving period. In other words, it is judged whether or not the driving halt period has ended and the following driving signal is inputted, and this operation is suspended at Step S108 until the following driving signal is inputted.

When the driving/detection switching signal shifts to the low level in sync with the rising edge of the driving signal at the timing at which the following driving signal is inputted (i.e., "YES" at Step S108), the switching means 23 switches the connection of the electrostatic actuator 120 from the ejection failure detecting means (detection circuit) 10 to the driving circuit 18 (Step S109), and the ejection failure detecting and judging processing is terminated.

The flowchart shown in FIG. 24 shows a case where the measuring means 17 measures the cycle from the residual vibration waveform detected in the residual vibration detection processing (the residual vibration detecting means 16); however, the present invention is not limited to this case. For example, the measuring means 17 may measure a phase difference or amplitude of the residual vibration waveform from the residual vibration waveform data detected in the residual vibration detection processing.

Figure 25:
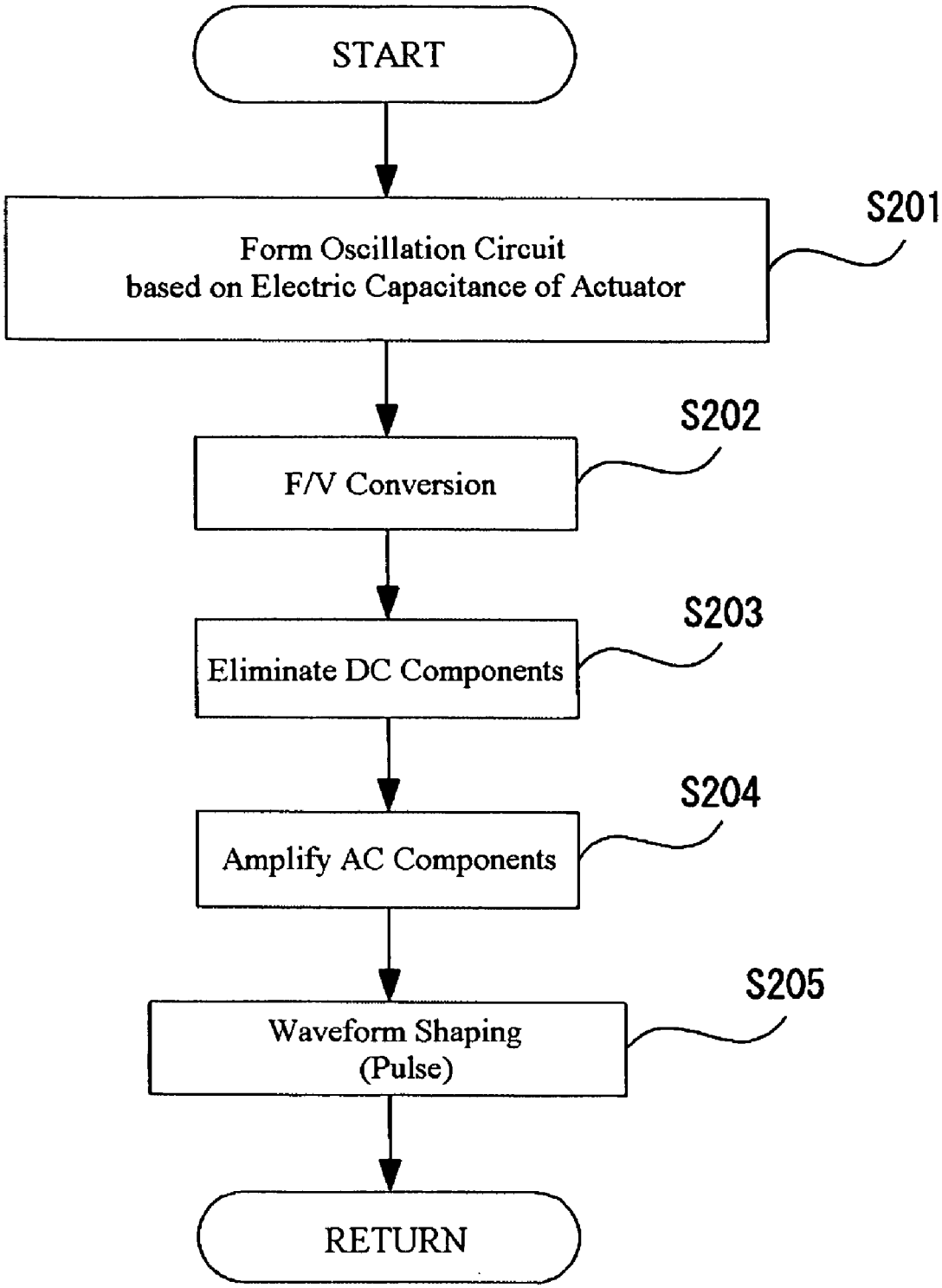
FIG. 25 is a flowchart showing residual vibration detection processing of the invention.

Next, the residual vibration detection processing (sub routine) at Step S104 of the flowchart shown in FIG. 24 will now be described. FIG. 25 is a flowchart showing the residual vibration detection processing of the invention. When the electrostatic actuator 120 and the oscillation circuit 11 are connected to each other by the switching means 23 as described above (Step S103 of FIG. 24), the oscillation circuit 11 forms a CR oscillation circuit, and starts to oscillate in response to the change of the electric capacitance of the electrostatic actuator 120 (residual vibration of the diaphragm 121 of the electrostatic actuator 120) (Step S201).

As shown in the timing chart described above, the charging signal, the hold signal and the clear signal are generated in the F/V converting circuit 12 according to the output signal (pulse signal) from the oscillation circuit 11, and the F/V conversion processing is carried out according to these signals by the F/V converting circuit 12, by which the frequency of the output signal from the oscillation circuit 11 is converted into a voltage (Step S202), and then the residual vibration waveform data of the diaphragm 121 is outputted from the F/V converting circuit 12. The DC components (direct current components) are eliminated from the residual vibration waveform data outputted from the F/V converting circuit 12 in the capacitor C3 of the waveform shaping circuit 15 (Step S203), and the residual vibration waveform (AC components) from which the DC components have been eliminated is amplified in the operational amplifier 151 (Step S204).

The residual vibration waveform data after the amplification is subjected to waveform shaping in the predetermined processing and converted into pulses (Step S205). In other words, in this embodiment, the voltage value (predetermined voltage value) set by the direct current voltage source Vref2 is compared with the output voltage from the operational amplifier 151 in the comparator 152. The comparator 152 outputs the binarized waveform (rectangular wave) on the basis of the comparison result. The output signal from the comparator 152 is the output signal from the residual vibration detecting means 16, and is outputted to the measuring means 17 for the ejection failure judgment processing to be carried out, upon which the residual vibration detection processing is completed (terminated).

Figure 26:
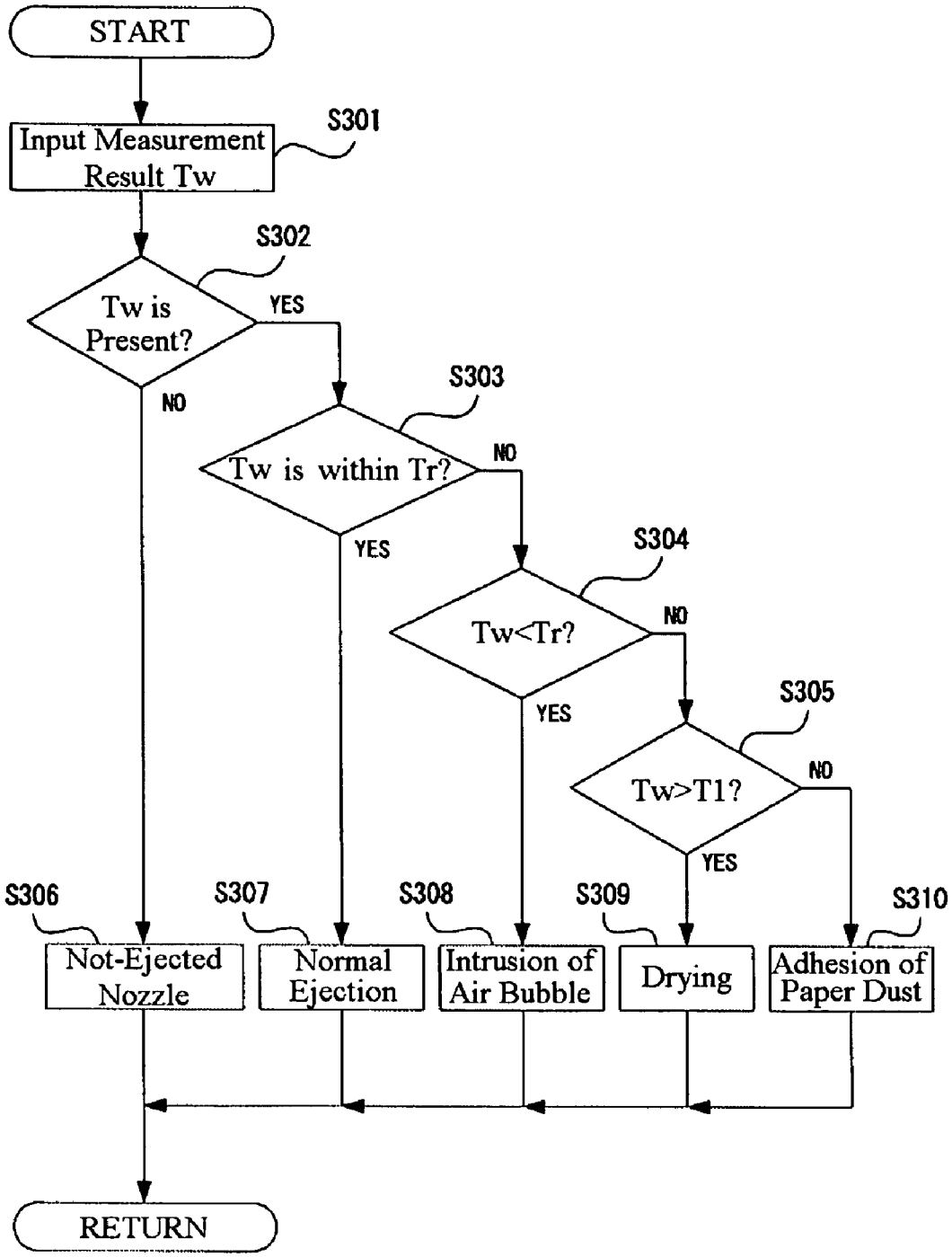
FIG. 26 is a flowchart showing ejection failure judgment processing of the invention.

The ejection failure judgment processing (sub routine) at Step S106 of the flowchart shown in FIG. 24 will now be described. FIG. 26 is a flowchart showing the ejection failure judgment processing of the invention carried out by the control section 6 and the judging means 20. The judging means 20 judges whether or not ink droplets were ejected normally from the corresponding ink jet head 100 on the basis of the measurement data (measurement result), such as the cycle, measured by the measuring means 17 described above. Also, when ink droplets were not ejected normally, that is, in the case of an ejection failure, the judging means 20 further judges the cause thereof.

Initially, the control section 6 outputs the predetermined range Tr of the cycle of the residual vibration and the predetermined threshold T1 of the cycle of the residual vibration stored in the EEPROM 62 to the judging means 20. The predetermined range Tr of the cycle of residual vibration is the residual vibration cycle in the case of normal ejection given with an allowance for the cycle to be judged as normal. The data is stored in a memory (not shown) of the judging means 20, and the processing as follows is carried out.

The measurement result measured in the measuring means 17 at Step S105 of FIG. 24 is inputted into the judging means 20 (Step S301). Here, in this embodiment, the measurement result is the cycle Tw of the residual vibration of the diaphragm 121.

At Step S302, the judging means 20 judges whether or not the cycle Tw of the residual vibration is present, that is, whether or not the ejection failure detecting means 10 failed to obtain the residual vibration waveform data. In the case where it is judged that the cycle Tw of the residual vibration is absent, the judging means 20 judges that the nozzle 110 of the ink jet head 100 in question is a not-yet-ejected nozzle that did not eject an ink droplet in the ejection failure detecting and judging processing (Step S306). Further, in the case where it is judged that the residual vibration waveform data is present, the judging means 20 judges, at the following Step S303, whether or not the cycle Tw is within the predetermined range Tr that can be deemed as the cycle in the case of normal ejection.

In the case where it is judged that the cycle Tw of the residual vibration is within the predetermined range Tr, it means that an ink droplet was ejected normally from the corresponding ink jet head 100. Hence, the judging means 20 judges that the nozzle 110 of the ink jet head 100 in question normally ejected an ink droplet (normal ejection) (Step S307). Further, in the case where it is judged that the cycle Tw of the residual vibration is not within the predetermined range Tr, the judging means 20 judges, at the following Step S304, whether or not the cycle Tw of the residual vibration is shorter than the predetermined range Tr.

In the case where it is judged that the cycle Tw of the residual vibration is shorter than the predetermined range Tr, it means that the frequency of the residual vibration is high, and an air bubble is thought to have intruded into the cavity 141 of the ink jet head 100 as described above. Hence, the judging means 20 judges that an air bubble has intruded into the cavity 141 of the ink jet head 100 in question (intrusion of an air bubble) (Step S308).

In the case where it is judged that the cycle Tw of the residual vibration is longer than the predetermined range Tr, the judging means 20 subsequently judges whether or not the cycle Tw of the residual vibration is longer than the predetermined threshold T1 (Step S305). In the case where it is judged that the cycle Tw of the residual vibration is longer than the predetermined threshold T1, the residual vibration is thought to be over-damped. Hence, the judging means 20 judges that ink has thickened due to drying in the vicinity of the nozzle 110 of the ink jet head 100 in question (drying) (Step S309).

In the case where it is judged at Step S305 that the cycle Tw of the residual vibration is shorter than the predetermined threshold T1, the cycle Tw of the residual vibration takes a value that falls within the range satisfying the relation, Tr<Tw<T1, and as described above, paper dust is thought to be adhering in the vicinity of the outlet of the nozzle 110, in case of which the frequency is higher than in the case of drying. Hence, the judging means 20 judges that paper dust is adhering in the vicinity of the outlet of the nozzle 110 of the ink jet head 100 in question (adhesion of paper dust) (Step S310).

When normal ejection or the cause of an ejection failure of the target ink jet head 100 is judged by the judging means 20 (Steps S306 through S310) in this manner, the judgment result is outputted to the control section 6, upon which the ejection failure judgment processing is completed (terminated).

Next, on the assumption of the ink jet printer 1 provided with a head unit 35 including a plurality of ink jet heads (droplet ejection heads) 100, that is, a plurality of nozzles 110 (in this embodiment, the head unit 35 is provided with five ink jet heads 100*a* through 100*e* (that is, five nozzles 110), but, in the invention, both the number of the head units 35 provided to the printing means 3 and the number of the ink jet heads 100 (nozzles 110) provided to each head unit 35 are not limited to these numbers, they may be determined arbitrarily), a plurality of ejection selecting means (nozzle selector) 182 corresponding to the respective colors of inks of the ink jet printer 1 and the timing of the detection and judgment (detection and judgment timing) of an ejection failure for the respective ink jet heads 100 will now be described. FIGS. 27–30 are block diagrams showing some examples of the detection and judgment timing of an ejection failure in the ink jet printer 1 provided with the plurality of ejection selecting means 182. Examples of the configuration in the respective drawings will now be described one by one.

Figure 27:
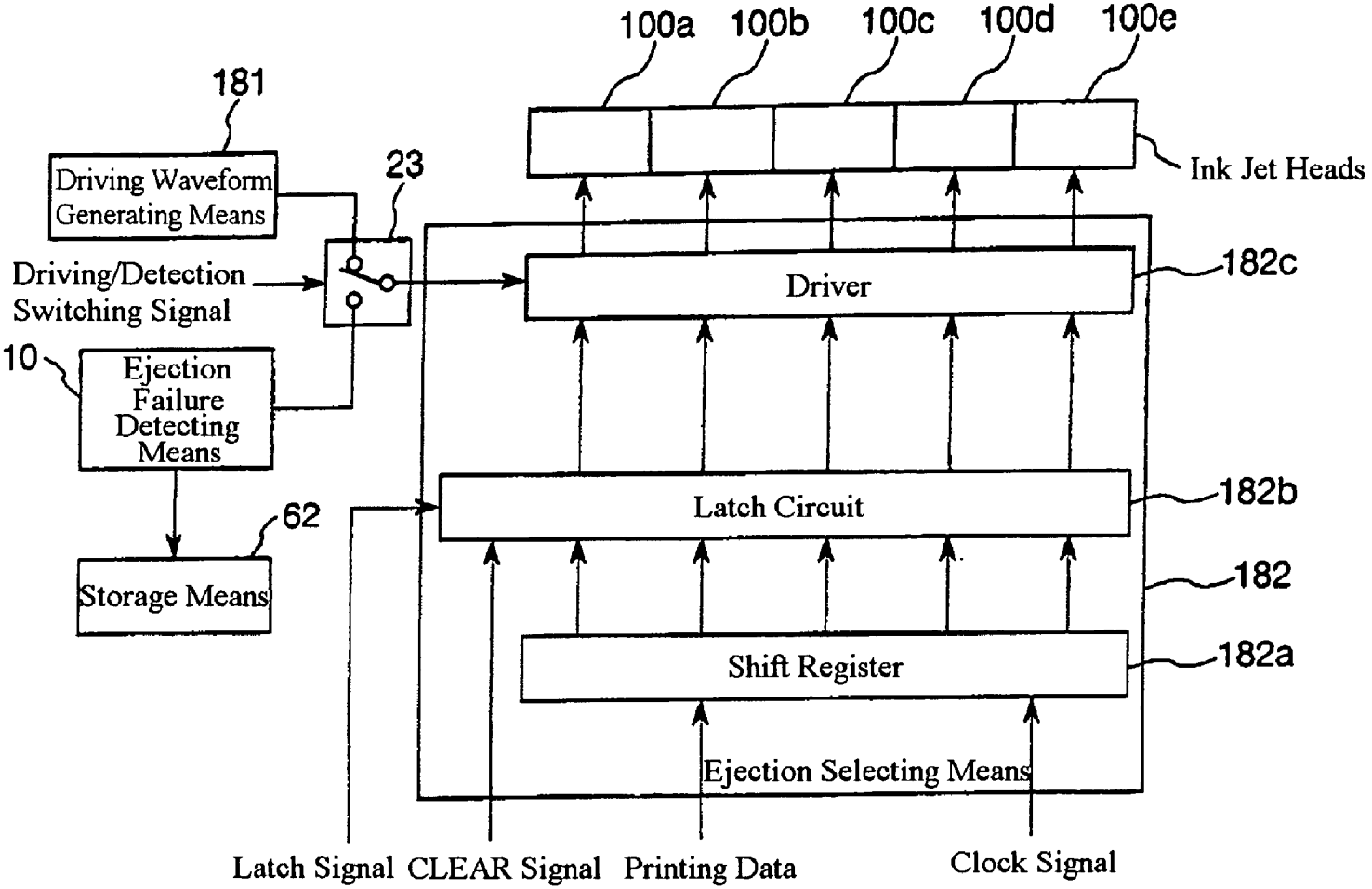
FIG. 27 shows one example of detection timing of an ejection failure for a plurality of ink jet heads (in the case where there is one ejection failure detecting means).

FIG. 27 shows one example of detection timing of an ejection failure for a plurality of (five) ink jet heads 100*a* through 100*e* (in the case where there is one ejection failure detecting means 10). As shown in FIG. 27, the ink jet printer 1 having a plurality of ink jet heads 100*a* through 100*e* is provided with driving waveform generating means 181 for generating a driving waveform, the ejection selecting means 182 capable of selecting from which nozzle 110 ink droplets are to be ejected, and the plurality of ink jet heads 100*a* through 100*e* selected by the ejection selecting means 182 and driven by the driving waveform generating means 181. In this regard, because the configuration of FIG. 27 is the same as those shown in FIG. 2, FIG. 16, and FIG. 23 except for the above-mentioned configuration, the description of the same portion is omitted.

In this example, the driving waveform generating means 181 and the ejection selecting means 182 are described as they are included in the driving circuit 18 of the head driver 33 (they are indicated as two blocks via the switching means 23 in FIG. 27; however, both of them are generally formed inside the head driver 33). The invention, however, is not limited to this configuration. For example, the driving waveform generating means 181 may be provided independently of the head driver 33.

As shown in FIG. 27, the ejection selecting means 182 is provided with a shift register 182*a*, a latch circuit 182*b*, and a driver 182*c*. Printing data (ejection data) outputted from the host computer 8 shown in FIG. 2 and underwent the predetermined processing in the control section 6 as well as a clock signal (CLK) are sequentially inputted into the shift register 182*a*. The printing data is shifted and inputted sequentially from the first stage to the latter stages in the shift register 182*a* in response to an input pulse of the clock signal (CLK) (each time the clock signal is inputted), and is then outputted to the latch circuit 182*b* as printing data corresponding to the respective ink jet heads 100*a* through 100*e*. In the ejection failure detecting and judging processing described later, ejection data used at the time of flushing (preliminary ejection) is inputted instead of the printing data. However, the ejection data referred to herein means printing data for all of the ink jet heads 100*a* through 100*e*. Alternatively, a value such that all the outputs from the latch circuit 182*b* will trigger ejection may be set by hardware at the time of flushing.

The latch circuit 182*b* latches the respective output signals from the shift register 182*a* by the latch signal inputted therein after printing data corresponding to the number of the nozzles 110 of the head unit 35, that is, the number of the ink jet heads 100, is stored into the shift register 182*a*. In the case where a CLEAR signal is inputted, the latch state is released, and the latched output signal from the shift register 182*a* becomes 0 (output of the latch is stopped), whereby the printing operation is stopped. In the case where no CLEAR signal is inputted, the latched printing data from the shift register 182*a* is outputted to the driver 182*c*. After the printing data outputted from the shift register 182*a* is latched in the latch circuit 182*b*, the following printing data is inputted into the shift register 182*a*, so that the latch signal in the latch circuit 182*b* is successively updated at the print timing.

The driver 182*c* connects the driving waveform generating means 181 to the electrostatic actuators 120 of the respective ink jet heads 100, and inputs the output signal (driving signal) from the driving waveform generating means 181 to the respective electrostatic actuators 120 specified (identified) by the latch signal outputted from the latch circuit 182*b* (any or all of the electrostatic actuators 120 of the ink jet heads 100*a* through 100*e*). The driving signal (voltage signal) is thus applied between both electrodes of the corresponding electrostatic actuator 120.

The ink jet printer 1 shown in FIG. 27 is provided with one driving waveform generating means 181 for driving the plurality of ink jet heads 100*a* through 100*e*, the ejection failure detecting means 10 for detecting an ejection failure (ink droplet non-ejection) for the ink jet head 100 in any of the ink jet heads 100*a* through 100*e*, storage means 62 for saving (storing) the judgment result, such as the cause of the ejection failure, obtained by the ejection failure detecting means 10, and one switching means 23 for switching the connection of the ejection selecting means 182 between the driving waveform generating means 181 and the ejection failure detecting means 10. Therefore, in this ink jet printer 1, one or more of the ink jet heads 100*a* through 100*e* selected by the driver 182*c* is driven according to the driving signal inputted from the driving waveform generating means 181, and the switching means 23 switches the connection of the electrostatic actuator 120 of the ink jet head 100 from the driving waveform generating means 181 to the ejection failure detecting means 10 when the driving/detection switching signal is inputted into the switching means 23 after the ejection driving operation. Then, the ejection failure detecting means 10 detects whether or not an ejection failure (ink droplet non-ejection) exists in the nozzle 110 of the ink jet head 100 in question as well as judges the cause thereof in the event of ejection failure, on the basis of the residual vibration waveform of the diaphragm 121.

Further, in the ink jet printer 1, when an ejection failure is detected and judged for the nozzle 110 of one ink jet head 100, an ejection failure is detected and judged for the nozzle 110 of the ink jet head 100 specified next, according to the driving signal subsequently inputted from the driving waveform generating means 181. Thereafter, an ejection failure is detected and judged sequentially for the nozzles 110 of the ink jet heads 100 to be driven by an output signal from the driving waveform generating means 181 in the same manner. Then, as described above, when the residual vibration detecting means 16 detects the residual vibration waveform of the diaphragm 121, the measuring means 17 measures the cycle or the like of the residual vibration waveform on the basis of the waveform data thereof. The judging means 20 then judges normal ejection or an ejection failure on the basis of the measurement result in the measuring means 17, and judges the cause of the ejection failure in the event of ejection failure (head failure) to output the judgment result to the storage means 62.

In this way, because the ink jet printer 1 shown in FIG. 27 is configured in such a manner that an ejection failure is detected and judged sequentially for the respective nozzles 110 of the plurality of ink jet heads 100*a* through 100*e* during the ink droplet ejection driving operation, it is sufficient to provide one ejection failure detecting means 10 and one switching means 23, whereby it is possible to scale down the circuitry of the ink jet printer 1 capable of detecting and judging an ejection failure, and to prevent an increase of the manufacturing costs thereof.

Figure 28:
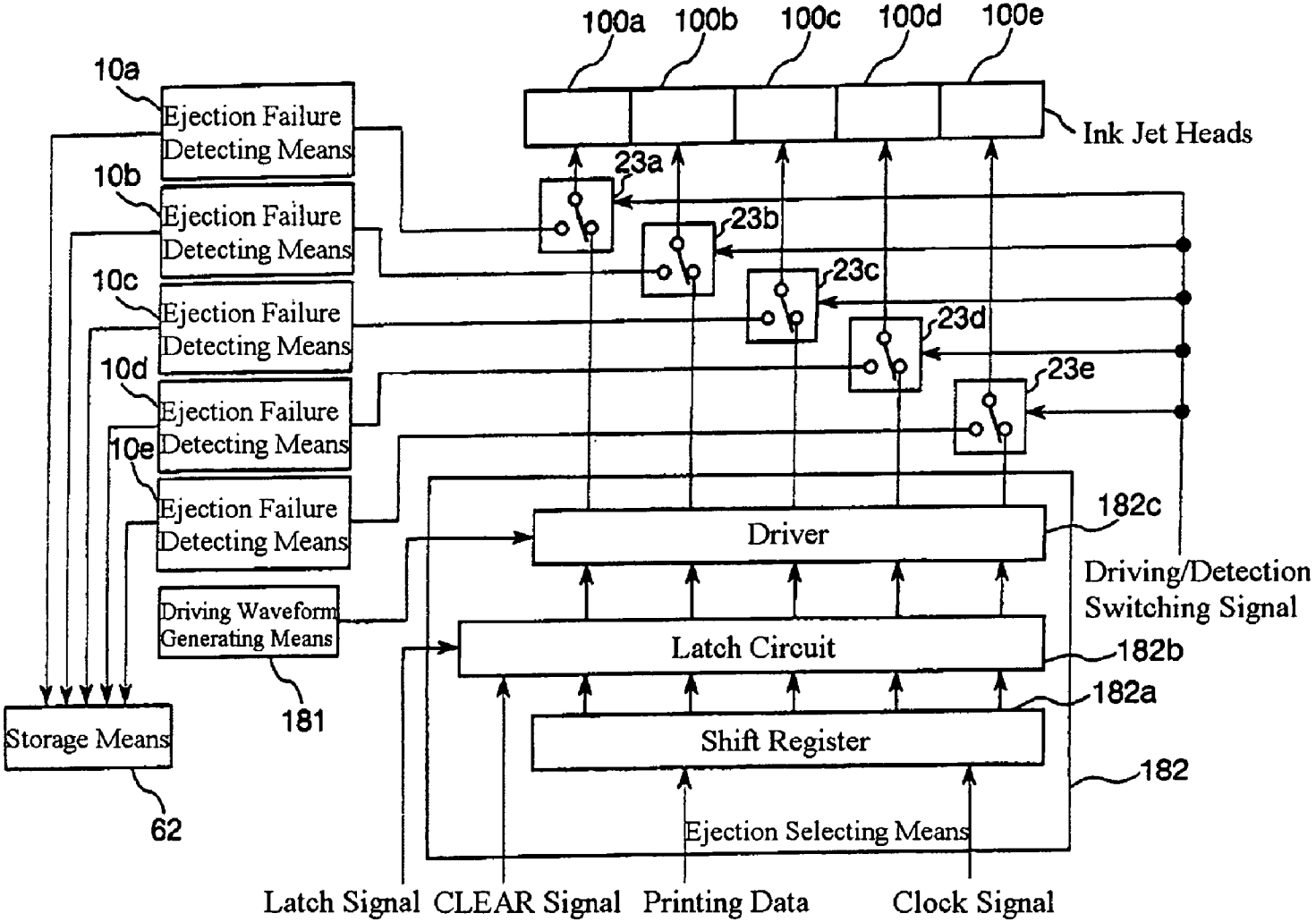
FIG. 28 shows another example of detection timing of an ejection failure for a plurality of ink jet heads (in the case where the number of ejection failure detecting means is equal to the number of ink jet heads).

FIG. 28 shows another example of detection timing of an ejection failure for a plurality of ink jet heads 100 (in the case where the number of the ejection failure detecting means 10 is equal to the number of the ink jet heads 100). The ink jet printer 1 shown in FIG. 28 is provided with one ejection selecting means 182, five ejection failure detecting means 10*a* through 10*e*, five switching means 23*a* through 23*e*, one driving waveform generating means 181 common for five ink jet heads 100*a* through 100*e*, and one storage means 62. In this regard, because the respective components have been described with reference to FIG. 27, the description of these components is omitted and only the connections of these components will be described.

As in the case shown in FIG. 27, the ejection selecting means 182 latches printing data corresponding to the respective ink jet heads 100*a* through 100*e* in the latch circuit 182*b* on the basis of the clock signal CLK and the printing data (ejection data) inputted from the host computer 8, and drives the electrostatic actuators 120 of the ink jet heads 100*a* through 100*e* corresponding to the printing data in response to the driving signal (voltage signal) inputted from the driving waveform generating means 181 into the driver 182*c*. The driving/detection switching signal is inputted into the respective switching means 23*a* through 23*e* corresponding to all the ink jet heads 100*a* through 100*e*. The switching means 23*a* through 23*e* then switch the connection of the ink jet heads 100 from the driving waveform generating means 181 to the ejection failure detecting means 10*a* through 10*e* according to the driving/detection switching signal regardless of the presence or absence of the corresponding printing data (ejection data), after input of the driving signal into the electrostatic actuators 120 of the ink jet heads 100.

After an ejection failure is detected and judged for the respective ink jet heads 100*a* through 100*e* by all the ejection failure detecting means 10*a* through 10*e*, the judgment results for all the ink jet heads 100*a* through 100*e* obtained in the ejection failure detecting and judging processing are outputted to the storage means 62. The storage means 62 stores the presence or absence of an ejection failure and the cause of the ejection failure for the respective ink jet heads 100*a* through 100*e* into the predetermined storage region thereof.

In this way, in the ink jet printer 1 shown in FIG. 28, the plurality of ejection failure detecting means 10*a* through 10*e* are respectively provided for the nozzles 110 of the plurality of ink jet heads 100*a* through 100*e*, and an ejection failure is detected and the cause thereof is judged after carrying out the switching operation with the use of the plurality of switching means 23*a* through 23*e* corresponding to the ejection failure detecting means 10*a* through 10*e*. Therefore, it is possible to detect an ejection failure and judge the cause thereof in a short time for all the nozzles 110 at a time.

Figure 29:
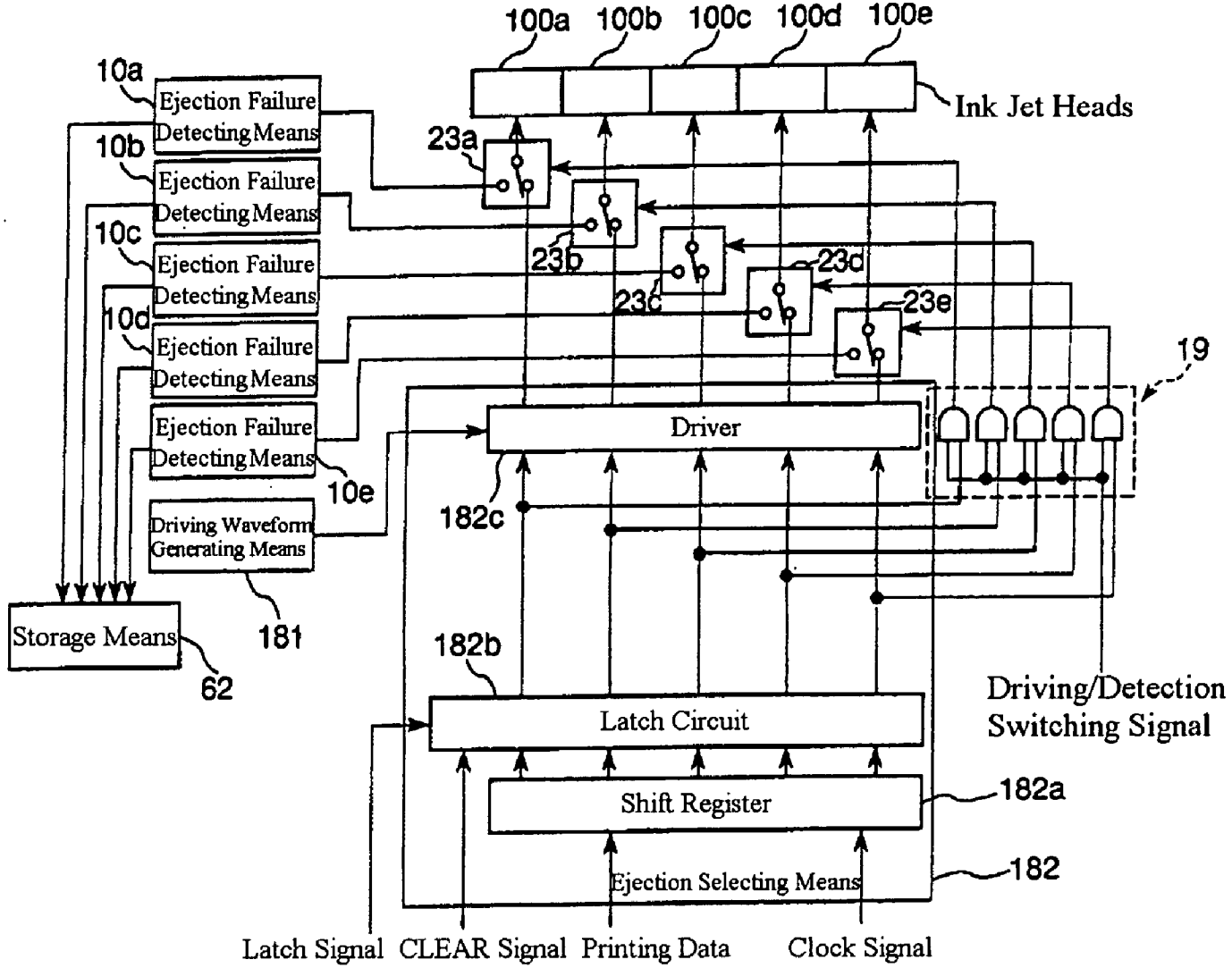
FIG. 29 shows still another example of detection timing of an ejection failure for a plurality of ink jet heads (in the case where the number of ejection failure detecting means is equal to the number of ink jet heads, and detection of an ejection failure is carried out when printing data is inputted).

FIG. 29 shows still another example of detection timing of an ejection failure for a plurality of ink jet heads 100 (in the case where the number of the ejection failure detecting means 10 is equal to the number of the ink jet heads 100, and detection of an ejection failure is carried out when printing data is inputted). The ink jet printer 1 shown in FIG. 29 is of the same configuration as that of the ink jet printer 1 shown in FIG. 28 except that switching control means 19 is added (appended). In this example, the switching control means 19 comprises a plurality of AND circuits (logical conjunction circuits) ANDa through ANDe, and upon input of the printing data to be inputted into the respective ink jet heads 100*a* through 100*e* and the driving/detection switching signal, the switching control means 19 outputs an output signal in the high level to the corresponding switching means 23*a* through 23*e*. In this case, the switching control means 19 is not limited to AND circuits (logical conjunction circuits), and it only has to be formed in such a manner that the switching control means 19 selects one or any of the plurality of switching means 23 that corresponds to an output from the latch circuit 182*b* for selecting the ink jet head 100 to be driven.

The respective switching means 23*a* through 23*e* switch the connection of the electrostatic actuators 120 of the corresponding ink jet heads 100*a* through 100*e* from the driving waveform generating means 181 to the corresponding ejection failure detecting means 10*a* through 10*e*, according to the output signals from the corresponding AND circuits ANDa through ANDe of the switching control means 19. To be more specific, when the output signals from the corresponding AND circuits ANDa through ANDe are in the high level, in other words, in the case where printing data to be inputted into the corresponding ink jet heads 100*a* through 100*e* is outputted from the latch circuit 182*b* to the driver 182*c* while the driving/detection switching signal remains in the high level, the switching means 23*a* through 23*e* corresponding to the AND circuits in question switch the connections of the corresponding ink jet heads 100*a* through 100*e* from the driving waveform generating means 181 to the corresponding ejection failure detecting means 10*a* through 10*e*.

After the presence or absence of an ejection failure for the respective ink jet heads 100 and the cause thereof in the event of ejection failure are detected by the ejection failure detecting means 10*a* through 10*e* corresponding to the ink jet heads 100 into which the printing data has been inputted, the corresponding ejection failure detecting means 10 output the judgment results obtained in the ejection failure detecting and judging processing to the storage means 62. The storage means 62 stores one or more judgment result inputted (obtained) in this manner into the predetermined storage region thereof.

In this way, in the ink jet printer 1 shown in FIG. 29, a plurality of ejection failure detecting means 10*a* through 10*e* are provided to correspond to the respective nozzles 110 of a plurality of ink jet heads 100*a* through 100*e*, and when printing data corresponding to the respective ink jet heads 100*a* through 100*e* is inputted into the ejection selecting means 182 from the host computer 8 via the control section 6, an ejection failure of the ink jet head 100 is detected and the cause thereof is judged after only any of the switching means 23*a* through 23*e* specified by the switching control means 19 carry out the predetermined switching operation. Hence, the detection and judgment processing is not carried out for the ink jet heads 100 that have not carried out the ejection driving operation. It is thus possible to avoid useless detection and judgment processing in this ink jet printer 1.

Figure 30:
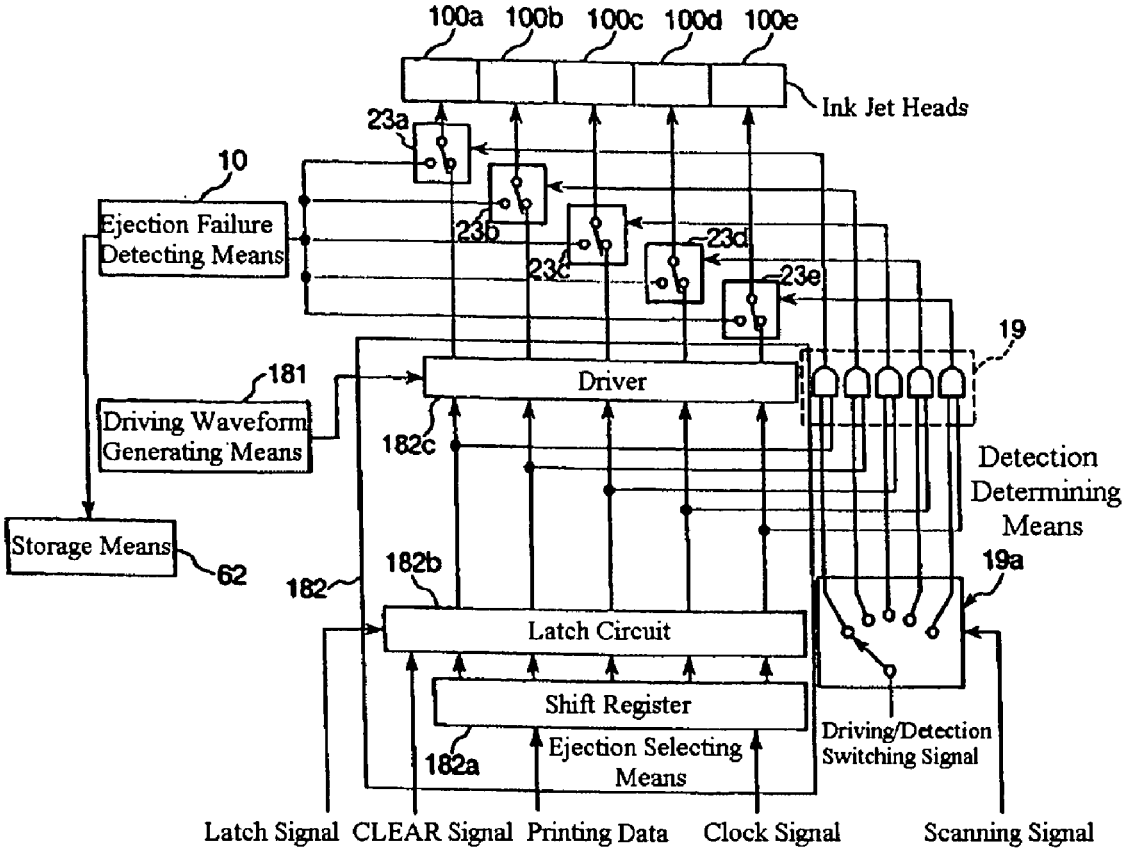
FIG. 30 shows yet still another example of detection timing of an ejection failure for a plurality of ink jet heads (in the case where the number of switching means is equal to the number of ink jet heads, and detection of an ejection failure is carried out by making the rounds of the respective ink jet heads).

FIG. 30 shows yet still another example of the detection timing of an ejection failure for a plurality of ink jet heads 100 (in the case where the number of switching means 23 is equal to the number of the ink jet heads 100, and detection of an ejection failure is carried out by making the rounds of the respective ink jet heads 100). The ink jet printer 1 shown in FIG. 30 is of the same configuration as that of the ink jet printer 1 shown in FIG. 29 except that there is only one ejection failure detecting means 10 and switching selecting means 19*a* for scanning the driving/detection switching signal (identifying one of the ink jet heads 100 one by one for which the detection and judgment processing is to be carried out) is added.

This ink jet printer 1 is constructed so that detection determining means repeatedly carries out a scanning operation in which any one of the plurality of switching means 23*a* through 23*e* corresponding to the plurality of ink jet heads 100*a* through 100*e* is sequentially scanned in a predetermined order, and determines the ink jet head 100 when the timing of the droplet ejection operation of the droplet ejection head coincides with the timing of the scanning of the switching means corresponding to the droplet ejection head as a droplet ejection head for which the detection of the ejection failure of the droplets is to be carried out. Hereinafter, the description of the ink jet printer 1 will be given in detail.

The switching selecting means 19*a* is connected to the switching control means 19 as shown in FIG. 29, and is a selector that scans (selects and switches) the input of the driving/detection switching signal into the AND circuits ANDa through ANDe corresponding to a plurality of ink jet heads 100*a* through 100*e*, according to a scanning signal (selection signal) inputted from the control section 6. The scanning (selection) order of the switching selecting means 19*a* may be the same as the order of printing data inputted into the shift register 182*a*, that is, the order of ejection by the plurality of ink jet heads 100; however, it may simply be the order of the plurality of ink jet heads 100*a* through 100*e*. In this regard, in the structure of the ink jet heads 100 shown in FIG. 30, the switching selection means 19*a* and the switching control means 19 constitute the detection determining means that determines for which nozzle 110 in the nozzles 110 of the ink jet heads 100*a* through 100*e* the ejection failure detecting means 10 detects an ejection failure of droplets.

In the case where the scanning order is the order of printing data inputted into the shift register 182*a*, when the printing data is inputted into the shift register 182*a* of the ejection selecting means 182, the printing data is latched in the latch circuit 182*b*, and outputted to the driver 182*c* in response to the input of the latch signal. The scanning signal to identify the ink jet head 100 corresponding to the printing data is inputted into the switching selecting means 19*a* in sync with the input of the printing data into the shift register 182*a* or the input of the latch signal into the latch circuit 182*b*, and the driving/detection switching signal is outputted to the corresponding AND circuit. In this regard, the switching selecting means 19*a* outputs a low level signal from output terminals thereof when no selection is made.

The corresponding AND circuit (in switching control means 19) carries out the logical operation AND of the printing data inputted from the latch circuit 182*b* and the driving/detection switching signal inputted from the switching selecting means 19*a*, thereby outputting an output signal in the high level to the corresponding switching means 23. When the output signal in the high level is inputted from the switching control means 19, the switching means 23 switches the connection of the electrostatic actuator 120 of the corresponding ink jet head 100 from the driving waveform generating means 181 to the ejection failure detecting means 10.

The ejection failure detecting means 10 then detects an ejection failure of the ink jet head 100 into which the printing data has been inputted, and judges the cause thereof in the event of ejection failure, after which the ejection failure detecting means 10 outputs the judgment result to the storage means 62. The storage means 62 stores the judgment result inputted (obtained) in this manner into the predetermined storage region thereof.

Further, in the case where the scanning order is simply the order of the ink jet heads 100*a* through 100*e*, when the printing data is inputted into the shift register 182*a* of the ejection selecting means 182, the printing data is latched in the latch circuit 182*b*, and outputted to the driver 182*c* in response to the input of the latch signal. The scanning (selection) signal to identify the ink jet head 100 corresponding to the printing data is inputted into the switching selecting means 19*a* in sync with the input of the printing data into the shift register 182*a* or the input of the latch signal into the latch circuit 182*b*, and the driving/detection switching signal is outputted to the corresponding AND circuit of the switching control means 19.

When the printing data corresponding to the ink jet head 100 determined by the scanning signal inputted into the switching selecting means 19*a* is inputted into the shift register 182*a*, the output signal from the corresponding AND circuit (in switching control means 19) shifts to the high level, and the corresponding switching means 23 switches the connection of the corresponding ink jet head 100 from the driving waveform generating means 181 to the ejection failure detecting means 10. However, when no printing data is inputted into the shift register 182*a*, the output signal from the AND circuit remains in the low level, and the corresponding switching means 23 does not carry out the predetermined switching operation. In this way, the ejection failure detecting and judging processing of the ink jet head 100 is carried out on the basis of the AND of the selection result by the switching selecting means 19*a* and the presence of the printing data outputted from the latch circuit 182*b*.

In the case where the switching operation is carried out by the switching means 23, the ejection failure detecting means 10 detects an ejection failure of the ink jet head 100 into which the printing data has been inputted and judges the cause thereof in the event of ejection failure in the same manner as described above, and then the ejection failure detecting means 10 outputs the judgment result to the storage means 62. The storage means 62 stores the judgment result inputted (obtained) in this manner into the predetermined storage region thereof.

When there is no printing data corresponding to the ink jet head 100 specified by the switching selecting means 19*a*, the corresponding switching means 23 does not carry out the switching operation as described above, and for this reason, it is not necessary for the ejection failure detecting means 10 to carry out the ejection failure detecting and judging processing; however, such processing may be carried out as well. In the case where the ejection failure detecting and judging processing is carried out without carrying out the switching operation, as described in the flowchart of FIG. 26, the judging means 20 of the ejection failure detecting means 10 judges that the nozzle 110 of the corresponding ink jet head 100 is a not-yet ejected nozzle (Step S306), and stores the judgment result into the predetermined storage region of the storage means 62.

In this way, the ink jet printer 1 shown in FIG. 30 is different from the ink jet printer 1 shown in FIG. 28 or FIG. 29, and in the ink jet printer 1 shown in FIG. 30, only one ejection failure detecting means 10 is provided for the respective nozzles 110 of a plurality of ink jet heads 100*a* through 100*e*. When the printing data corresponding to the respective ink jet heads 100*a* through 100*e* is inputted into the ejection selecting means 182 from the host computer 8 via the control section 6 while identified by the scanning (selection) signal, only the switching means 23, corresponding to the ink jet head 100 to carry out the ejection driving operation in response to the printing data, carries out the switching operation, so that an ejection failure is detected and the cause thereof is judged only for the corresponding ink jet head 100. This makes it possible to reduce the load on the CPU 61 of the control section 6 without the need to process a large volume of detection results at a time. Further, because the ejection failure detecting means 10 makes the rounds of the respective ink jet heads 100 at nozzle states other than the ejection operation, it is possible to recognize an ejection failure of each nozzle 110 while being driven for printing, and the state of the nozzles 110 in the entire head unit 35 can be known. Thus, because an ejection failure is detected periodically, this can reduce, for example, the steps of detecting an ejection failure nozzle by nozzle while the printing operation is halted. In view of the foregoing, it is possible to efficiently detect an ejection failure of the ink jet head 100 and judge the cause thereof.

Moreover, in contrast to the ink jet printer 1 shown in FIG. 28 or FIG. 29, because the ink jet printer 1 shown in FIG. 30 may be provided with only one ejection failure detecting means 10, in comparison with the ink jet printers 1 shown in FIGS. 28 and 29, it is possible not only to scale down the circuitry of the ink jet printer 1, but also to prevent an increase of the manufacturing costs.

Next, the operations of the ink jet printers 1 shown in FIG. 27 through FIG. 30, that is, the ejection failure detecting and judging processing (chiefly, detection timing) in the ink jet printer 1 provided with a plurality of ink jet heads 100, will now be described. In the ejection failure detection and judgment processing (multi-nozzle processing) for droplet ejection heads of the invention, the residual vibration of the diaphragm 121 when the electrostatic actuators 120 of the respective ink jet heads 100 carry out the ink droplet ejection operation is detected, and the occurrence of an ejection failure (missing dot, ink droplet non-ejection) is judged for the ink jet head 100 in question on the basis of the cycle of the residual vibration; moreover, in the event of a missing dot (ink droplet non-ejection), the cause thereof is judged. In this manner, in the invention, when the ejection operation of ink droplets (droplets) by the ink jet heads 100 is carried out, the detection and judgment processing for the ink jet heads 100 can be carried out. However, the ink jet heads 100 eject ink droplets not only when the printing operation (print) is actually carried out onto a recording sheet P, but also when the flushing operation (preliminary ejection or preparatory ejection) is carried out. Hereinafter, the ejection failure detection and judgment processing (for multi-nozzle) in the droplet ejection heads of the invention in these two cases will be described.

In this regard, the flushing (preliminary ejection) process referred to herein is defined as a head cleaning operation by which ink droplets are ejected through all or only target nozzles 110 of the ink jet heads 100 in the head unit 35 while a cap (not shown in FIG. 1) is attached or in a place where ink droplets (droplets) do not reach the recording sheet P (media) (a cleaning position), that is, a non-recording region (a predetermined region on which ink droplets are allowed to land). The flushing process (flushing operation) is carried out, for example, when ink within the cavities 141 is discharged periodically to maintain the viscosity of ink in the nozzles 110 at a value within an adequate range, or as a recovery operation when ink has thickened. Further, the flushing process is also carried out when the respective cavities 141 are initially filled with ink after the ink cartridges 31 are attached to the printing means 3.

A wiping process (i.e., processing by which fouling (such as paper dust or dust) adhering onto the head surface of the head unit 35 are wiped out by a wiper not shown in FIG. 1) may be carried out to clean the nozzle plate (nozzle surface) 150. In this case, however, a negative pressure may be produced inside the nozzles 110 and ink of other colors (other kinds of droplets) may be sucked therein. Hence, the flushing operation is carried out after the wiping process in order to force a predetermined quantity of ink droplets to be ejected through all the nozzles 110 of the head unit 35. Further, the flushing process may be carried out from time to time in order to ensure satisfactory printing by maintaining the meniscus of the nozzles 110 in a normal state.

Figure 31:
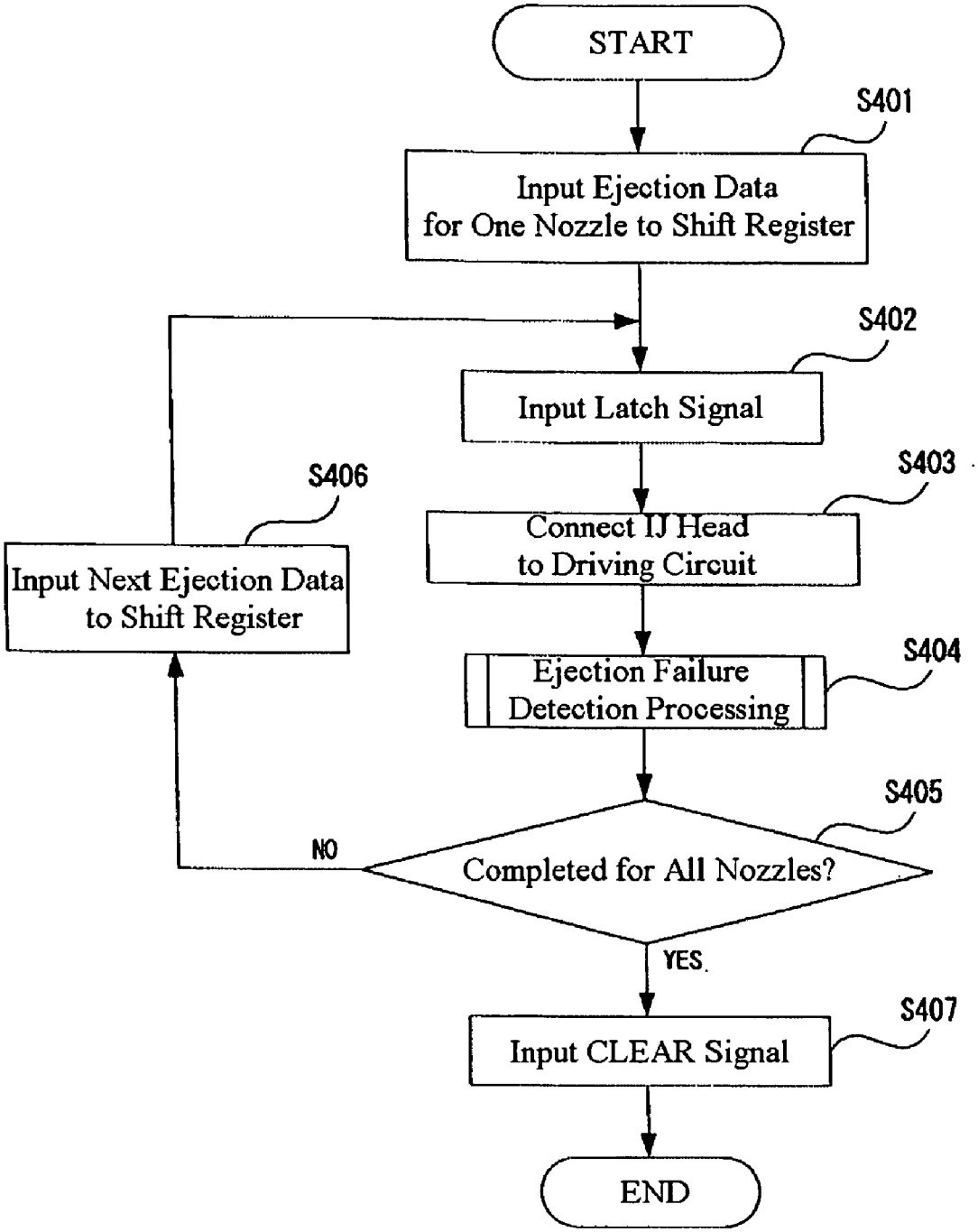
FIG. 31 is a flowchart showing the detection timing of an ejection failure during a flushing operation by the ink jet printer shown in FIG. 27.

First, the ejection failure detection and judgment processing during the flushing process will be described with reference to flowcharts shown in FIG. 31 through FIG. 33. In this regard, these flowcharts will be explained with reference to the block diagrams of FIG. 27 through FIG. 30 (the same can be said in the processing during the printing operations below). FIG. 31 is a flowchart showing the detection timing of an ejection failure during the flushing operation by the ink jet printer 1 shown in FIG. 27.

When the flushing process of the ink jet printer 1 is carried out at the predetermined timing, the ejection failure detection and judgment processing shown in FIG. 31 is carried out. The control section 6 inputs ejection data for one nozzle 110 into the shift register 182*a* of the ejection selecting means 182 (Step S401), the latch signal is inputted into the latch circuit 182*b* (Step S402), whereby the ejection data is latched therein. At this time, the switching means 23 connects the electrostatic actuator 120 of the ink jet head 100, the target of the ejection data, to the driving waveform generating means 181 (Step S403).

Subsequently, the ejection failure detection and judgment processing shown in the flowchart of FIG. 24 is carried out for the ink jet head 100, which has carried out the ink ejection operation, by the ejection failure detecting means 10 (Step S404). At Step S405, the control section 6 judges whether or not the ejection failure detection and judgment processing has been completed for all the nozzles 110 of the ink jet heads 100*a* through 100*e* in the ink jet printer 1 shown in FIG. 27, on the basis of the ejection data outputted to the ejection selecting means 182. In the case where it is judged that the processing is not completed for all the nozzles 110, the control section 6 inputs the ejection data corresponding to the nozzle 110 of the following ink jet head 100 into the shift register 182*a* (Step S406). The control section 6 then returns to Step S402 and repeats the processing in the same manner.

On the other hand, in the case where it is judged at Step S405 that the ejection failure detection and judgment processing described above is completed for all the nozzles 110, the control section 6 releases the latch circuit 182*b* from the latch state by inputting a CLEAR signal into the latch circuit 182*b* (Step S407), and ends (terminates) the ejection failure detection and judgment processing in the ink jet printer 1 shown in FIG. 27.

As described above, because the detection circuit is constructed from one ejection failure detecting means 10 and one switching means 23 for the ejection failure detection and judgment processing in the printer 1 shown in FIG. 27, the ejection failure detection and judgment processing is repeated as many times as the number of the ink jet heads 100; however, there is an advantage that the circuit forming the ejection failure detecting means 10 is increased little in size.

Figure 32:
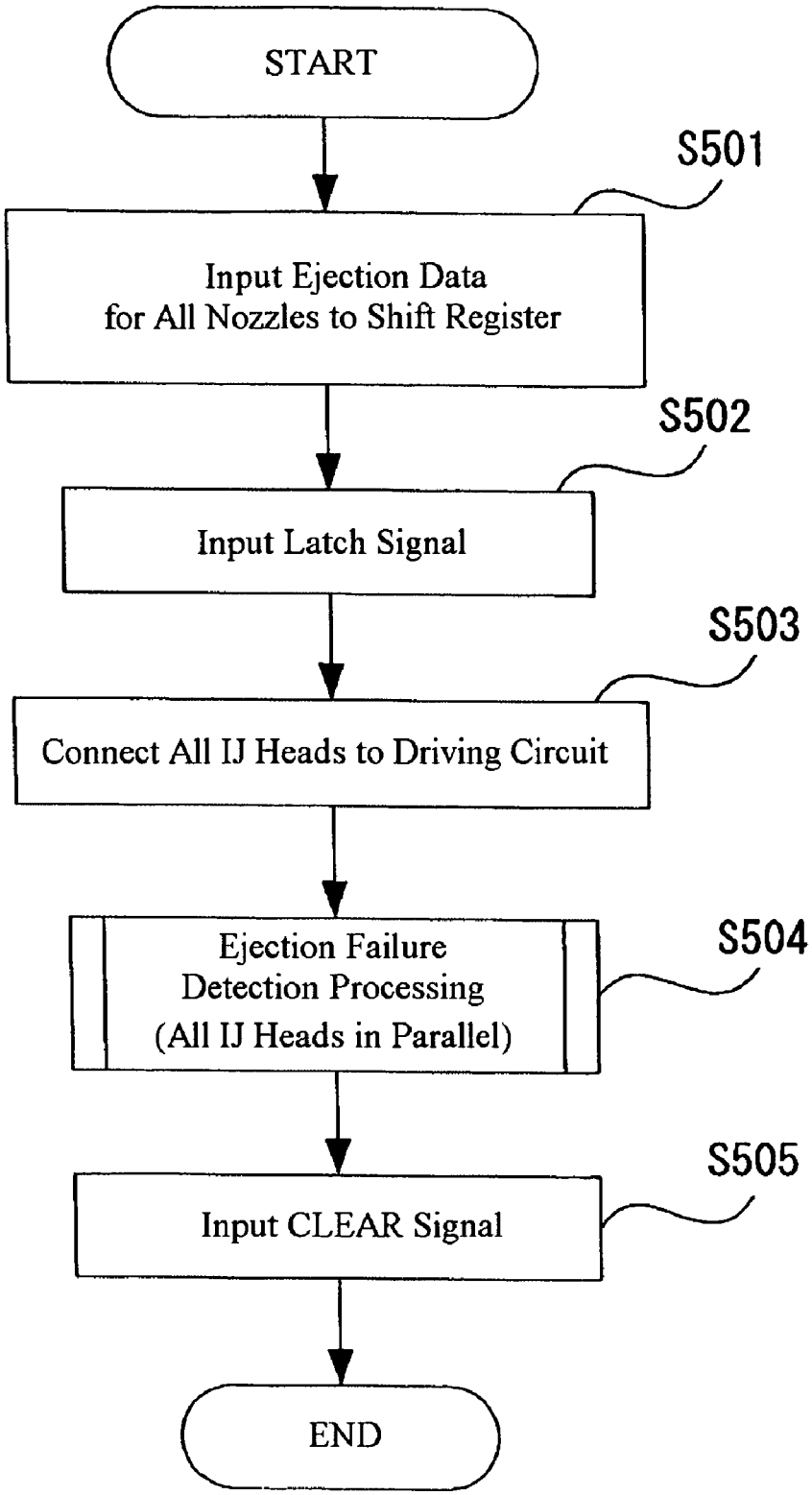
FIG. 32 is a flowchart showing the detection timing of an ejection failure during a flushing operation by the ink jet printers shown in FIGS. 28 and 29.

FIG. 32 is a flowchart showing the detection timing of an ejection failure during the flushing operation by the ink jet printers 1 shown in FIGS. 28 and 29. The ink jet printer 1 shown in FIG. 28 and the ink jet printer 1 shown in FIG. 29 are slightly different in terms of the circuitry, but the same in the point that the number of ejection failure detecting means 10 and the number of switching means 23 correspond with (are equal to) the number of ink jet heads 100. For this reason, the ejection failure detection and judgment processing during the flushing operation comprises the same steps.

When the flushing process of the ink jet printer 1 is carried out at the predetermined timing, the control section 6 inputs ejection data for all the nozzles 110 into the shift register 182*a* of the ejection selecting means 182 (Step S501), then the latch signal is inputted into the latch circuit 182*b* (Step S502), whereby the ejection data is latched therein. At this time, the switching means 23*a* through 23*e* connect all the ink jet heads 100*a* through 100*e* to the driving waveform generating means 181, respectively (Step S503).

Subsequently, the ejection failure detection and judgment processing shown in the flowchart of FIG. 24 is carried out in parallel for all the ink jet heads 100, which have carried out the ink ejection operation, by the ejection failure detecting means 10*a* through 10*e* corresponding to the respective ink jet heads 100*a* through 100*e* (Step S504). In this case, the judgment results corresponding to all the ink jet heads 100*a* through 100*e* are correlated with the ink jet heads 100 as the targets of the processing, and stored into the predetermined storage region of the storage means 62 (Step S107 of FIG. 24).

In order to clear the ejection data latched in the latch circuit 182*b* of the ejection selecting means 182, the control section 6 releases the latch circuit 182*b* from the latch state by inputting a CLEAR signal into the latch circuit 182*b* (Step S505), and ends (terminates) the ejection failure detection and judgment processing in the ink jet printers 1 shown in FIGS. 28 and 29.

As described above, because the detection and judgment circuit is constructed from a plurality of (five, in this embodiment) ejection failure detecting means 10 and a plurality of switching means 23 corresponding to the ink jet heads 100*a* through 100*e* in the processing in the printers 1 shown in FIGS. 28 and 29, there is an advantage that the ejection failure detection and judgment processing can be carried out in a short time for all the nozzles 110 at a time.

Figure 33:
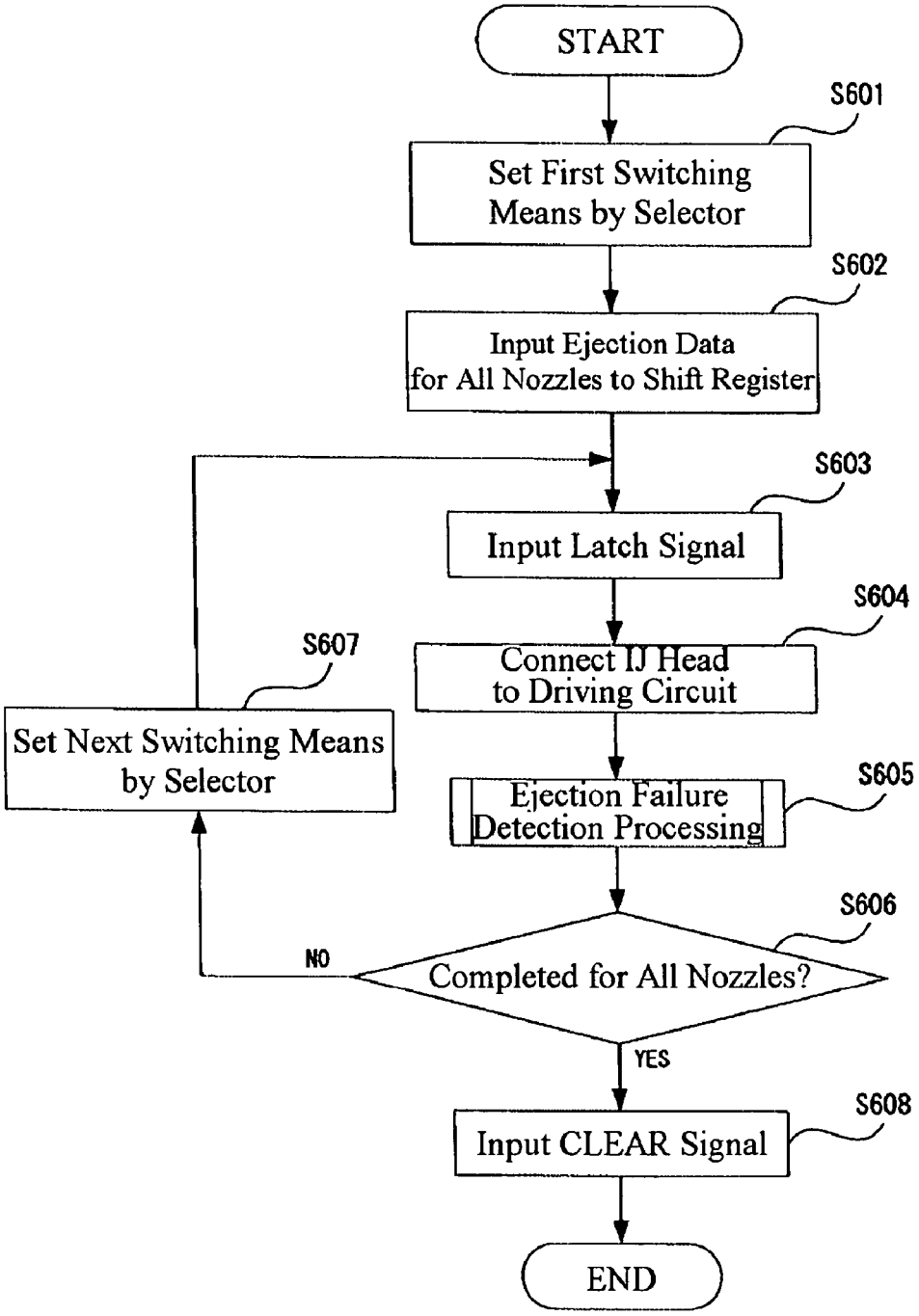
FIG. 33 is a flowchart showing the detection timing of an ejection failure during a flushing operation by the ink jet printer shown in FIG. 30.

FIG. 33 is a flowchart showing the detection timing of an ejection failure during the flushing operation by the ink jet printer 1 shown in FIG. 30. The ejection failure detection processing and the cause judgment processing during the flushing operation will now be described with the use of the circuitry of the ink jet printer 1 shown in FIG. 30.

When the flushing process in the ink jet printer 1 is carried out at the predetermined timing, the control section 6 first outputs a scanning signal to the switching selecting means (selector) 19*a*, and sets (identifies) first switching means 23*a* and ink jet head 100*a* by the switching selecting means 19*a* and the switching control means 19 (Step S601). The control section 6 then inputs ejection data for all the nozzles 110 into the shift register 182*a* of the ejection selecting means 182 (Step S602), and the latch signal is inputted into the latch circuit 182*b* (Step S603), whereby the ejection data is latched. At this time, the switching means 23*a* connects the electrostatic actuator 120 of the ink jet head 100*a* to the driving waveform generating means 181 (Step S604).

Subsequently, the ejection failure detection and judgment processing shown in the flowchart of FIG. 24 is carried out for the ink jet head 100*a* that has carried out the ink ejection operation (Step S605). In this case, the driving/detection switching signal as the output signal from the switching selecting means 19*a* and the ejection data outputted from the latch circuit 182*b* are inputted into the AND circuit ANDa, and the output signal from the AND circuit ANDa shifts to the high level at Step S103 of FIG. 24, whereby the switching means 23*a* connects the electrostatic actuator 120 of the ink jet head 100*a* to the ejection failure detecting means 10. The judgment result in the ejection failure judgment processing carried out at Step S106 of FIG. 24 is correlated with the ink jet head 100 as the target of processing (herein, the ink jet head 100*a*), and is stored in the predetermined storage region of the storage means 62 (Step S107 of FIG. 24).

At Step S606, the control section 6 judges whether or not the ejection failure detection and judgment processing has been completed for all the nozzles 110. In the case where it is judged that the ejection failure detection and judgment processing is not completed for all the nozzles 110, the control section 6 outputs a scanning signal to the switching selecting means (selector) 19*a*, and sets (identifies) the following switching means 23*b* and ink jet head 100*b* by the switching selecting means 19*a* and the switching control means 19 (Step S607). The control sections 6 then returns to Step S603 and repeats the processing in the same manner. Thereafter, this loop is repeated until the ejection failure detection and judgment processing is completed for all the ink jet heads 100.

On the other hand, in the case where it is judged at Step S606 that the ejection failure detection and judgment processing is completed for all the nozzles 110, the control section 6 releases the latch circuit 182*b* from the latch state by inputting a CLEAR signal into the latch circuit 182*b* (Step S609) in order to clear the ejection data latched in the latch circuit 182*b* of the ejection selecting means 182 (Step S608), and ends (terminates) the ejection failure detection and judgment processing in the ink jet printer 1 shown in FIG. 30.

As described above, according to the processing in the ink jet printer 1 shown in FIG. 30, the detection circuit is constructed from a plurality of switching means 23 and one ejection failure detecting means 10, and the ejection failure of the corresponding ink jet head 100 is detected and the cause thereof is judged by allowing only the switching means 23, identified by the scanning signal from the switching selecting means (selector) 19*a* and corresponding to the ink jet head 100 to carry out ejection driving operation in response to the ejection data, to carry out the switching operation. Therefore, it is possible to detect an ejection failure of the ink jet head 100 and to judge the cause thereof more efficiently.

In this regard, at Step S602 of this flowchart, the ejection data corresponding to all the nozzles 110 is inputted into the shift register 182*b*. However, as in the flowchart shown in FIG. 31, the ejection failure detection and judgment processing may be carried out for the nozzles 110 one by one by inputting the ejection data to be inputted into the shift register 182*a* into one corresponding ink jet head 100 in the scanning order of the ink jet heads 100 by the switching selecting means 19*a*.

Next, the ejection failure detection and judgment processing in the ink jet printer 1 during the printing operation will now be described with reference to the flowcharts shown in FIGS. 34 and 35. Because the ink jet printer 1 shown in FIG. 27 is chiefly suitable for the ejection failure detection and judgment processing during the flushing operation, the description of the flowchart and the operation thereof during the printing operation is omitted. However, the ejection failure detection and judgment processing may be carried out during the printing operation as well in the ink jet printer 1 shown in FIG. 27.

Figure 34:
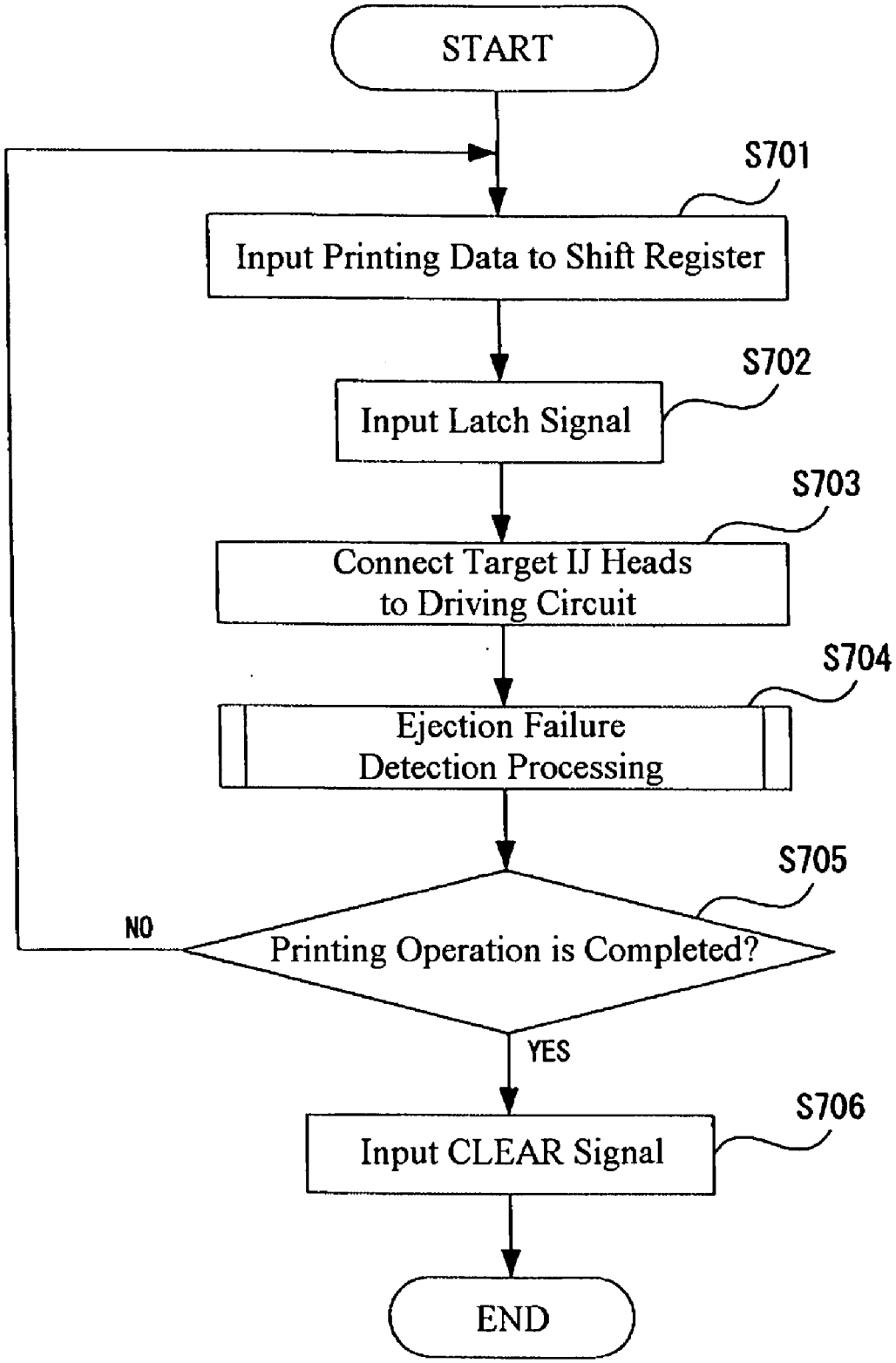
FIG. 34 is a flowchart showing the detection timing of an ejection failure during a printing operation by the ink jet printers shown in FIGS. 28 and 29.

FIG. 34 is a flowchart showing the detection timing of an ejection failure during the printing operation by the ink jet printers 1 shown in FIGS. 28 and 29. The processing according to this flowchart is carried out (started) in response to a printing (print) command from the host computer 8. When the printing data is inputted to the shift register 182*a* of the ejection selecting means 182 from the host computer 8 via the control section 6 (Step S701), the latch signal is inputted into the latch circuit 182*b* (Step S702), whereby the printing data is latched therein. At this time, the switching means 23*a* through 23*e* connect all the ink jet heads 100*a* through 100*e* to the driving waveform generating means 181 (Step S703).

The ejection failure detecting means 10 corresponding to the ink jet heads 100 that have carried out the ink ejection operation then carry out the ejection failure detection and judgment processing shown in the flowchart of FIG. 24 (Step S704). In this case, the judgment results corresponding to the ink jet heads 100 are respectively correlated with the ink jet heads 100 as the targets of processing, and stored in the predetermined storage region of the storage means 62.

Here, in the case of the ink jet printer 1 shown in FIG. 28, the switching means 23*a* through 23*e* respectively connect the ink jet heads 100*a* through 100*e* to the ejection failure detecting means 10*a* through 10*e* according to the driving/detection switching signal outputted from the control section 6 (Step S103 of FIG. 24). Hence, because the electrostatic actuator 120 is not driven in the ink jet head 100 in which the printing data is absent, the residual vibration detecting means 16 of the ejection failure detecting means 10 does not detect the residual vibration waveform of the diaphragm 121. On the other hand, in the case of the ink jet printer 1 shown in FIG. 29, the switching means 23*a* through 23*e* connect the ink jet head 100 in which the printing data is present to the corresponding ejection failure detecting means 10 according to the output signal from the AND circuit into which the driving/detection switching signal outputted from the control section 6 and the printing data outputted from the latch circuit 182*b* are inputted (Step S103 of FIG. 24).

At Step S705, the control section 6 judges whether or not the printing operation by the ink jet printer 1 has been completed. In the case where it is judged that the printing operation is not completed, the control section 6 returns to Step S701, and inputs the following printing data into the shift register 182*a* to repeat the processing in the same manner. On the other hand, in the case where it is judged that the printing operation is completed, the control section 6 releases the latch circuit 182*b* from the latch state by inputting a CLEAR signal into the latch circuit 182*b* in order to clear the ejection data latched in the latch circuit 182*b* of the ejection selecting means 182 (Step S706), and ends (terminates) the ejection failure detection and judgment processing in the ink jet printers 1 shown in FIGS. 28 and 29.

As described above, the ink jet printers 1 shown in FIGS. 28 and 29 are provided with a plurality of switching means 23*a* through 23*e* and a plurality of ejection failure detecting means 10*a* through 10*e* so that the ejection failure detection and judgment processing is carried out for all the ink jet heads 100 at a time. Hence, it is possible to carry out the processing in a short time. Also, the ink jet printer 1 shown in FIG. 29 is further provided with the switching control means 19, that is, the AND circuits ANDa through ANDe executing the logical operation AND of the driving/detection switching signal and the printing data so that the switching operation is carried out by the switching means 23 for only the ink jet head 100 that will carry out the printing operation. Hence, it is possible to carry out the ejection failure detection and judgment processing without carrying out useless detection.

Figure 35:
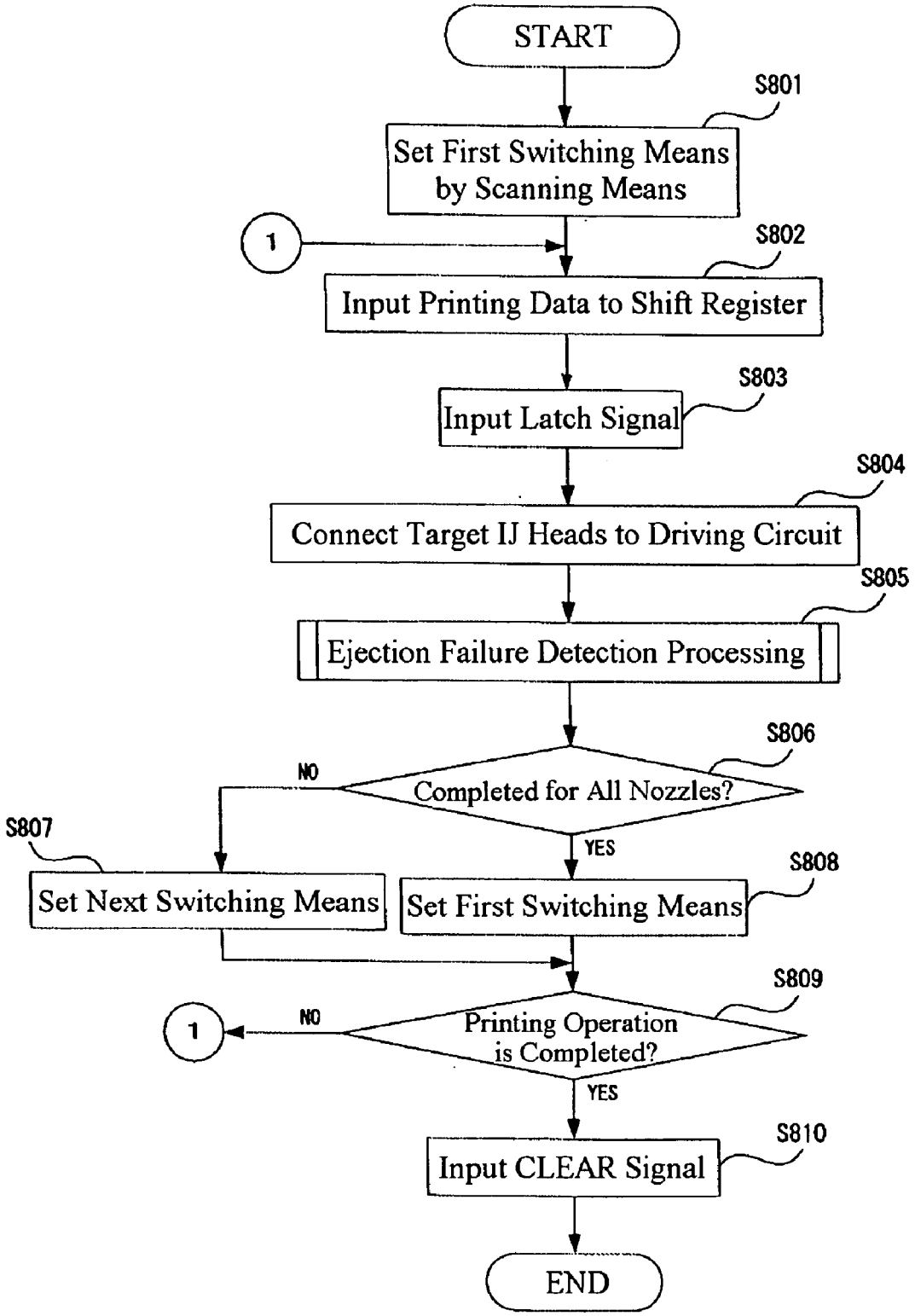
FIG. 35 is a flowchart showing the detection timing of an ejection failure during a printing operation by the ink jet printer shown in FIG. 30.

FIG. 35 is a flowchart showing the detection timing of an ejection failure during the printing operation by the ink jet printer 1 shown in FIG. 30. The processing according to this flowchart is carried out by the ink jet printer 1 shown in FIG. 30 in response to a printing command from the host computer 8. The switching selecting means 19*a* sets (identifies) in advance first switching means 23*a* and ink jet head 100*a* (Step S801).

When the printing data is inputted into the shift register 182*a* of the ejection selecting means 182 from the host computer 8 via the control section 6 (Step S802), the latch signal is inputted into the latch circuit 182*b* (Step S803), whereby the printing data is latched. At this stage, the switching means 23*a* through 23*e* connect all the ink jet heads 100*a* through 100*e* to the driving waveform generating means 181 (the driver 182*c* of the ejection selecting means 182) (Step S804).

In the case where the printing data is present in the ink jet head 100*a*, the control section 6 controls the switching selecting means 19*a* to connect the electrostatic actuator 120 to the ejection failure detecting means 10 after the ejection operation (Step S103 of FIG. 24), and carries out the ejection failure detection and judgment processing shown in the flowchart of FIG. 24 (and FIG. 25) (Step S805). The judgment result in the ejection failure judgment processing carried out at Step S106 of FIG. 24 is correlated with the ink jet head 100 as the target of processing (herein, the ink jet head 100*a*), and is stored in the predetermined storage region of the storage means 62 (Step S107 of FIG. 24).

At Step S806, the control section 6 judges whether or not the ejection failure detection and judgment processing described above has been completed for all the nozzles 110 (all the ink jet heads 100). In the case where it is judged that the above processing is completed for all the nozzles 110, the control section 6 sets the switching means 23*a* corresponding to the first nozzle 110 in response to the scanning signal (Step S808). On the other hand, in the case where it is judged that the above processing is not completed for all the nozzles 110, the control section 6 sets the switching means 23*b* corresponding to the following nozzle 110 (Step S807).

At Step S809, the control section 6 judges whether or not the predetermined printing operation specified by the host computer 8 has been completed. In the case where it is judged that the printing operation is not completed, the control section 6 inputs the following printing data into the shift register 182*a* (Step S802), and repeats the processing in the same manner. On the other hand, in the case where it is judged that the printing operation is completed, the control section 6 releases the latch circuit 182*b* from the latch state by inputting a CLEAR signal into the latch circuit 182*b* in order to clear the ejection data latched in the latch circuit 182*b* of the ejection selecting means 182 (Step S810), and ends (terminates) the ejection failure detection and judgment processing in the ink jet printer 1 shown in FIG. 30.

As described above, the droplet ejection apparatus (ink jet printer 1) of the invention is provided with a plurality of ink jet heads (droplet ejection heads) 100 each having the diaphragm 121, the plurality of electrostatic actuators 120 for displacing each of the diaphragms 121, the cavity 141 filled with liquid and whose internal pressure varies (increases or decreases) with the displacement of the diaphragm 121, and the nozzle 110 communicating with the cavity 141 and through which the liquid within the cavity 141 is ejected in the form of droplets due to a change (increase and decrease) in internal pressure of the cavity 141. The apparatus is further provided with the driving waveform generating means 181 for driving the electrostatic actuators 120, the ejection selecting means 182 for selecting one or more nozzle 110 out of a plurality of nozzles 110 from which the droplets are to be ejected, one or more ejection failure detecting means 10 for detecting the residual vibration of the diaphragm 121 and detecting an ejection failure of the droplets on the basis of the residual vibration of the diaphragm 121 thus detected, and one or more switching means 23 for switching the connection of the electrostatic actuator 120 to the ejection failure detecting means 10 from the driving waveform generating means 181 in response to the driving/detection switching signal or on the basis of the driving/detection switching signal and the printing data, or the scanning signal in addition to these after the ejection operation of the droplets by driving the electrostatic actuator 120. Hence, an ejection failure of a plurality of nozzles 110 can be detected either at a time (in parallel) or sequentially.

Therefore, according to the droplet ejection apparatus and the method of detecting and judging an ejection failure in the droplet ejection heads of the invention, an ejection failure can be detected and the cause thereof can be judged in a short time. Further, it is possible to scale down the circuitry of the detection circuit including the ejection failure detecting means 10, and to prevent an increase of the manufacturing costs of the droplet ejection apparatus. Furthermore, because the detection of an ejection failure and the judgment of the cause thereof is carried out by switching to the ejection failure detecting means 10 after the electrostatic actuators 120 are driven, the driving of the actuators is not influenced at all, and therefore the throughput of the droplet ejection apparatus of the invention will be neither reduced nor deteriorated. Moreover, it is possible to provide the ejection failure detecting means 10 of the invention to an existing droplet ejection apparatus (such as ink jet printer) provided with predetermined components.

In contrast to the configuration described above, another droplet ejection apparatus of the invention is provided with a plurality of switching means 23, the switching control means 19, and one or a plurality of (i.e., as many as the number of nozzles 110) ejection failure detecting means 10. The detection of an ejection failure and the judgment of the cause thereof is carried out by switching the corresponding electrostatic actuator 120 from the driving waveform generating means 181 or the ejection selecting means 182 to the ejection failure detecting means 10 in response to the driving/detection switching signal and the ejection data (printing data) or to the scanning signal, the driving/detection switching signal and the ejection data (printing data).

Therefore, the switching means 23 corresponding to the electrostatic actuator 120 into which the ejection data (printing data) has not been inputted, that is, the one that has not carried out the ejection driving operation, do not carry out the switching operation. The droplet ejection apparatus of the invention is thus able to avoid useless detection and judgment processing. Further, in the case of using the switching selecting means 19*a*, because the droplet ejection apparatus has to be provided with only one ejection failure detecting means 10, it is possible to scale down the circuitry of the droplet ejection apparatus, and to prevent an increase of the manufacturing costs of the droplet ejection apparatus.

In this regard, in the first embodiment of the invention, the structure in which the ink jet printers 1 shown in FIGS. 27 through 30 to explain the timing of the detection of the ejection failure includes five ink jet heads 100 (i.e., five nozzles 110) on the head unit 35 is shown and described for ease of explanation. However, in the droplet ejection apparatus of the invention, the number of ink jet heads (droplet ejection heads) 100 is not limited to five. It is possible to detect and judge an ejection failure for all nozzles 110 actually mounted (provided) on the head unit 35.

Figure 36:
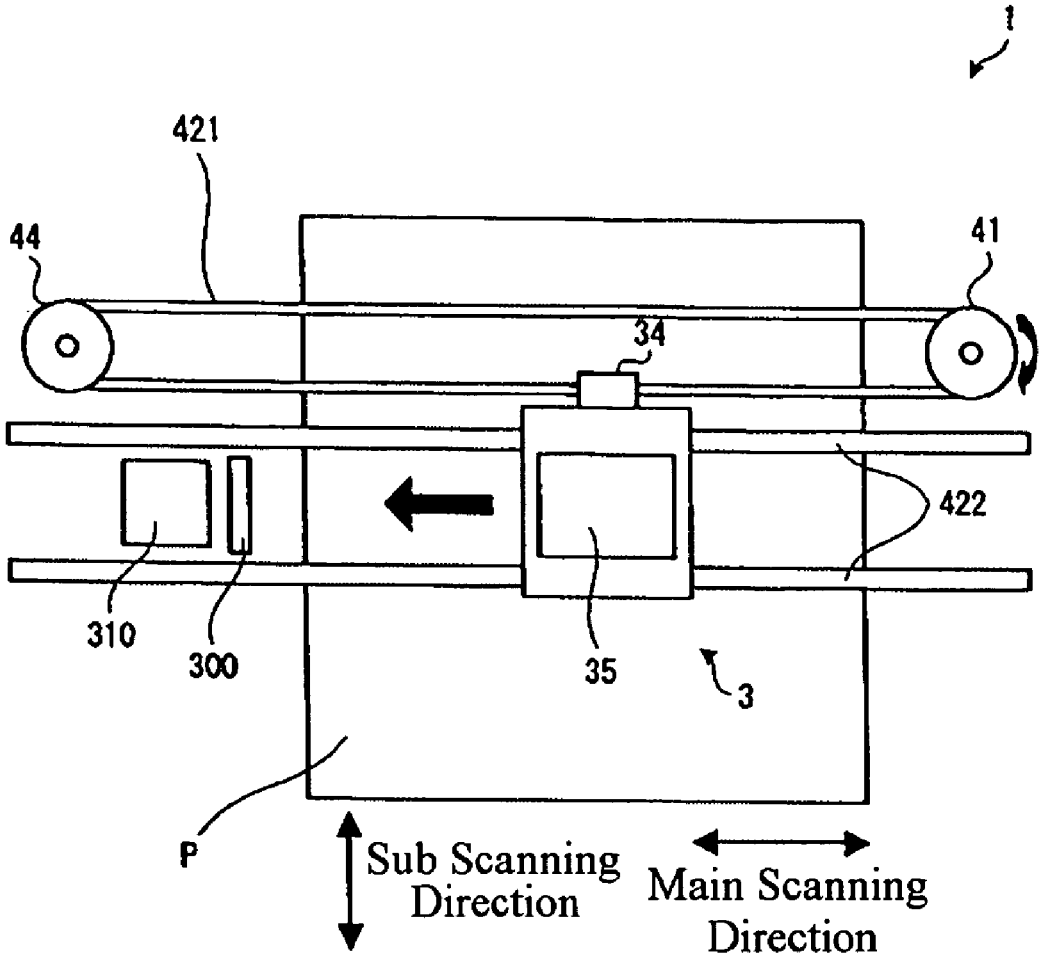
FIG. 36 is a drawing schematically showing the structure (part of which is omitted) when viewed from the top of the ink jet printer shown in FIG. 1.

Next, the configuration (recovery means 24) to carry out recovery processing by which the cause of an ejection failure (head failure) is eliminated for the ink jet head 100 (head unit 35) in the droplet ejection apparatus of the invention will now be described. FIG. 36 is a drawing schematically showing the structure (part of which is omitted) when viewed from the top of the ink jet printer 1 shown in FIG. 1. The ink jet printer 1 shown in FIG. 36 is provided with a wiper 300 and a cap 310 used to carry out the recovery processing of ink droplet non-ejection (head failure) in addition to the configuration shown in the perspective view of FIG. 1.

The recovery processing carried out by the recovery means 24 of the invention includes the flushing process by which droplets are preliminarily ejected through the nozzles 110 of the respective ink jet heads 100, the wiping process by the wiper 300 described below (see FIG. 37), and a pumping process (pump-suction process) by a tube pump 320 described below. In other words, the recovery means 24 is provided with the tube pump 320, a pulse motor for driving the same, the wiper 300 and a vertical driving mechanism of the wiper 300, and a vertical driving mechanism (not shown) of the cap 310. The head driver 33, the head unit 35 and the like in the flushing process, and the carriage motor 41 and the like in the wiping process function as part of the recovery means 24. Because the flushing process is already described above, the wiping process and the pumping process will be described below.

The wiping process referred to herein is defined as the process by which foreign substances such as paper dust adhering to the nozzle plate 150 (nozzle surface) of the head unit 35 (ink jet heads 100) is wiped out with the wiper 300. The pumping process (pump-suction process) referred to herein is defined as process by which ink inside the cavities 141 is sucked (removed by a vacuum) and discharged through the respective nozzles 110 of the head unit 35 (ink jet heads 100) by driving the tube pump 320 described below. Thus, the wiping process is appropriate process as the recovery processing for a state of adhesion of paper dust, which is one of the causes of an ejection failure of droplets of the ink jet head 100 as described above. Further, the pump-suction process is appropriate process as the recovery processing for eliminating air bubbles inside the cavities 141 which cannot be eliminated by the flushing process described above, or for eliminating thickened ink when ink has thickened due to drying in the vicinity of the nozzles 110 or when ink inside the cavities 141 has thickened by aged deterioration. In this regard, the recovery processing may be carried out by the flushing process described above in the case where ink has thickened slightly and the viscosity thereof is not noticeably high. In this case, because a quantity of ink to be discharged is small, appropriate recovery processing can be carried out without deteriorating the throughput or the running costs.

A plurality of head units 35 each including a plurality of ink jet heads 100 are mounted on the carriage 32, guided by the two carriage guide shafts 422, and moved by the carriage motor 41 as it is coupled to the timing belt 421 via a coupling portion 34 provided at the top edge of the printing means 3 in the drawing. The head units 35 mounted on the carriage 32 can be moved in the main scanning direction via the timing belt 421 (i.e., in conjunction with the timing belt 421) that moves when driven by the carriage motor 41. The carriage motor 41 serves as a pulley for continuously turning the timing belt 421, and a pulley 44 is provided at the other end as well.

The cap 310 is used to carry out capping the nozzle plate 150 of the head unit 35 (ink jet heads 100) (see FIG. 5). The cap 310 is provided with a hole on the side surface of the bottom portion, and as will be described below, a flexible tube 321, one component of the tube pump 320, is connected to the bottom portion of the cap 310. In this regard, the tube pump 320 will be described below with reference to FIG. 39.

During the recording (printing) operation, a recording sheet P moves in the sub scanning direction, that is, downward in FIG. 36, and the printing means 3 moves in the main scanning direction, that is, the horizontal direction in FIG. 36 while the electrostatic actuators 120 of the predetermined ink jet heads 100 (droplet ejection heads) are being driven, so that the ink jet printer (droplet ejection apparatus) 1 prints (records) a predetermined image or the like on the recording sheet P on the basis of the printing data (print data) inputted from the host computer 8.

Figure 37:
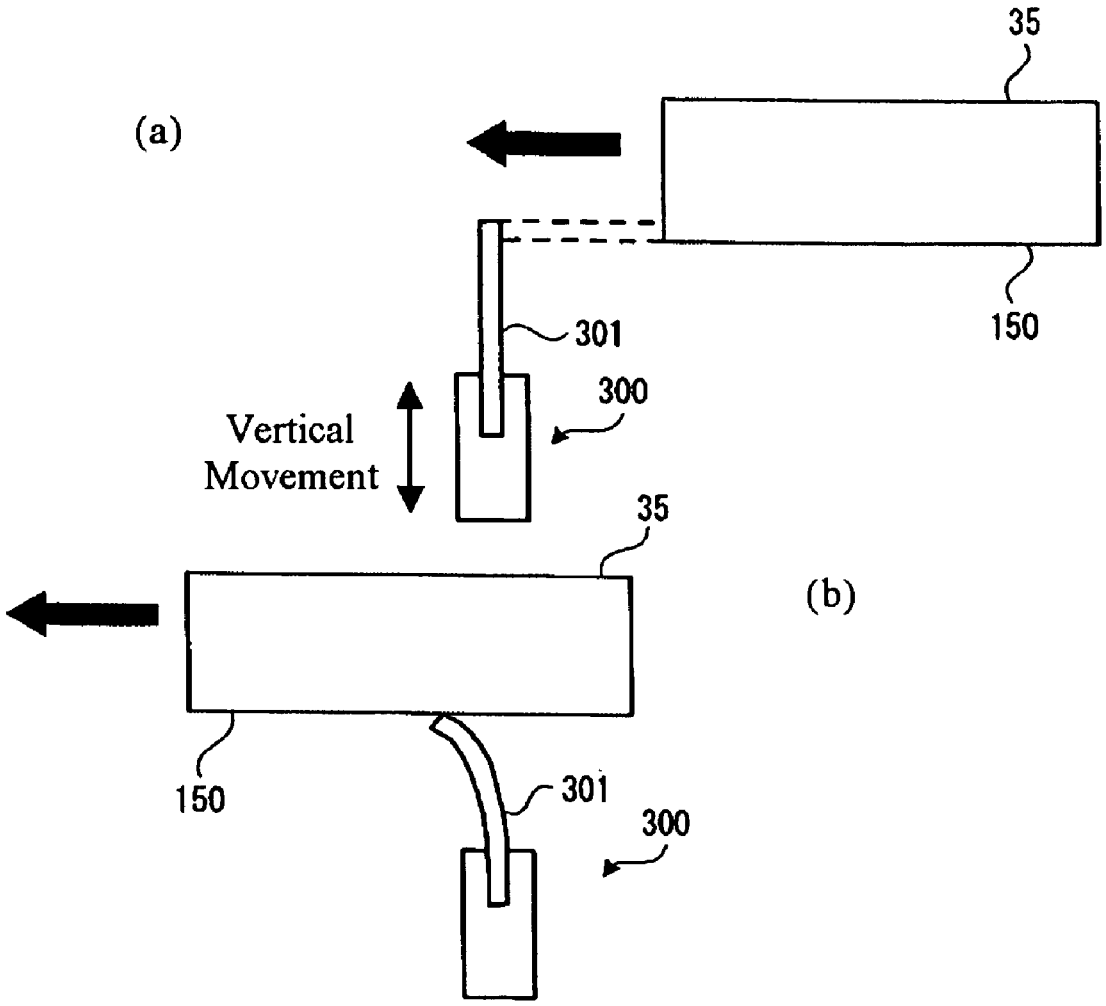
FIG. 37 is a drawing showing the positional relationship between a wiper and head unit shown in FIG. 36.

FIG. 37 is a drawing showing the positional relationship between the wiper 300 and the printing means 3 (head unit 35) shown in FIG. 36. Referring to FIG. 37, the printing means 3 (head unit 35) and the wiper 300 are shown as part of the side view of the ink jet printer 1 shown in FIG. 36 when viewed from bottom to top in the drawing. As shown in FIG. 37(*a*), the wiper 300 is vertically-movably provided so as to be able to abut on the nozzle surface of the head unit 35, that is, the nozzle plate 150 of the ink jet heads 100.

Here, the wiping process as the recovery processing using the wiper 300 will now be described. When the wiping process is carried out, as shown in FIG. 37(*a*), the wiper 300 is moved upward by a driving device (not shown) so that the tip end of the wiper 300 is positioned above the nozzle surface (nozzle plate 150). In this case, when the printing means 3 (head unit 35) is moved to the left of the drawing (in a direction indicated by an arrow) by driving the carriage motor 41, a wiping member 301 abuts on the nozzle plate 150 (nozzle surface).

Because the wiping member 301 is formed from a flexible rubber member or the like, as shown in FIG. 37(*b*), the tip end portion of the wiping member 301 abutting on the nozzle plate 150 is bent, and the wiping member 301 thereby cleans (wipes out) the surface of the nozzle plate 150 (nozzle surface) by the tip end portion thereof. This makes it possible to remove foreign substances, such as paper dust (for example, paper dust, dust afloat in air, pieces of rubber), adhering to the nozzle plate 150 (nozzle surface). Further, the wiping process may be carried out more than once depending on the adhesion state of such foreign substances (i.e., in the case where a large quantity of foreign substances are adhering thereto) by allowing the printing means 3 to reciprocate above the wiper 300.

Figure 38:
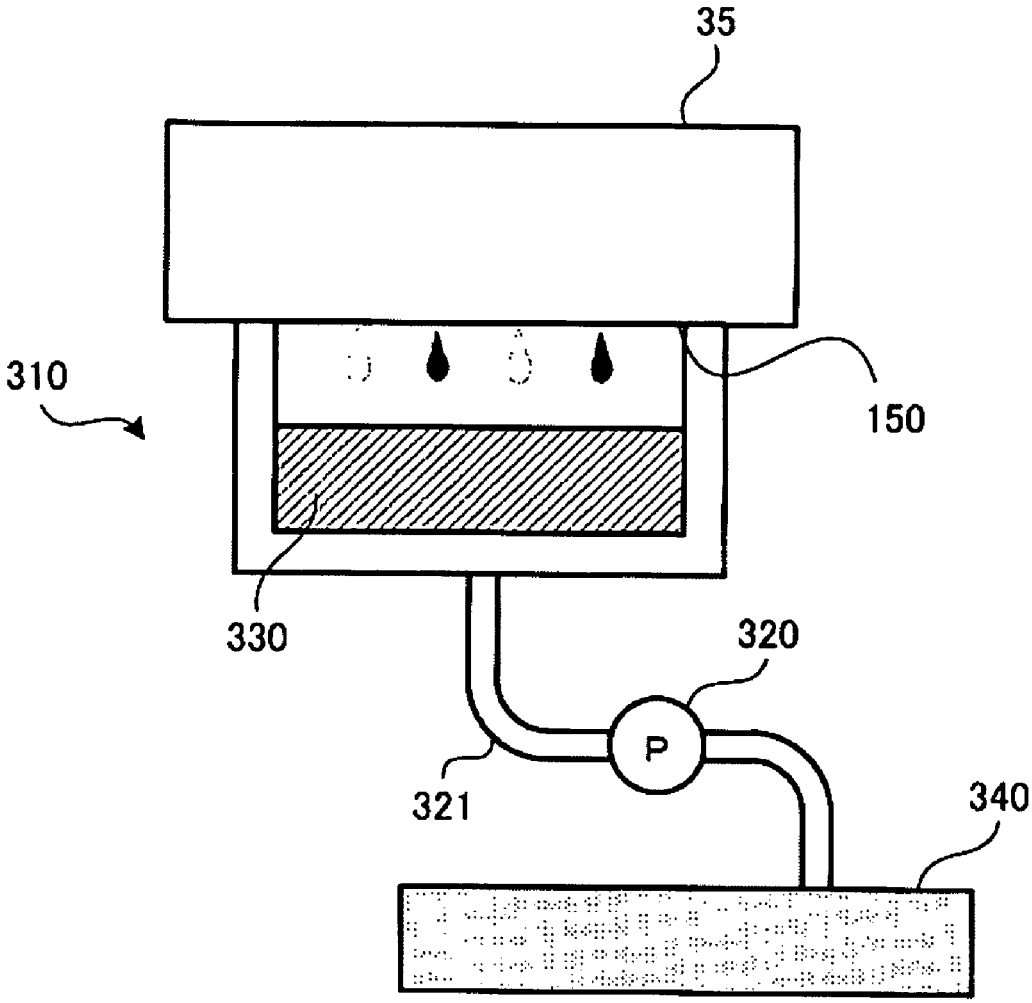
FIG. 38 is a drawing showing the relationship between the head unit (ink jet heads), a cap and a pump during a pump-suction process.

FIG. 38 is a drawing showing the relationship between the head unit 35 (ink jet heads 100), the cap 310 and the pump 320 during the pump-suction process. The tube 321 forms an ink discharge path used in the pumping process (pump-suction process), and one end thereof is connected to the bottom portion of the cap 310 as described above, and the other end thereof is connected to a discharged ink cartridge 340 via the tube pump 320.

An ink absorber 330 is placed on the inner bottom surface of the cap 310. The ink absorber 330 absorbs and temporarily preserves ink ejected through the nozzles 110 of the ink jet heads 100 during the pump-suction process or the flushing process. The ink absorber 330 prevents ejected droplets from splashing back and thereby smearing the nozzle plate 150 during the flushing operation into the cap 310.

Figure 39:
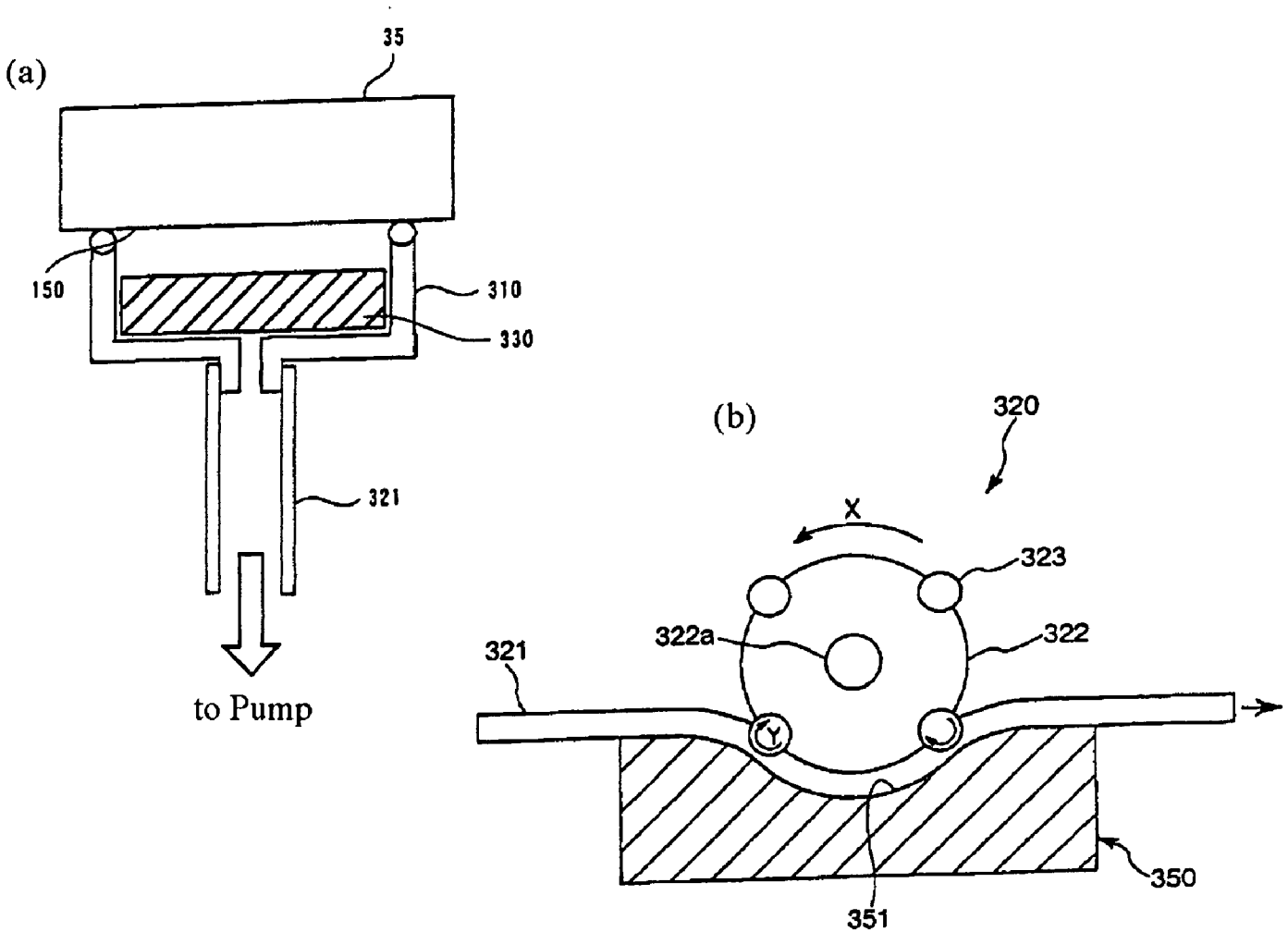
FIG. 39 is a schematic view showing the configuration of a tube pump shown in FIG. 38.

FIG. 39 is a schematic view showing the configuration of the tube pump 320 shown in FIG. 38. As shown in FIG. 39(*b*), the tube pump 320 is a rotary pump, and is provided with a rotor 322, four rollers 323 placed to the circumferential portion of the rotor 322, and a guiding member 350. The rollers 323 are supported by the rotor 322, and apply a pressure to the flexible tube 321 placed arc-wise along a guide 351 of the guiding member 350.

In this tube pump 320, the rotor 322 is rotated with the shaft 322*a* as the center thereof in a direction indicated by an arrow X of FIG. 39, which allows one or two rollers 323 abutting on the tube 321 to sequentially apply pressure to the tube 321 placed on the arc-shaped guide 351 of the guiding member 350 while rotating in the Y direction. The tube 321 thereby undergoes deformation, and ink (liquid material) within the cavities 141 of the respective ink jet heads 100 is sucked via the cap 310 due to a negative pressure generated in the tube 321. Then, unwanted ink intruded with air bubbles or having thickened due to drying is discharged into the ink absorber 330 through the nozzles 110, and the discharged ink absorbed in the ink absorber 330 is then discharged to the discharged ink cartridge 340 (see FIG. 38) via the tube pump 320.

In this regard, the tube pump 320 is driven by a motor (not shown) such as a pulse motor. The pulse motor is controlled by the control section 6. A look-up table in which driving information as to the rotational control of the tube pump 320 (for example, the rotational speed, the number of rotations and the like), a control program written with sequence control, and the like are stored in the PROM 64 of the control section 6. The tube pump 320 is controlled by the CPU 61 of the control section 6 according to the driving information specified above.

Figure 40:
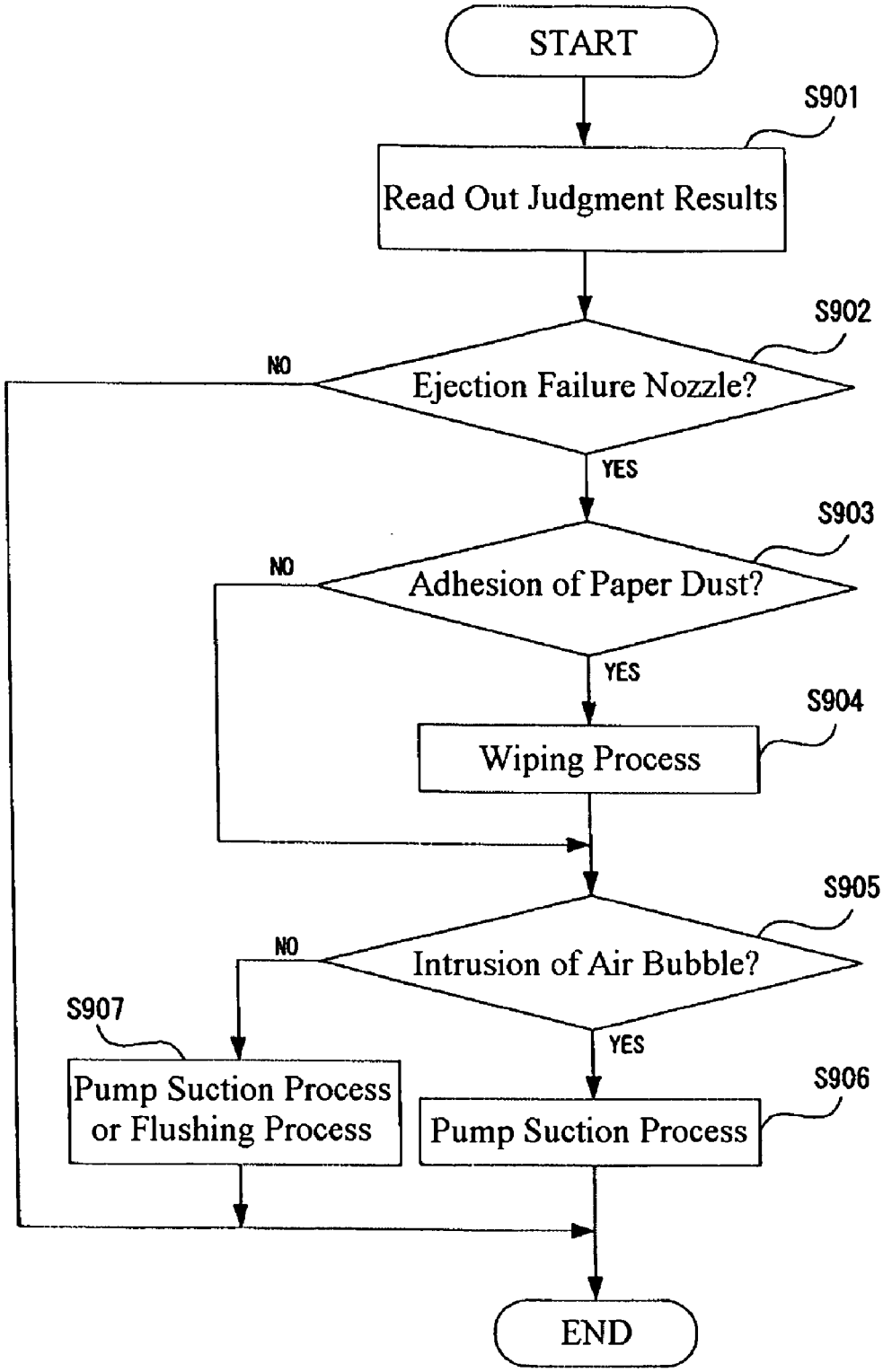
FIG. 40 is a flowchart showing ejection failure recovery processing in the ink jet printer of the invention.

Next, the operation of the recovery means 24 (ejection failure recovery processing) will now be described. FIG. 40 is a flowchart showing the ejection failure recovery processing in the ink jet printer 1 (droplet ejection apparatus) of the invention. When an ejection failure of the nozzle 110 is detected and the cause thereof is judged in the ejection failure detection and judgment processing described above (see the flowchart of FIG. 24), the printing means 3 is moved to the predetermined stand-by region (for example, in FIG. 36, a position at which the nozzle plate 150 of the printing means 3 (the head units 35) is covered with the cap 310 or a position at which the wiping process by the wiper 300 can be carried out) at the predetermined time while the printing operation (print operation) or the like is not carried out, and the ejection failure recovery processing is carried out.

The control section 6 first reads out the judgment results corresponding to the respective nozzles 110, which are stored in the EEPROM 62 of the control section 6 at Step S107 of FIG. 24 (Step S901). (It should be noted that the judgment results to be read out are not the judgment results whose contents are limited to the respective nozzles 110, but those for the respective ink jet heads 100. Hence, hereinafter, the nozzles 110 having an ejection failure also means the ink jet head 100 in which an ejection failure is occurring.) At Step S902, the control section 6 judges whether or not the judgment results thus read out include those for a nozzle 110 having an ejection failure. In the case where it is judged that the nozzle 110 having an ejection failure is absent, that is, in the case where droplets were ejected normally through all the nozzles 110, the control section 6 simply ends (terminates) the ejection failure recovery processing.

On the other hand, in the case where it is judged that a nozzle 110 having an ejection failure is present, the control section 6 further judges at Step S903 whether or not paper dust is adhering in the vicinity of the outlet of the nozzle 110 judged as having the ejection failure. In the case where it is judged that no paper dust is adhering in the vicinity of the outlet of the nozzle 110, the control section 6 proceeds to Step S905. In the case where it is judged that paper dust is adhering thereto, the recovery means 24 carries out the wiping process to the nozzle plate 150 by the wiper 300 as described above (Step S904).

At Step S905, the control section 6 subsequently judges whether or not an air bubble has intruded into the nozzle 110 judged as having the ejection failure. In the case where it is judged that an air bubble has intruded thereinto, the recovery means 24 carries out the pump-suction process by the tube pump 320 for all the nozzles 110 (Step S906), and ends (terminates) the ejection failure recovery processing. On the other hand, in the case where it is judged that an air bubble has not intruded thereinto, the recovery means 24 carries out the pump-suction process by the tube pump 320 for all the nozzles 110 or the flushing process for the nozzle 110 judged as having the ejection failure alone or for all the nozzles 110, on the basis of the length of the cycle of the residual vibration of the diaphragm 121 measured by the measuring means 17 (Step S907), and ends (terminates) the ejection failure recovery processing.

As described above, in the droplet ejection apparatus (ink jet printer 1) in the first embodiment of the invention and the method of recovering an ejection failure of the droplet ejection heads (ink jet heads 100), the apparatus includes: the ejection failure detecting means 10 for an ejection failure and a cause thereof in the plurality of droplet ejection heads (the plurality of ink jet heads 100 of the respective head units 35); and the recovery means 24 for carrying out the recovery processing in accordance with the cause of the ejection failure in the case where the ejection failure of the nozzle 110 in question was detected by the ejection failure detecting means 10 (for example, the tube pump 320 for the pump-suction process, the wiper 300 for the wiping process, and the like).

Therefore, according to the droplet ejection apparatus and the method of recovering the ejection failure of the invention, since appropriate recovery processing in response to the cause of the ejection failure (any one or two of the flushing process, the pump-suction process and the wiping process) can be carried out, it is possible to reduce useless ink discharged when the recovery processing is carried out in comparison with the sequential recovery processing in the conventional droplet ejection apparatus, and this makes it possible to prevent the throughput of the droplet ejection apparatus from being reduced or deteriorated.

Further, in the droplet ejection apparatus (ink jet printer 1) of the invention, the droplet ejection head (ink jet head 100) is provided with the diaphragm 121 displaced by the driving of the electrostatic actuator 120, and the ejection failure detecting means 10 detects an ejection failure of droplets on the basis of a vibration pattern of the residual vibration of the diaphragm 121 (for example, a cycle of the residual vibration) at a droplet ejection operation.

Therefore, according to the invention, compared with the conventional droplet ejection apparatus capable of detecting an ejection failure, the droplet ejection apparatus of this embodiment as described above does not need other parts (for example, optical missing dot detecting device or the like). As a result, not only an ejection failure of the droplets can be detected without increasing the size of the droplet ejection head, but also the manufacturing costs of the droplet ejection apparatus capable of carrying out an ejection failure (missing dot) detecting operation can be reduced. In addition, in the droplet ejection apparatus of the invention, because the droplet ejection apparatus of the invention detects an ejection failure of the droplets through the use of the residual vibration of the diaphragm after the droplet ejection operation, an ejection failure of the droplets can be detected even during the printing operation.

Further, the pump-suction process (this is one of the recovery processing that the recovery means 24 can carry out) is a process advantageous to the case of the thickening of ink due to drying or the like and the case of the intrusion of air bubble. Because the same recovery processing may be carried out in the case of the above-mentioned two causes, the pump-suction process may be carried out for the ink jet head 100 in which an air bubble has intruded and the ink jet head 100 in which ink has thickened due to drying at a time without determining the recovery processing separately as Steps S905 through S907 in the flowchart of FIG. 40 in the case where the ink jet head 100 in which an air bubble has intruded and the ink jet head 100 in which ink has thickened due to drying (for both of which the pump-suction process is required to eliminate the causes) are detected in the head unit 35. In other words, the pump-suction process may be carried out after judging whether or not paper dust is adhering to the vicinity of the nozzle 110 without judging whether the cause of the ejection failure is either the intrusion of the air bubble or the thickening due to drying. Moreover, the pump-suction process may be carried out for a predetermined region including the ink jet head 100 in which the ejection failure has occurred, or for all the head units 35 including the ink jet head 100 in which the ejection failure has occurred or the head unit 35 corresponding to the type of ink.

(Second Embodiment)

Examples of other configurations of the ink jet head of the invention will now be described. FIGS. 41–44 are cross sectional views each schematically showing an example of other configuration of the ink jet head (head unit). Hereinafter, an explanation will be given with reference to these drawings; however, differences from the first embodiment described above are chiefly described, and the description of the similar portions is omitted.

Figure 41:
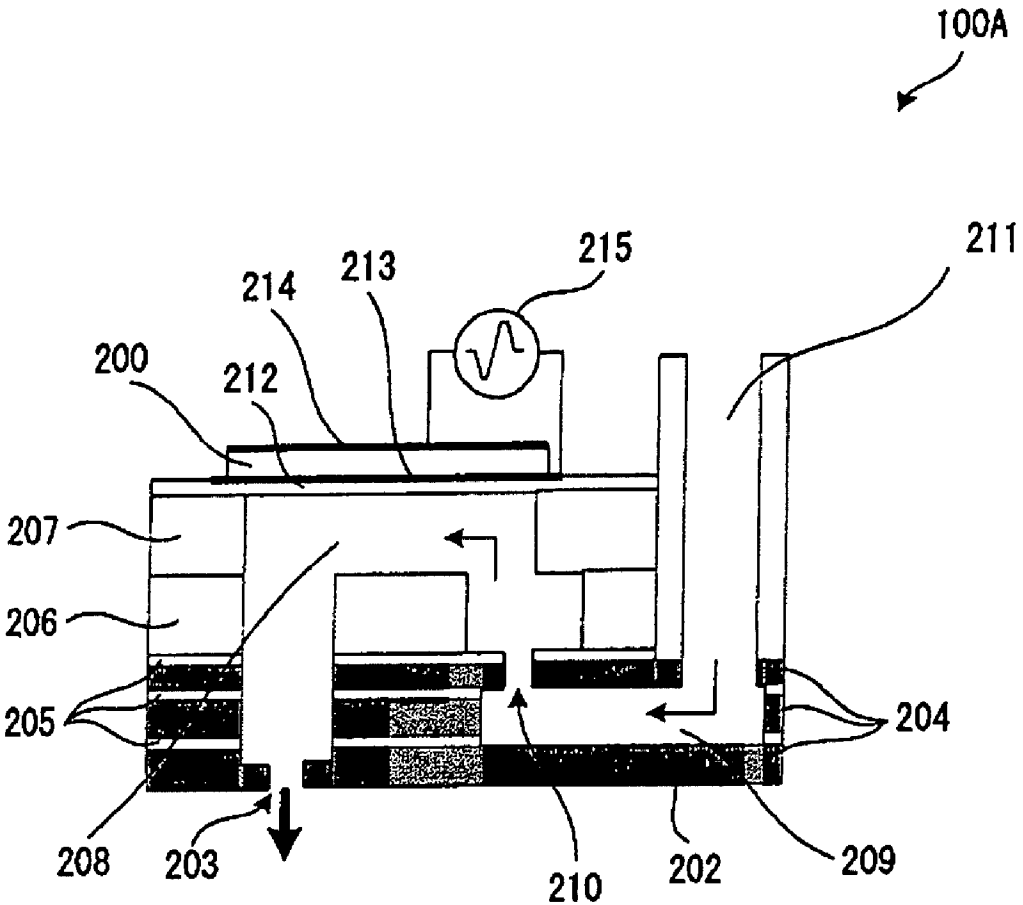
FIG. 41 is a cross sectional view schematically showing an example of another configuration of the ink jet head of the invention.

An ink jet head 100A shown in FIG. 41 is one that ejects ink (liquid material) within a cavity 208 through a nozzle 203 as a diaphragm 212 vibrates when a piezoelectric element 200 is driven. A metal plate 204 made of stainless steel is bonded to a nozzle plate 202 made of stainless steel in which the nozzle (hole) 203 is formed, via an adhesive film 205, and another metal plate 204 made of stainless steel is further bonded to the first-mentioned metal plate 204 via an adhesive film 205. Furthermore, a communication port forming plate 206 and a cavity plate 207 are sequentially bonded to the second-mentioned metal plate 204.

The nozzle plate 202, the metal plates 204, the adhesive films 205, the communication port forming plate 206, and the cavity plate 207 are molded into their respective predetermined shapes (a shape in which a concave portion is formed), and the cavity 208 and a reservoir 209 are defined by laminating these components. The cavity 208 and the reservoir 209 communicate with each other via an ink supply port 210. Further, the reservoir 209 communicates with an ink intake port 211.

The diaphragm 212 is placed at the upper surface opening portion of the cavity plate 207, and the piezoelectric element 200 is bonded to the diaphragm 212 via a lower electrode 213. Further, an upper electrode 214 is bonded to the piezoelectric element 200 on the opposite side of the lower electrode 213. A head driver 215 is provided with a driving circuit that generates a driving voltage waveform. The piezoelectric element 200 starts to vibrate when a driving voltage waveform is applied (supplied) between the upper electrode 214 and the lower electrode 213, whereby the diaphragm 212 bonded to the piezoelectric element 200 starts to vibrate. The volume (and the internal pressure) of the cavity 208 varies with the vibration of the diaphragm 212, and ink (liquid) filled in the cavity 208 is thereby ejected through the nozzle 203 in the form of droplets.

A reduced quantity of liquid (ink) in the cavity 208 due to the ejection of droplets is replenished with ink supplied from the reservoir 209. Further, ink is supplied to the reservoir 209 through the ink intake port 211.

Figure 42:
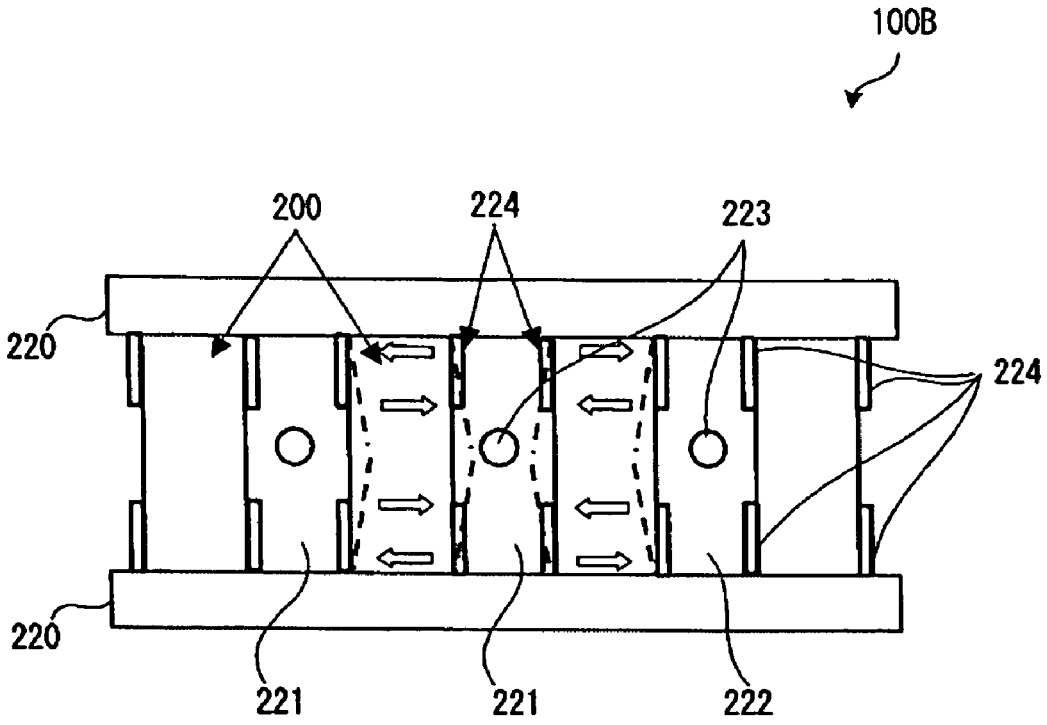
FIG. 42 is a cross sectional view schematically showing an example of still another configuration of the ink jet head of the invention.

Likewise, an ink jet head 100B shown in FIG. 42 is one that ejects ink (liquid material) within a cavity 221 through a nozzle 223 when the piezoelectric element 200 is driven. The ink jet head 100B includes a pair of opposing substrates 220, and a plurality of piezoelectric elements 200 are placed intermittently at predetermined intervals between both substrates 220.

Cavities 221 are formed between adjacent piezoelectric elements 200. A plate (not shown) and a nozzle plate 222 are placed in front and behind the cavities 221 of FIG. 42, respectively, and nozzles (holes) 223 are formed in the nozzle plate 222 at positions corresponding to the respective cavities 221.

Pairs of electrodes 224 are placed on one and the other surfaces of each piezoelectric element 200. That is to say, four electrodes 224 are bonded to one piezoelectric element 200. When a predetermined driving voltage waveform is applied between predetermined electrodes of these electrodes 224, the piezoelectric element 200 undergoes share-mode deformation and starts to vibrate (indicated by arrows in FIG. 42). The volume of the cavities 221 (internal pressure of cavity) varies with the vibration, and ink (liquid material) filled in the cavities 221 is thereby ejected through nozzles 223 in the form of droplets. In other words, the piezoelectric elements 200 per se function as the diaphragms in the ink jet head 100B.

Figure 43:
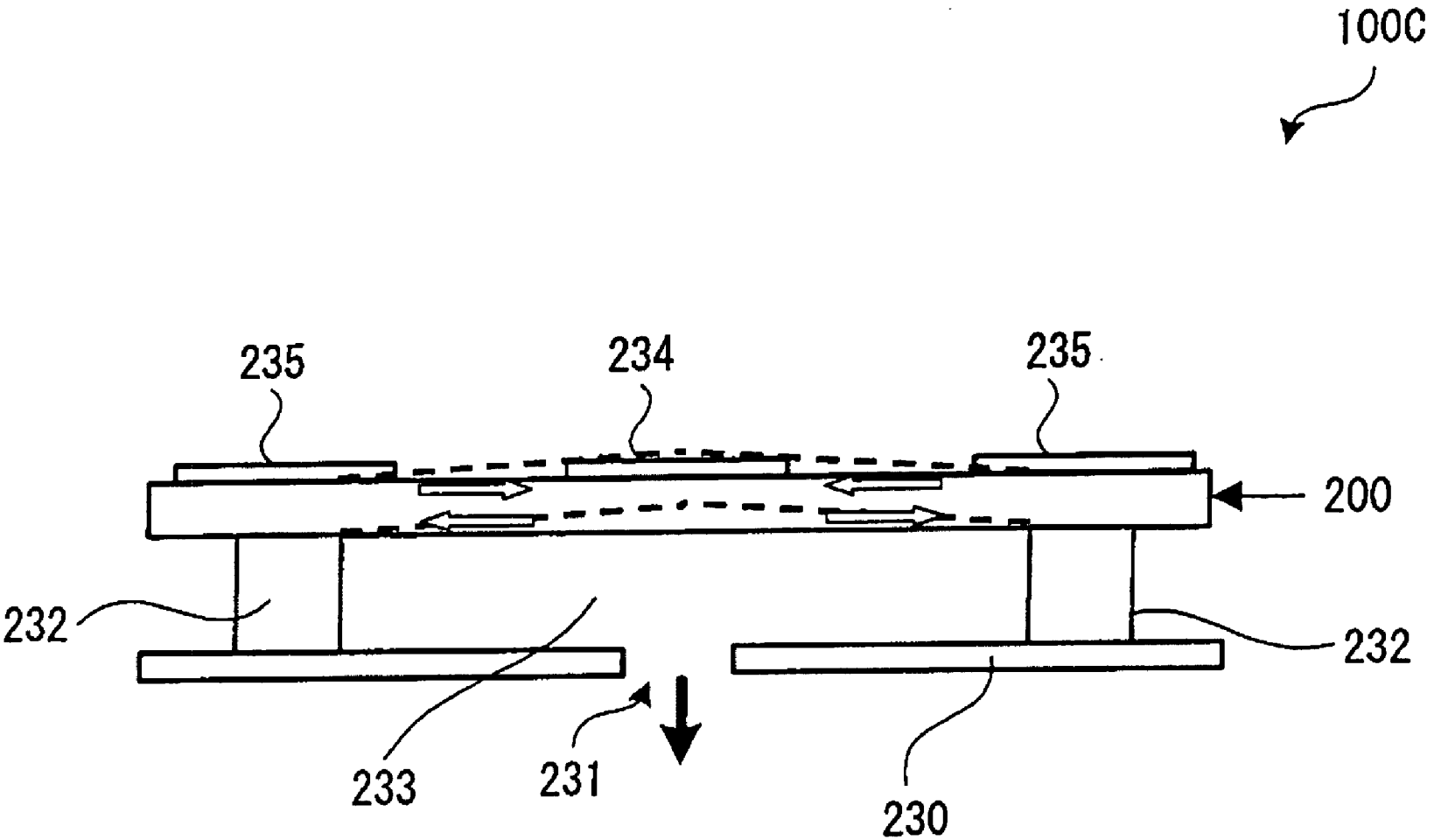
FIG. 43 is a cross sectional view schematically showing an example of still another configuration of the ink jet head of the invention.

Likewise, an ink jet head 100C shown in FIG. 43 is one that ejects ink (liquid material) within a cavity 233 through a nozzle 231 when the piezoelectric element 200 is driven. The ink jet head 100C is provided with a nozzle plate 230 in which the nozzle 231 is formed, spacers 232, and the piezoelectric element 200. The piezoelectric element 200 is placed to be spaced apart from the nozzle plate 230 by a predetermined distance with the spacers 232 in between, and the cavity 233 is defined by a space surrounded by the nozzle plate 230, the piezoelectric element 200, and the spacers 232.

A plurality of electrodes are bonded to the top surface of the piezoelectric element 200 in FIG. 43. To be more specific, a first electrode 234 is bonded to a substantially central portion of the piezoelectric element 200, and second electrodes 235 are bonded on both sides thereof. When a predetermined driving voltage waveform is applied between the first electrode 234 and the second electrodes 235, the piezoelectric element 200 undergoes share-mode deformation and starts to vibrate (indicated by arrows of FIG. 43). The volume of the cavity 233 (internal pressure of cavity 233) varies with the vibration, and ink (liquid material) filled in the cavity 233 is thereby ejected through the nozzle 231 in the form of droplets. In other words, the piezoelectric element 200 per se functions as the diaphragm in the ink jet head 100C.

Figure 44:
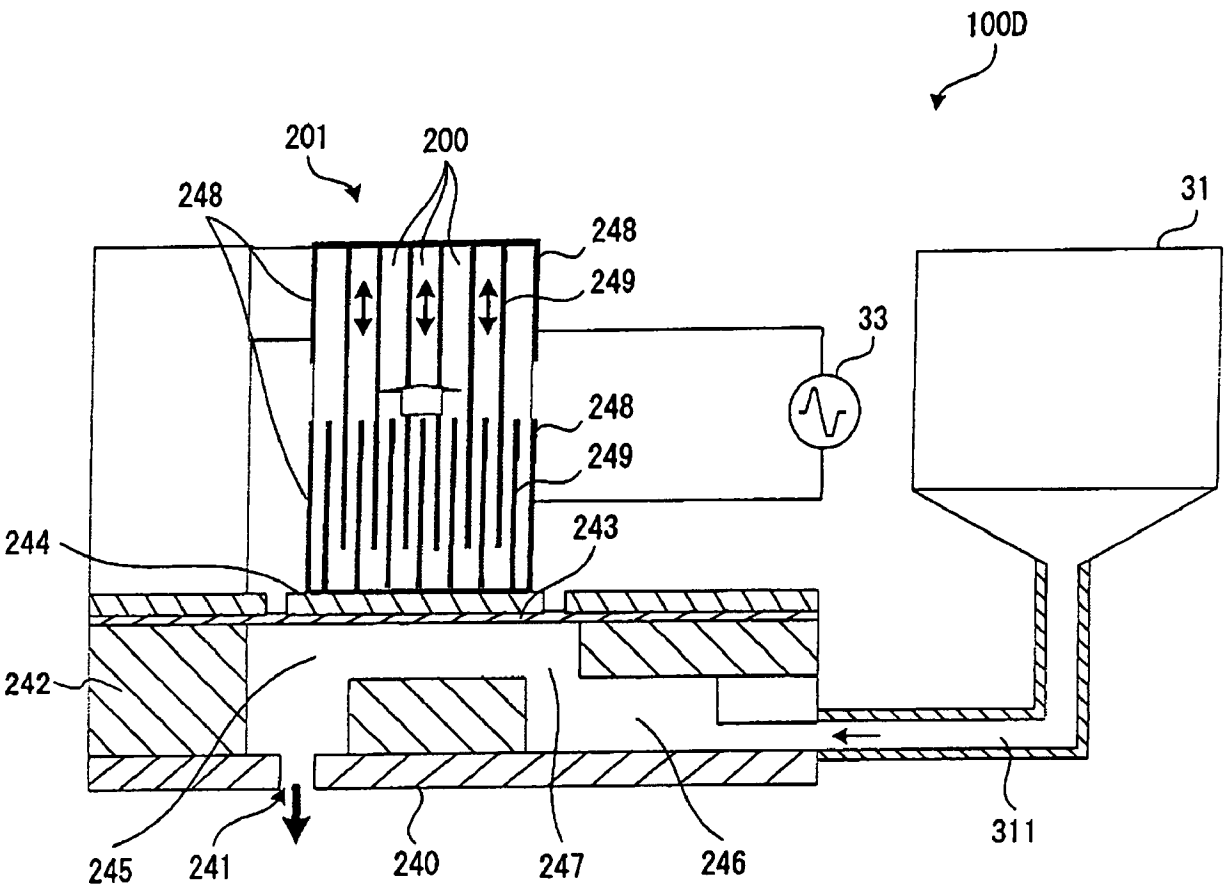
FIG. 44 is a cross sectional view schematically showing an example of still another configuration of the ink jet head of the invention.

Likewise, an ink jet head 100D shown in FIG. 44 is one that ejects ink (liquid material) within a cavity 245 through a nozzle 241 when the piezoelectric element 200 is driven. The ink jet head 100D is provided with a nozzle plate 240 in which the nozzle 241 is formed, a cavity plate 242, a diaphragm 243, and a layered piezoelectric element 201 comprising a plurality of piezoelectric elements 200 to be layered.

The cavity plate 242 is molded into a predetermined shape (a shape in which a concave portion is formed), by which the cavity 245 and a reservoir 246 are defined. The cavity 245 and the reservoir 246 communicate with each other via an ink supply port 247. Further, the reservoir 246 communicates with an ink cartridge 31 via an ink supply tube 311.

The lower end of the layered piezoelectric element 201 in FIG. 44 is bonded to the diaphragm 243 via an intermediate layer 244. A plurality of external electrodes 248 and internal electrodes 249 are bonded to the layered piezoelectric element 201. To be more specific, the external electrodes 248 are bonded to the outer surface of the layered piezoelectric element 201 and the internal electrodes 249 are provided in spaces between piezoelectric elements 200, which together form the layered piezoelectric element 201 (or inside each piezoelectric element). In this case, the external electrodes 248 and the internal electrodes 249 are placed so that parts of them are alternately layered in the thickness direction of the piezoelectric element 200.

By applying a driving voltage waveform between the external electrodes 248 and the internal electrodes 249 by the head driver 33, the layered piezoelectric element 201 undergoes deformation (contracts in the vertical direction of FIG. 44) and starts to vibrate as indicated by arrows in FIG. 44, whereby the diaphragms 243 undergoes vibration due to this vibration. The volume of the cavity 245 (internal pressure of cavity 245) varies with the vibration of the diaphragm 243, and ink (liquid material) filled in the cavity 245 is thereby ejected through the nozzle 241 in the form of droplets.

A reduced quantity of liquid (ink) in the cavity 245 due to the ejection of droplets is replenished with ink supplied from the reservoir 246. Further, ink is supplied to the reservoir 246 from the ink cartridge 31 through the ink supply tube 311.

As with the electric capacitance type of ink jet head 100 as described above, the ink jet heads 100A through 100D provided with piezoelectric elements are also able to detect an ejection failure of droplets and identify the cause of the ejection failure on the basis of the residual vibration of the diaphragm or the piezoelectric element functioning as the diaphragm. Alternatively, the ink jet heads 100B and 100C may be provided with a diaphragm (diaphragm used to detect the residual vibration) serving as a sensor at a position facing the cavity, so that the residual vibration of this diaphragm is detected.

(Third Embodiment)

Next, a third embodiment of the invention will now be described.

Figure 45:
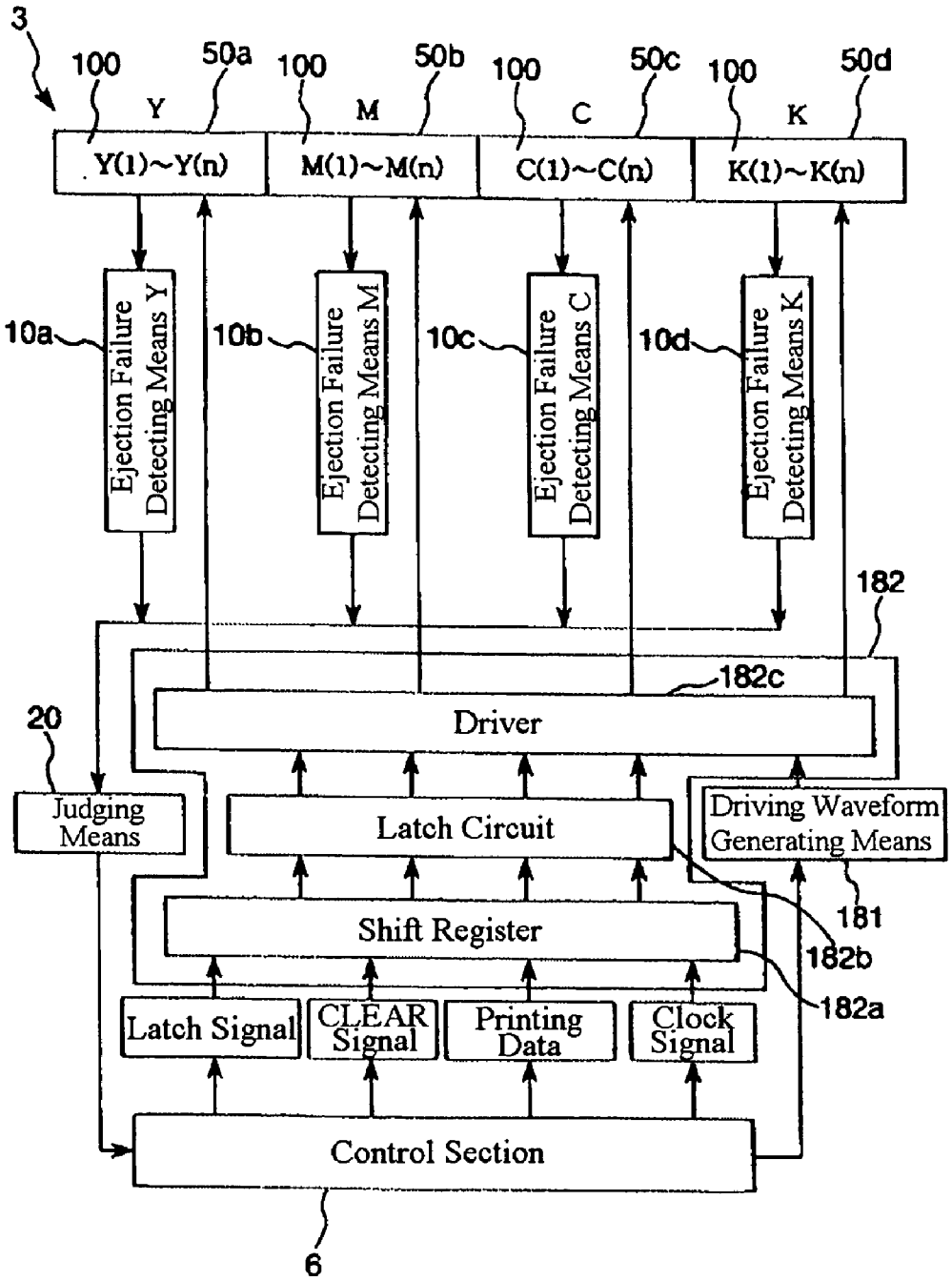
FIG. 45 is a block diagram showing a main portion of a droplet ejection apparatus in a third embodiment according to the invention.
Figure 46:
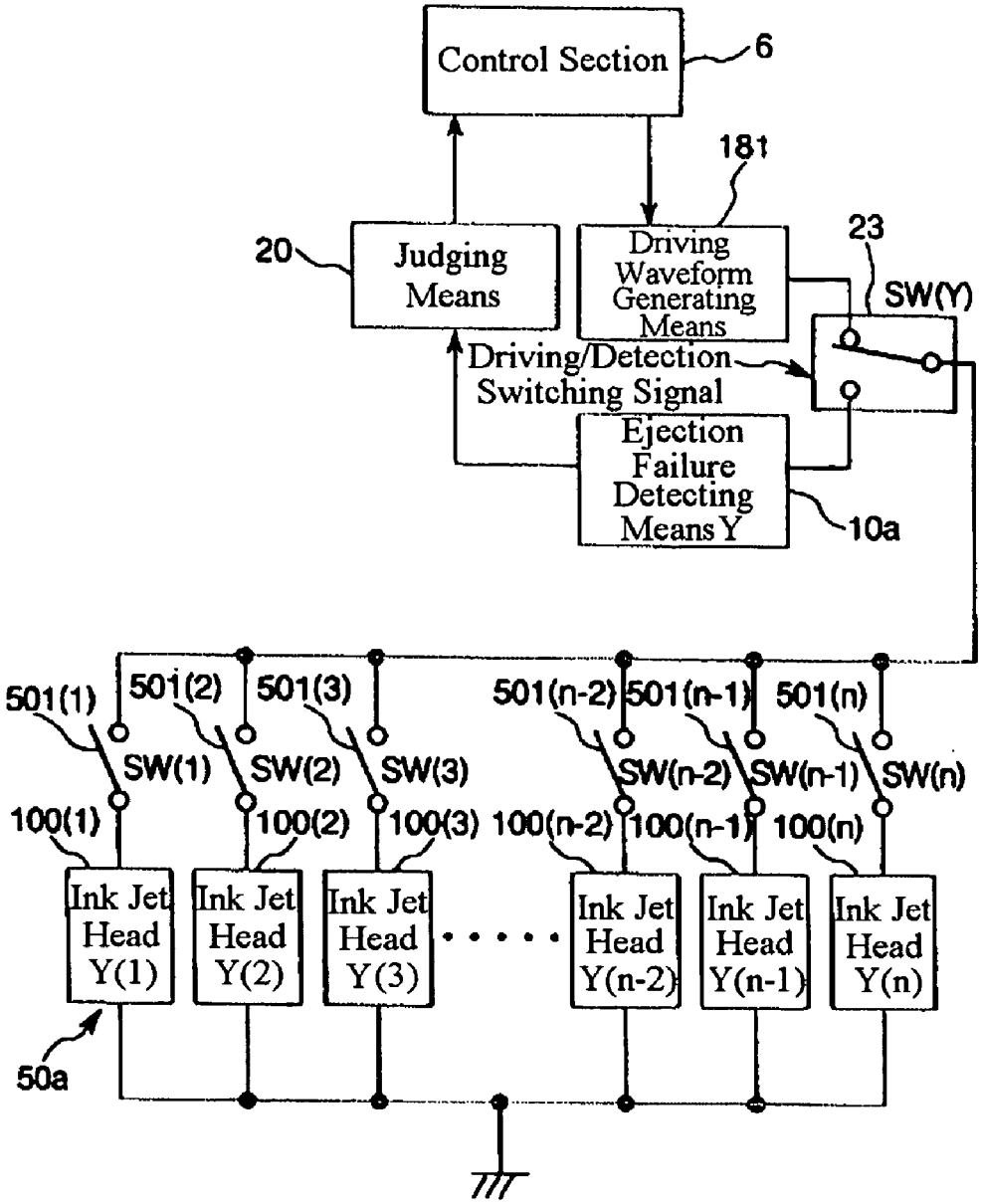
FIG. 46 is a block diagram showing one block of the droplet ejection apparatus shown in FIG. 45.

FIG. 45 is a block diagram showing a main portion of a droplet ejection apparatus in the third embodiment according to the invention. FIG. 46 is a block diagram showing one block of the droplet ejection apparatus shown in FIG. 45.

Hereinafter, an explanation will be given with reference to these drawings; however, differences from the first embodiment described above will be chiefly described, and the description of the similar portions is omitted.

In the ink jet printer (droplet ejection apparatus) 1 of the third embodiment, "n" ink jet heads (droplet ejection heads) 100 (here, "n" is a natural number) constitute one block 50, and a plurality of ink jet heads (droplet ejection heads) are divided to "m" blocks 50 (here, "m" is a natural number). The ink jet printer 1 is provided with the same number of ejection failure detecting means 10 as the block 50 (that is, "m" ejection failure detecting means), and each of the ejection failure detecting means 10 is assigned to a predetermined block 50. The ink jet printer 1 is adapted to control the flushing means to carry out the flushing processes in which a droplet is in turn ejected through the nozzle 110 of each of the ink jet heads 100 in each of the blocks 50 n'th times to a non-recording region (predetermined region on which ink droplets are allowed to land), and at this time each of the plurality of ejection failure detecting means 10 sequentially carries out the detection and judgment of the ejection failure for each of the n ink jet heads 100 in the block 50 corresponding to each of the plurality of ejection failure detecting means 10.

Hereinafter, a description will be given in detail with reference to an example shown in the drawings.

As shown in FIG. 45, the printing means 3 has four blocks (head blocks) 50*a*, 50*b*, 50*c*, and 50*d* for four colors of inks including yellow (Y), magenta (M), cyan (c), and black (K). The n ink jet heads 100 (nozzles 110) for each of the colors of ink including yellow (Y), magenta (M), cyan (c), and black (K) are arranged on each of the blocks 50*a*, 50*b*, 50*c* and 50*d*. In this regard, in the drawings and the following explanation, "yellow", "magenta", "cyan" and "black" are respectively referred to as "Y", "M", "C" and "K".

The four ejection failure detecting means 10*a*, 10*b*, 10*c* and 10*d* are assigned to the blocks 50*a*, 50*b*, 50*c* and 50*d*, respectively. Further, in this embodiment, one judging means 20 is provided separately from the ejection failure detecting means 10*a*, 10*b*, 10*c* and 10*d*.

In this case, a plurality of judging means 20 (for example, the same number as the ejection failure detecting means 10) may be provided to the ink jet printer 1, or the judging means 20 may be included in the ejection failure detecting means 10 as in the first embodiment described above.

The block 50*a* for Y is shown in FIG. 46. As shown in FIG. 46, the n ink jet heads 100 for Y are respectively connected to the ejection failure detecting means 10*a* and the driving waveform generating means 181 via n open/close switches 501 and the switching means 23. The n open/close switches 501 and the switching means 23 are controlled by the control section 6, respectively. Although it is not shown in the drawings, each of the other blocks 50, that is, the block 50*b* for M, the block 50*c* for C and the block 50*d* for K, has the same construction as the block 50*a* for Y.

As described above, the printing data inputted from the host computer 8 is delivered from the shift register 182*a* to the latch circuit 182*b*, one or more ink jet heads 100 to eject a ink droplet are selected from the plurality of ink jet heads 100. Then, a driving waveform is inputted into predetermined ink jet heads 100 from the driving waveform generating means 181 of the driving circuit 18 via the driver 182*c*.

Thus, ink droplets are ejected from the nozzles 110 of the predetermined ink jet heads 100, and the ejected ink droplets are landed on a recording sheet P, whereby a recording operation is made.

Here, depending on an image or letters to be recorded, there are the nozzles 110 through which ink droplets are ejected frequently, and the nozzles 110 through which ink droplets are ejected hardly. The latter nozzles 110, that is, the nozzles through which ink droplets are ejected hardly fall into a state where the ejection stability of ink droplets is inferior by developing the drying of ink without carrying out the flushing operations. In the case of a serial printer, the flushing operations are periodically carried out when the printing means 3 is in a cleaning position that is a non-recording region. This makes it possible to prevent the nozzles 110 from drying, thereby keeping up a nozzle state of each of the ink jet heads 100. The several numbers of ink droplet ejections in the flushing process are set in the range of substantially dozens to thousands depending on, for example, an ambient temperature or time interval of the flushing process. In this embodiment, the detection and judgment of an ejection failure is carried out during the flushing process. This makes it possible to become efficient without the need for a special time required carrying out the ejection failure detecting and judging processing, and to keep the amount of consumption of ink to a minimum.

Next, the operation when the ejection failure detecting and judging processing is carried out during the flushing process will be described using the block 50*a* for Y representatively. In this regard, in order to identify a predetermined open/close switch 501 and ink jet head 100 from the n open/close switches 501 and the n ink jet heads 100, the numbers of 1 to n in parentheses (i.e., (1) to (n)) are respectively added to them in FIG. 46 and the following explanation.

As shown in FIG. 46, at the flushing process, the switching means 23 first switches a connection of the ink jet heads 100 to the driving waveform generating means 181 side (that is, the switching means 23 switches so that the driving waveform generating means 181 is connected to the ink jet heads 100), all the open/close switches 501(1) to 501(n) are turned ON, whereby ink droplets are ejected through the nozzles 110 of all the ink jet heads 100 (that is, a first ink droplet ejection operation is carried out). Hereupon, the switching means 23 switches a connection of the ink jet heads 100 to the ejection failure detecting means 10*a* side (that is, the switching means 23 switches so that the ejection failure detecting means 10*a* is connected to the ink jet heads 100, and the open/close switches 501(2) to 501(n) except for the open/close switch 501(1) are turned OFF. Thus, only the ink jet head 100(1) is connected to the ejection failure detecting means 10*a*, and as described above, the detection and judgment of the ejection failure is carried out for the ink jet head 100(1).

Next, the switching means 23 switches the connection of the ink jet head 100 to the driving waveform generating means 181 side again, and all the open/close switches 501(1) to 501(n) are turned ON, whereby ink droplets are ejected through the nozzles 110 of all the ink jet heads 100 (that is, a second ink droplet ejection operation is carried out). Hereupon, the switching means 23 switches the connection of the ink jet heads 100 to the ejection failure detecting means 10*a* side (that is, the switching means 23 switches so that the ejection failure detecting means 10*a* is connected to the ink jet heads 100, and the open/close switches 501(1), and 501(3) to 501(n) except for the open/close switch 501(2) are turned OFF. Thus, only the ink jet head 100(2) is connected to the ejection failure detecting means 10*a*, and as described above, the detection and judgment of the ejection failure is carried out for the ink jet head 100(2).

Subsequently, the detection and judgment of the ejection failure is sequentially carried out for the ink jet heads 100(3) to 100(n) one by one in a similar manner.

In this case, since the operation in each of the other blocks 50, that is, the block 50*b* for M, the block 50*c* for C and block 50*d* for K is the same as in the block 50*a* for Y described above, the description thereof is omitted.

In this way, the number of ink jet heads 100 in each block 50 that one ejection failure detecting means 10 handles corresponds with the number of ejections of ink droplets in the flushing process. Hence, it is possible to carry out the ejection failure detecting and judging processing for all the ink jet heads 100 once at one flushing process.

Further, in this embodiment, although the example in which the number of blocks 50 is the same as the number of colors of inks has been described, it is no need that they are the same. For example, the ink jet heads 100 corresponding to each of the colors Y, M, C and K may be divided into a plurality of blocks (sub-blocks).

Next, timing (time) to carry out the ejection failure detecting and judging processing when the ink droplets are ejected n times (during the flushing process) or the like will be described.

As the timing (time) to carry out the ejection failure detecting and judging processing during the flushing process, for example, the following (1) to (4) may be mentioned. Onetime may be selected from these times, or arbitrary two or more times may be selected (that is, arbitrary two or more times are combined).

(1) The ejection failure detecting and judging processing is carried out periodically (is repeated at predetermined constant time intervals).

This makes it possible to keep up the state of the nozzles 110 in the respective ink jet heads 100, and it is possible to carry out the ejection failure detecting and judging processing for the respective nozzles 110 periodically.

(2) In the case of a serial ink jet printer, the ejection failure detecting and judging processing is carried out periodically whenever the printing means 3 (the ink jet heads 100) reciprocates in the main scanning direction.

This makes it possible to keep up the state of the nozzles 110 in the respective ink jet heads 100, and it is possible to carry out the ejection failure detecting and judging processing for the respective nozzles 110 every reciprocation of the printing means 3 (ink jet heads 100).

(3) The ejection failure detecting and judging processing is carried out immediately after the ink jet printer 1 has been powered on.

This makes it possible to keep up the state of the nozzles 110 in the respective ink jet heads 100 surely immediately after the ink jet printer 1 has been powered on, and it is possible to carry out the ejection failure detecting and judging processing for the respective nozzles 110 at this time.

(4) The ejection failure detecting and judging processing is carried out immediately after the recovery means 24 has carried out the recovery processing.

This makes it possible to keep up the state of the nozzles 110 in the respective ink jet heads 100 surely immediately after the recovery means 24 carried out the recovery processing, and it is possible to carry out the ejection failure detecting and judging processing for the respective nozzles 110 at this time.

As described above, according to the ink jet printer 1 in the third embodiment of the invention, since the ejection failure detecting and judging processing is carried out during the flushing process, it is possible to become efficient without the need for a special time required carrying out the ejection failure detecting and judging processing, and it is possible to detect and judge an ejection failure of the nozzle 110 in the respective ink jet heads 100 while keeping the amount of consumption of ink to a minimum.

Further, since the number of ejection of ink droplets (that is, "n") is the same as the number of ink jet heads 100 in one block and the same number of ejection failure detecting means 10 as the number of blocks (that is, "m") are provided to the ink jet printer 1, it is possible to carry out the ejection failure detecting and judging processing surely for the ink jet heads 100 one by one at the "n" ejections of ink droplets. Moreover, it is possible to reduce the number of ejection failure detecting means 10 in comparison with the case where the number of ejection failure detecting means 10 is the same as the number of ink jet heads 100, and this makes it possible to scale down the circuitry of the head unit 35, and to prevent the manufacturing costs of the ink jet printer 1 from increasing.

In this regard, the feature of the third embodiment can be applied to the second embodiment described above and a fourth embodiment described below.

(Fourth Embodiment)

Figure 47:
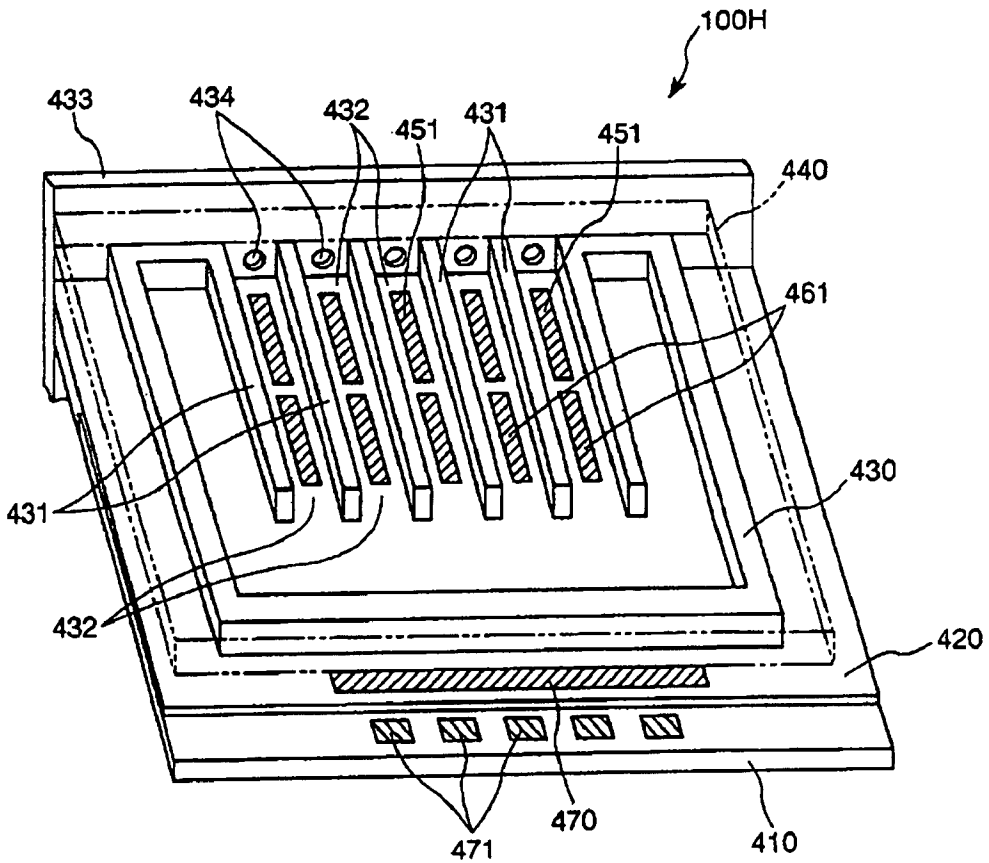
FIG. 47 is a perspective view showing an example of still another configuration of the head unit of the invention.
Figure 48:
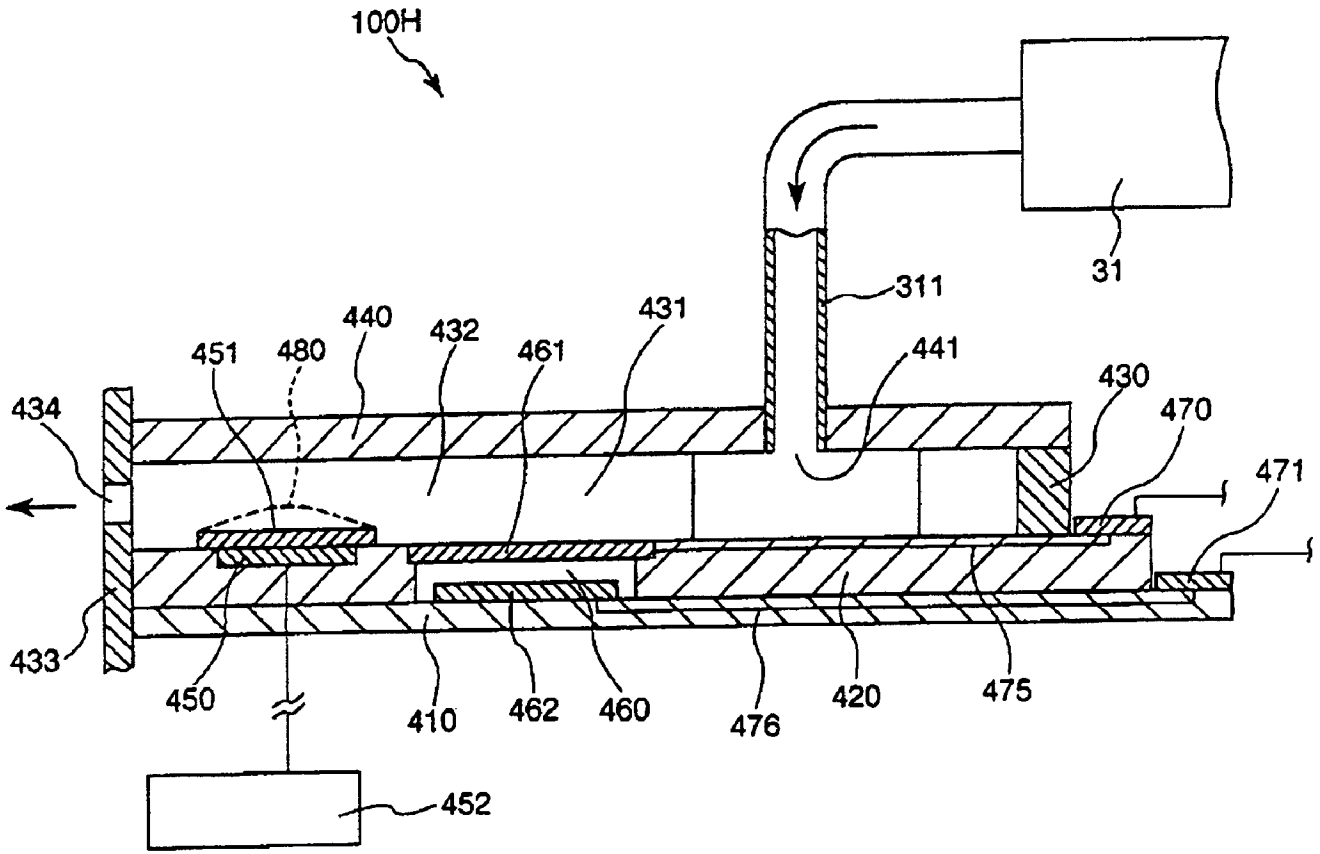
FIG. 48 is a schematic cross sectional view of the head unit shown in FIG. 47.

An example of still another configuration of the ink jet head of the invention will now be described. FIG. 47 is a perspective view showing the configuration of a head unit 100H. FIG. 48 is a schematic cross sectional view of the head unit 100H corresponding to one color of ink (one cavity) shown in FIG. 47. Hereinafter, an explanation will be given with reference to these drawings; however, differences from the first embodiment described above will be chiefly described, and the description of the similar portions is omitted.

The head unit 100H shown in these drawings is a so-called film boiling type of ink jet head (thermal jet type), and is provided with a supporting plate 410, a substrate 420, an outer wall 430, partition walls 431, and a top plate 440, which are bonded to each other in this order from bottom to top of FIGS. 47 and 48.

The substrate 420 and the top plate 440 are placed so that they are spaced apart by a predetermined interval and the outer wall 430 and a plurality of (six in the case of the drawings) partition walls 431 aligned in parallel at regular intervals are placed therebetween. Thus, a plurality of (five in the case of the drawings) cavities (pressure chambers, or ink chambers) 432 are defined in a space between the substrate 420 and the top plate 440 by the partition walls 431. Each cavity 432 is shaped like a strip (rectangular parallelepiped).

Further, as shown in FIGS. 47 and 48, the left ends of the respective cavities 432 in FIG. 48 (top ends in FIG. 47) are covered with a nozzle plate (front plate) 433. The nozzle plate 433 is provided with nozzles (holes) 434 respectively communicating with the cavities 432, and ink (liquid material) is ejected through these nozzles 434.

In FIG. 47, the nozzles 434 are aligned linearly, that is, in a row, with respect to the nozzle plate 433. It goes without saying, however, that the arrangement pattern of the nozzles 434 is not limited to this pattern. A pitch between the nozzles 434 aligned in a row may be arbitrarily set in accordance with the printing resolution (dpi: dot per inch).

In this regard, the nozzle plate 433 may be omitted, and instead, it may be configured in such a manner that the top ends of the respective cavities 432 in FIG. 47 (left ends in FIG. 48) are open, and these opened openings are used as the nozzles.

Further, an ink intake port 441 is formed in the top plate 440, and an ink cartridge 31 is connected to the ink intake port 441 via an ink supply tube 311. It is not shown in the drawings; however, the head unit 100H may be provided with a damper including a damper chamber between the ink intake port 441 and the ink cartridge 31 (i.e., it may be provided with a damper formed from rubber, and the volume of the damper chamber is changed due to the deformation damper). Thus, because the damper chamber 130 absorbs fluctuation of ink and a change in ink pressure when the carriage 32 reciprocates, it is possible to supply a predetermined amount of ink to the head unit 100H stably.

The supporting plate 410, the outer wall 430, the partition walls 431, the top plate 440 and the nozzle plate 433 are respectively made of, for example, various kinds of metal materials such as stainless steel, various kinds of resin materials, various kinds of ceramics, or the like. Further, the substrate 420 is made of, for example, silicon or the like.

Heating elements 450 are provided (buried) in the substrate 420 at positions corresponding to the respective cavities 432. The heating elements 450 are electrically conducted separately by a head driver (electrically conducting means) 452 to heat themselves. The head driver 452 outputs, for example, a pulsed signal as a driving signal of the heating elements 450 in response to the printing signal (printing data) inputted from the control section 6.

The surface of each heating element 450 on the cavity 432 side is covered with a protection film (cavitation-proof (cavitation-resistant) film) 451. The protection film 451 is provided to prevent the heating elements 450 from coming into direct contact with ink within the cavities 432. By providing the protection film 451, it is possible to prevent degeneration, deterioration, and the like caused when the heating elements 450 come into contact with ink.

Concave portions 460 are formed in the substrate 420 at the positions in the vicinity of the respective heating elements 450 and corresponding to the respective cavities 432. The concave portions 460 can be formed, for example, by etching, stamping, or the like.

A diaphragm 461 is provided to shield each concave portion 460 on the cavity 432 side. The diaphragm 461 undergoes elastic deformation (displaces elastically) in the vertical direction in FIG. 48 so as to follow a change in the internal pressure of the cavity 432 (liquid pressure).

Constituent material and thickness of the diaphragm 461 is not particularly limited, and may be set arbitrarily.

On the other hand, the other side of the concave portion 460 is covered with the supporting plate 410, and segment electrodes 462 are provided on the top surface of the supporting plate 410 in FIG. 48 at positions corresponding to the respective diaphragms 461.

The diaphragm 461 and the segment electrode 462 are provided oppositely in substantially parallel so as to be spaced apart from each other by a predetermined distance. A gap distance (gap length g) between the diaphragm 461 and the segment electrode 462 is not particularly limited, and may be set arbitrarily. A parallel plate capacitor can be formed by placing the diaphragm 461 and the electrode 462 to be spaced apart from each other by a slight distance in this manner. As described above, when the diaphragm 461 displaces (deforms) elastically in the vertical direction in FIG. 48 so as to follow an internal pressure of the cavity 432, a distance of the space between the diaphragm 461 and the electrode 462 varies in response to the displacement, thereby varying (changing) the electric capacitance C of the parallel plate capacitor. Because the change in the electric capacitance C appears as change in frequency difference when converted into information on the frequency by oscillation of the CR oscillation circuit, as described above, by detecting this potential difference, it is possible to detect (sense) the residual vibration (damped vibration) of the diaphragm 461.

The common electrode 470 is formed on the substrate 420 outside of the cavities 432. Further, the outer segment electrodes 471 are formed on the supporting plate 410 outside of the cavities 432.

As for constituent material of the segment electrode 462, the common electrode 470 and the outer segment electrodes 471, for example, stainless steel, aluminum, gold, copper, or alloys containing two or more kinds selected from these metals, or the like. Further, each of the segment electrodes 462, the common electrode 470 and the outer segment electrodes 471 can be formed, for example, by bonding of metal foil, plating, vapor deposition, sputtering, or the like.

The respective diaphragms 461 and the common electrode 470 are electrically connected to each other via a conductor 475. The respective segment electrodes 462 and the respective outer segment electrodes 471 are electrically connected to each other via a conductor 476.

The conductors 475 and 476 may comprise (1) installation of conducting wire such as a metal wire, (2) a thin film made on the surface of the substrate 420 or the supporting plate 410 from an electrically conductive material such as gold and copper, (3) a conductor forming site in the substrate 420 or the like provided with electrical conduction by doping ions therein, and the like.

Figure 49:
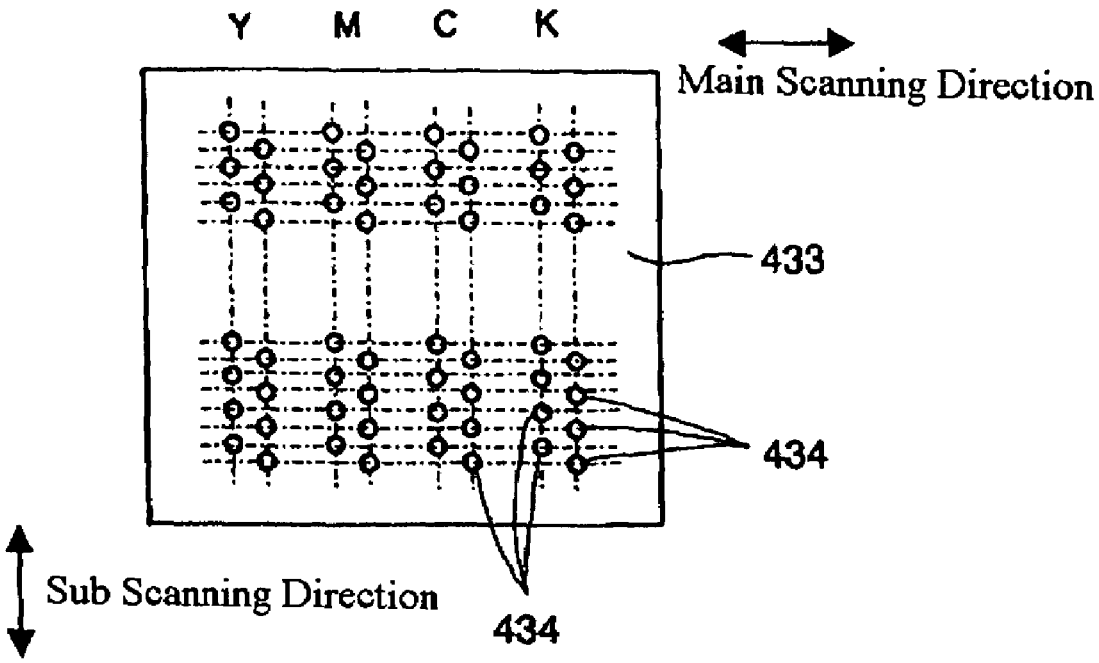
FIG. 49 is a plan view showing another example of a nozzle arrangement pattern in a nozzle plate of the head unit using four colors of inks.

The head units 100H as described above can be placed in such a manner so as to be laminated in the vertical direction in FIG. 48. FIG. 49 shows an example of arrangement of the nozzles 434 in the case where four colors of inks (ink cartridges 31) are provided. In this case, by arranging a plurality of head units 100H so as to be laminated in the main scanning direction, for example, and bonding one piece of nozzle plate 433 on the front surfaces thereof, this nozzle arrangement may be constructed.

The arrangement pattern of the nozzles 434 on the nozzle plate 433 is not particularly limited, and as shown in FIG. 49, adjacent nozzle rows may be arranged so that the nozzles 434 of the adjacent nozzle rows are shifted by a half pitch each other.

The function (operation principle) of the head unit 100H will now be described.

When the heating elements 450 are electrically conducted as a driving signal (pulse signal) is outputted from the head driver 452, the heating elements 450 heat instantaneously to a temperature as high as or higher than 300° C. This generates an air bubble (different from the above-mentioned air bubble that is generated and intrudes into the cavity to cause an ejection failure) 480 on the protection film 451 due to film boiling, and the air bubble 480 swells instantaneously. This raises the liquid pressure of ink (liquid material) filled in the cavity 432, and part of ink is thereby ejected through the nozzle 434 in the form of droplets.

The air bubble 480 contracts abruptly immediately after the ink droplet is ejected, and restores to the original state. The diaphragm 461 displaces (deforms) elastically with a change in internal pressure of the cavity 432 at this time, thereby giving rise to damped vibration (residual vibration) that lasts until ink droplet is ejected again by inputting the following driving signal.

Once the diaphragm 461 starts the damped vibration, the electric capacitance between the diaphragm 461 and the opposing segment electrode 462 starts to vary in accordance with the damped vibration. The variation in the electric capacitance appears as a variation in the potential difference between the common electrode 470 and the outer segment electrode 471. By reading the variation in the potential difference, it is possible to detect and identify an ejection failure and/or a cause thereof. Namely, by comparing a pattern of the variation in the detected potential difference with a pattern (state) of the variation in the potential difference (variation in the electric capacitance) between the common electrode 470 and the outer segment electrode 471 when an ink droplet is ejected through the nozzle 434 normally, it is possible to judge whether or not an ink droplet is ejected normally. In addition, by comparing the pattern of the variation in the detected potential difference with patterns of the variation in the potential difference in the causes of ejection failures (missing dot) of the ink droplets and identifying the cause, it is possible to judge the cause of the ejection failure.

A reduced quantity of liquid within the cavity 432 due to the ejection of the ink droplet is replenished as new ink is supplied through the ink intake port 441 to the cavity 432. This ink is supplied from the ink cartridge 31 by flowing through the ink supply tube 311.

As described above, the droplet ejection apparatus and the method of detecting and judging an ejection failure in droplet ejection heads of the invention includes: a plurality of droplet ejection heads each having a cavity, a diaphragm, an actuator and a nozzle; a driving circuit that drives each of the actuators; ejection selecting means for selecting the nozzle or nozzles of the droplet ejection heads in response to printing data or the like; one or more ejection failure detecting means for detecting an ejection failure of droplets on the basis of the residual vibration of the diaphragm; one or more switching means for switching a connection of the actuator from the driving circuit to the ejection failure detecting means. The droplet ejection apparatus and the method of the invention detects and judges the ejection failure on the basis of the residual vibration of the diaphragm after a droplet ejection operation in the flushing operation or printing operation.

Therefore, according to the droplet ejection apparatus and the method of detecting and judging an ejection failure in droplet ejection heads of the invention, it is possible to detect and judge an ejection failure for each of the nozzles of the droplet ejection heads including a plurality of nozzles without providing other detecting device on the droplet ejection heads. Hence, it is no need to increase the size of the droplet ejection head, and it is possible to prevent the manufacturing cost of the droplet ejection apparatus that can detect an ejection failure from increasing.

The droplet ejection apparatus the method of detecting and judging an ejection failure in the droplet ejection heads of the invention have been described based on embodiments shown in the drawings, but it is to be understood that the invention is not limited to these embodiments, and respective portions forming the droplet ejection head or the droplet ejection apparatus can be replaced with an arbitrary arrangement capable of functioning in the same manner. Further, any other arbitrary component may be added to the droplet ejection head or the droplet ejection apparatus of the invention.

Liquid to be ejected (droplets) that is ejected from a droplet ejection head (ink jet head 100 in the embodiments described above) in the droplet ejection apparatus of the invention is not particularly limited, and for example, it may be liquid (including dispersion liquid such as suspension and emulsion) containing various kinds of materials as follows. Namely, a filter material (ink) for a color filter, a light-emitting material for forming an EL (Electroluminescence) light-emitting layer in an organic EL apparatus, a fluorescent material for forming a fluorescent body on an electrode in an electron emitting device, a fluorescent material for forming a fluorescent body in a PDP (Plasma Display Panel) apparatus, a migration material forming a migration body in an electrophoresis display device, a bank material for forming a bank on the surface of a substrate W, various kinds of coating materials, a liquid electrode material for forming an electrode, a particle material for forming a spacer to provide a minute cell gap between two substrates, a liquid metal material for forming metal wiring, a lens material for forming a microlens, a resist material, a light-scattering material for forming a light-scattering body, liquid materials for various tests used in a bio-sensor such as a DNA chip and a protein chip, and the like may be mentioned.

Further, in the invention, a droplet receptor to which droplets are ejected is not limited to paper such as a recording sheet, and it may be other media such as a film, a woven cloth, a non-woven cloth or the like, or a workpiece such as various types of substrates including a glass substrate, a silicon substrate and the like.

INDUSTRIAL APPLICABILITY

As has been explained above, according to the invention, it is possible to detect and judge an ejection failure in each of the nozzles of the droplet ejection heads having a plurality of nozzles, and to reduce the size of the circuitry in such a droplet ejection apparatus. Therefore, this makes it possible to prevent the manufacturing cost of the droplet ejection apparatus from increasing.

This application claims priority to Japanese Patent Application No. 2003-092934 filed Mar. 28, 2003, which is hereby expressly incorporated by reference herein in its entirety.

What is claimed is:

1. A droplet ejection apparatus comprising:

a plurality of droplet ejection heads, each of the droplet ejection heads including:

a diaphragm;

an actuator which displaces the diaphragm;

a cavity filled with a liquid, an internal pressure of the cavity being increased and decreased in response to displacement of the diaphragm; and a nozzle communicated with the cavity, through which the liquid in the cavity is ejected in the form of droplets in response to the increase and decrease of the internal pressure of the cavity;

a driving circuit which drives the actuator of each droplet ejection head;

ejection selecting means for selecting the nozzle of the droplet ejection head in the plurality of droplet ejection heads from which a droplet is to be ejected;

detection determining means that determines for which nozzle of the droplet ejection head an ejection failure of the droplets is to be detected;

ejection failure detecting means for detecting a residual vibration of the diaphragm in the droplet ejection head determined by the detection determining means and detecting the ejection failure of the droplets on the basis of a vibration pattern of the detected residual vibration of the diaphragm; and a plurality of switching means respectively corresponding to the plurality of droplet ejection heads, wherein, after carrying out a droplet ejection operation by driving the actuator corresponding to the nozzle of the droplet ejection head determined by the detection determining means, the switching means corresponding to the determined droplet ejection head switches a connection of the driven actuator in the determined droplet ejection head from the driving circuit to the ejection failure detecting means, wherein the detection determining means repeatedly carries out a scanning operation in which any one of the plurality of switching means is sequentially scanned in a predetermined order, determines the droplet ejection head as a droplet ejection head for which the detection of the ejection failure of the droplets is to be carried out when the timing of the droplet ejection operation of the droplet ejection head coincides with the timing of the scanning of the switching means.

2. A droplet ejection apparatus comprising:

a plurality of droplet ejection heads, each of the droplet ejection heads including an actuator, a diaphragm displaced by the actuator, a cavity filled with a liquid, and a nozzle communicated with the cavity, through which the liquid within the cavity is ejected in the form of droplets by driving the actuator, the plurality of droplet ejection heads being divided to m blocks (here, "m" is a natural number), and one of the m blocks including n droplet ejection heads (here, "n" is a natural number);

a driving circuit which drives the actuator of each of the droplet ejection heads;

a plurality of ejection failure detecting means for detecting a residual vibration of the diaphragm and detecting an ejection failure of the droplets on the basis of a vibration pattern of the detected residual vibration of the diaphragm, the number of ejection failure detecting means being the same as the number of blocks, and the plurality of ejection failure detecting means being respectively assigned to the blocks; and recovery means for carrying out recovery processing for the droplet ejection heads to eliminate a cause of the ejection failure of the droplets, the recovery means comprising at least flushing means for carrying out a flushing process by which the droplets are preliminarily ejected through the nozzles of the droplet ejection heads by driving the actuators corresponding to the droplet ejection heads;

wherein the droplet ejection apparatus is adapted to control the flushing means to carry out the flushing processes in which a droplet is in turn ejected through the nozzle of each of the droplet ejection heads in each of the blocks n'th times to a predetermined region on which the droplets are allowed to land in order to keep up a nozzle state of each of the droplet ejection heads, and at this time each of the plurality of ejection failure detecting means sequentially carries out the detection of the ejection failure for each of the n droplet ejection heads in the block.

3. The droplet ejection apparatus as claimed in claim 2, further comprising:

a plurality of switching means, each of the plurality of switching means switching connections of the actuators in each of the blocks from the driving circuit to the corresponding ejection failure detecting means after carrying out the droplet ejection operation by driving the actuators.

4. The droplet ejection apparatus as claimed in claim 2, further comprising judging means for judging presence or absence of the ejection failure of the droplets in the droplet ejection heads on the basis of the vibration pattern of the residual vibration of the diaphragm.

5. The droplet ejection apparatus as claimed in claim 4, wherein the judging means judges a cause of the ejection failure in the case where the judging means judges that the ejection failure of the droplets is present in the droplet ejection heads.

6. The droplet ejection apparatus as claimed in claim 5, wherein the judging means judges that: an air bubble has intruded into the cavity in the case where the cycle of the residual vibration of the diaphragm is shorter than a predetermined range of cycle; the liquid in the vicinity of the nozzle has thickened due to drying in the case where the cycle of the residual vibration of the diaphragm is longer than a predetermined threshold; and paper dust is adhering in the vicinity of the outlet of the nozzle in the case where the cycle of the residual vibration of the diaphragm is longer than the predetermined range of cycle and shorter than the predetermined threshold.

7. The droplet ejection apparatus as claimed in claim 2, wherein the droplet ejection apparatus is adapted to periodically carry out the detection of the ejection failure by ejecting the droplets n'th times.

8. The droplet ejection apparatus as claimed in claim 2, wherein the droplet ejection apparatus is adapted to periodically carry out the detection of the ejection failure by ejecting the droplets n'th times every reciprocation of the droplet ejection heads.

9. The droplet ejection apparatus as claimed in claim 2, wherein me droplet ejection apparatus is adapted to carry out the detection of the ejection failure by ejecting me droplets n'th times immediately or me droplet ejection apparatus has been powered on.

10. The droplet ejection apparatus as claimed in claim 2, wherein the droplet ejection apparatus is adapted to periodically carry out the detection of the ejection failure by ejecting the droplets n'th times immediately or the recovery means has carried out the recovery processing.

11. A method of detecting and judging an ejection failure in droplet ejection heads of a droplet ejection apparatus, the droplet ejection apparatus including a driving circuit, a detecting circuit and a plurality of droplet ejection heads, each of the plurality of droplet ejection heads including a diaphragm, an actuator, a cavity and a nozzle, the method comprising the steps of:

selecting the nozzle of the droplet ejection head in the plurality of droplet ejection heads through which a droplet is to be ejected;

driving the actuator of the selected droplet ejection head with the driving circuit to displace the diaphragm;

carrying out a droplet ejecting operation through the nozzle;

switching a connection of the actuator from the driving circuit to the detecting circuit after carrying out the droplet ejection operation;

detecting a residual vibration of the diaphragm with the detecting circuit;

detecting an ejection failure of the droplets on the basis of a vibration pattern of the detected residual vibration of the diaphragm;

judging presence or absence of the ejection failure of the droplets in the droplet ejection heads on the basis of the vibration pattern of the residual vibration of the diaphragm; and judging a cause of the ejection failure in the case where it is judged that the ejection failure of the droplets is present in the droplet ejection heads, wherein the vibration pattern of the residual vibration of the diaphragm includes a cycle of the residual vibration; and wherein the cause judging step includes judging that:

an air bubble has intruded into the cavity in the case where the cycle of the residual vibration of the diaphragm is shorter than a predetermined range of cycle;

the liquid in the vicinity of the nozzle has thickened due to drying in the case where the cycle of the residual vibration of the diaphragm is longer than a predetermined threshold; and paper dust is adhering in the vicinity of the outlet of the nozzle in the case where the cycle of the residual vibration of the diaphragm is longer than the predetermined range of cycle and shorter than the predetermined threshold.

12. The method as claimed in claim 11, wherein the droplet ejection apparatus sequentially carries out the detection of the ejection failure of the droplets for the plurality of droplet ejection heads one by one.

13. The method as claimed in claim 11, wherein the droplet ejection apparatus carries out the detection of the ejection failure of the droplets for each of the plurality of droplet ejection heads substantially simultaneously.

* * * * *